US009053666B2

(12) United States Patent
Minami

(10) Patent No.: US 9,053,666 B2
(45) Date of Patent: Jun. 9, 2015

(54) DISPLAY DEVICE AND ELECTRONIC APPARATUS

(75) Inventor: Tetsuo Minami, Tokyo (JP)

(73) Assignee: Sony Corporation, Tokyo (JP)

( * ) Notice: Subject to any disclaimer, the term of this patent is extended or adjusted under 35 U.S.C. 154(b) by 287 days.

(21) Appl. No.: 13/566,725

(22) Filed: Aug. 3, 2012

(65) Prior Publication Data

US 2013/0050160 A1 Feb. 28, 2013

(30) Foreign Application Priority Data

Aug. 23, 2011 (JP) ..... 2011-181798

(51) Int. Cl.
*G09G 3/32* (2006.01)

(52) U.S. Cl.
CPC ..... *G09G 3/3233* (2013.01); *G09G 3/3266* (2013.01); *G09G 3/3275* (2013.01); *G09G 2300/0426* (2013.01); *G09G 2300/0819* (2013.01); *G09G 2300/0842* (2013.01); *G09G 2300/0866* (2013.01); *G09G 2320/0223* (2013.01); *G09G 2320/0233* (2013.01); *G09G 2320/043* (2013.01)

(58) Field of Classification Search
None
See application file for complete search history.

(56) References Cited

U.S. PATENT DOCUMENTS

| | | | | |
|---|---|---|---|---|
| 5,173,791 | A * | 12/1992 | Strathman et al. | 349/48 |
| 5,576,730 | A * | 11/1996 | Shimada et al. | 345/98 |
| 6,100,865 | A * | 8/2000 | Sasaki | 345/92 |
| 7,119,767 | B1 * | 10/2006 | Komiya et al. | 345/76 |
| 7,369,187 | B2 * | 5/2008 | Park | 349/38 |
| 7,375,722 | B2 * | 5/2008 | Kigo et al. | 345/204 |
| 2001/0033266 | A1 * | 10/2001 | Lee | 345/94 |
| 2002/0024486 | A1 * | 2/2002 | Aoki | 345/87 |
| 2002/0047822 | A1 * | 4/2002 | Senda et al. | 345/90 |
| 2002/0080317 | A1 * | 6/2002 | Yeo et al. | 349/149 |
| 2002/0101547 | A1 * | 8/2002 | Lee et al. | 349/40 |
| 2004/0017531 | A1 * | 1/2004 | Nagata et al. | 349/139 |
| 2004/0041753 | A1 * | 3/2004 | Nakanishi | 345/76 |
| 2004/0207612 | A1 * | 10/2004 | Moon | 345/204 |
| 2006/0066644 | A1 * | 3/2006 | Yamaguchi et al. | 345/690 |

(Continued)

FOREIGN PATENT DOCUMENTS

| | | | |
|---|---|---|---|
| EP | 2 088 577 | A2 | 8/2009 |
| JP | 2007-310311 | A | 11/2007 |

OTHER PUBLICATIONS

Extended European Search Report issued Dec. 5, 2012 for corresponding European Application No. 12176553.1.

*Primary Examiner* — Antonio Xavier
(74) *Attorney, Agent, or Firm* — Fishman Stewart Yamaguchi PLLC

(57) ABSTRACT

A display device includes: (A) scanning circuits; (B) a video signal output circuit; (C) a current supply unit; (D) M current supply lines connected to the current supply unit and extending in a first direction; (E) M scanning lines connected to the scanning circuits and extending in the first direction; (F) N data lines connected to the video signal output circuit and extending in a second direction; and (G) N×M light-emitting elements in total of N light-emitting elements in the first direction and M light-emitting elements in the second direction different from the first direction arranged in a two-dimensional matrix, each light-emitting element having a light-emitting unit and a driving circuit for driving the light-emitting unit. The driving circuit of each light-emitting element is connected to the corresponding current supply, scanning, and data lines. A capacitive load unit is provided between each scanning line and each scanning circuit.

15 Claims, 30 Drawing Sheets

(56) References Cited

U.S. PATENT DOCUMENTS

| | | | | |
|---|---|---|---|---|
| 2006/0170628 | A1* | 8/2006 | Yamashita et al. | 345/76 |
| 2006/0186824 | A1* | 8/2006 | Sun | 315/169.3 |
| 2007/0001945 | A1* | 1/2007 | Yoshida et al. | 345/87 |
| 2007/0001988 | A1* | 1/2007 | Byun | 345/100 |
| 2007/0262948 | A1* | 11/2007 | Han et al. | 345/102 |
| 2008/0001545 | A1* | 1/2008 | Uchino et al. | 315/175 |
| 2008/0111803 | A1* | 5/2008 | Lee et al. | 345/205 |
| 2008/0150928 | A1* | 6/2008 | Van Der Hoef et al. | 345/210 |
| 2009/0128675 | A1* | 5/2009 | Okano et al. | 348/294 |
| 2009/0167972 | A1* | 7/2009 | Hong | 349/37 |
| 2010/0164943 | A1 | 7/2010 | Liu | |
| 2010/0309186 | A1* | 12/2010 | Minami et al. | 345/211 |
| 2011/0058110 | A1* | 3/2011 | Yamada et al. | 348/790 |
| 2011/0175897 | A1* | 7/2011 | Tseng et al. | 345/213 |
| 2011/0242050 | A1* | 10/2011 | Byun et al. | 345/174 |
| 2011/0254830 | A1* | 10/2011 | Chang et al. | 345/213 |

* cited by examiner

[2Tr/1C DRIVING CIRCUIT]

[2Tr/1C DRIVING CIRCUIT]

VIDEO SIGNAL OUTPUT CIRCUIT
102
101
SCANNING CIRCUIT
DTL
DTL
DTL
1
CSL
SCL
SCL
SCL
CURRENT SUPPLY UNIT
100
SCANNING CIRCUIT
101
TERMINATION PORTION OF THE DATA LINE
102B
FIRST DIRECTION
SECOND DIRECTION

102b
DTL

[DISPLAY DEVICE OF 5Tr/1C DRIVING CIRCUIT CONFIGURATION]

[5Tr/1C DRIVING CIRCUIT]

[5Tr/1C DRIVING CIRCUIT]

[5Tr/1C DRIVING CIRCUIT]

[ TP (5) $_{-1}$ ]

[ TP (5) $_1$ ]

[ TP (5) $_1$ ] (CONTINUE)

[ TP (5) $_2$ ]

[5Tr/1C DRIVING CIRCUIT]

[ TP (5) 3 ]

[ TP (5) 4 ]

[ TP (5) 5 ]

[ TP (5) 6 ]

[ TP (5) 7 ]

[DISPLAY DEVICE OF 4Tr/1C DRIVING CIRCUIT CONFIGURATION]

[4Tr/1C DRIVING CIRCUIT]

[4Tr/1C DRIVING CIRCUIT]

[ TP (4) $_{-1}$ ]

[ TP (4) $_{1}$ ]

[ TP (4) $_{2}$ ]

[ TP (4) $_{3}$ ]

[4Tr/1C DRIVING CIRCUIT]

[ TP (4) 4 ]

[ TP (4) 5 ]

[ TP (4) 6 ]

[ TP (4) 7 ]

[DISPLAY DEVICE OF 3Tr/1C DRIVING CIRCUIT CONFIGURATION]

[3Tr/1C DRIVING CIRCUIT]

[3Tr/1C DRIVING CIRCUIT]

[3Tr/1C DRIVING CIRCUIT]

[ TP (3) $_{-1}$ ]

[ TP (3) $_{0}$ ]

[ TP (3) $_{1}$ ]

[ TP (3) $_{2}$ ]

[3Tr/1C DRIVING CIRCUIT]

[ TP (3) 3 ]

[ TP (3) 4 ]

[ TP (3) 5 ]

[ TP (3) 6 ]

[ TP (3) 7 ]

[2Tr/1C DRIVING CIRCUIT]

[2Tr/1C DRIVING CIRCUIT]

[ TP (2) $_{-1}$ ]

[ TP (2) $_0$ ]

[ TP (2) $_1$ ]

[ TP (2) $_2$ ]

[ TP (2) $_3$ ]

[ TP (2) $_4$ ]

[EXISTING 2Tr/1C DRIVING CIRCUIT]

RELATED ART

DISPLAY DEVICE AND ELECTRONIC APPARATUS

FIELD

The present disclosure relates to a display device and an electronic apparatus.

BACKGROUND

In recent years, as a display device which is represented by a liquid crystal display, an organic electroluminescence display device (hereinafter, simply abbreviated as "organic EL display device") using an organic electroluminescence element (hereinafter, simply abbreviated as "organic EL element") is attracting attention. The organic EL display device is of a self-luminous type, and has a characteristic of low power consumption. It is considered that the organic EL display has sufficient responsiveness to a high-definition and high-speed video signal, and the development for practical use and commercialization are closely proceeding.

The organic EL display device has a plurality of light-emitting elements 1 each of which includes a light-emitting unit ELP and a driving circuit for driving the light-emitting unit ELP. For example, FIG. 28 is an equivalent circuit diagram of the light-emitting element 1 which includes the driving circuit having two transistors and one capacitive unit, and FIG. 29 is a conceptual diagram of a circuit which constitutes a display device (for example, see JP-A-2007-310311). The driving circuit has a drive transistor $T_{Drv}$ which includes source/drain regions, a channel forming region, and a gate electrode, a video signal write transistor $T_{Sig}$ which includes source/drain regions, a channel forming region, and a gate electrode, and a capacitive unit $C_1$. Reference numeral $C_{EL}$ represents parasitic capacitance of the light-emitting unit $C_1$.

In the drive transistor $T_{Drv}$, one region of the source/drain regions is connected to a current supply line CSL, and the other of the source/drain regions is connected to the light-emitting unit ELP and also connected to one end of the capacitive unit $C_1$ to constitute a second node $ND_2$. The gate electrode of the drive transistor $T_{Drv}$ is connected to the other of the source/drain regions of the video signal write transistor $T_{Sig}$ and also connected to the other end of the capacitive unit $C_1$ to constitute a first node $ND_1$.

In the video signal write transistor $T_{Sig}$, one region of the source/drain regions is connected to a data line DTL, and the gate electrode is connected to a scanning line SCL.

The display device includes (a) a current supply unit 100, (b) scanning circuits 101, (c) a video signal output circuit 102, (d) N×M light-emitting elements 1 in total of N light-emitting elements in a first direction and M light-emitting elements in a second direction different from the first direction (specifically, a direction perpendicular to the first direction) arranged in a two-dimensional matrix, (e) M current supply lines CSL which are connected to the current supply unit 100 and extend in the first direction, (f) M scanning lines SCL which are connected to the scanning circuits 101 and extend in the first direction, and (g) N data lines DTL which are connected to the video signal output circuit 102 and extend in the second direction. Although in FIG. 29, 3×3 light-emitting elements 1 are shown, this is merely for illustration. The scanning circuits 101 are arranged at both ends of the scanning line SCL.

SUMMARY

Although a method of driving a driving circuit will be described in detail in connection with examples, a scanning signal which is sent from the scanning circuit 101 and reaches the gate electrode of the video signal write transistor $T_{Sig}$ through the corresponding scanning line SCL is changed depending on the position of the light-emitting element 1 in the first direction (see FIG. 26B). This change results from the wiring capacitance or wiring resistance of the scanning line SCL. If the scanning signal is changed, there is a difference in luminance in the light-emitting unit. Specifically, in a light-emitting element (in FIGS. 26A and 26B, represented by "pixel center") in the central portion of the display device, wiring capacitance or wiring resistance of the scanning line SCL is large compared to a light-emitting element (in FIGS. 26A and 26B, represented by "pixel end") which is adjacent to the scanning circuit 101 or near the scanning circuit 101. For this reason, the pulse shape of the scanning signal is changed (that is, a difference in the pulse width of the scanning signal between the light-emitting elements increases), and a mobility correction effect (effectiveness) described below is changed, causing an increase in luminance (see a schematic view of FIG. 30A).

A scanning signal which is sent from the scanning circuit 101 and reaches the gate electrode of the video signal write transistor $T_{Sig}$ through the scanning line SCL is also changed depending on the position of the light-emitting element 1 in the second direction. This change is because parasitic capacitance formed by the scanning line SCL and the data line DTL differs between the light-emitting elements 1 in and near the termination portion of the data line DTL and the light-emitting elements 1 in other regions. In the light-emitting elements in and near the termination portion of the data line DTL, in particular, in the light-emitting elements adjacent to the scanning circuit and in and near the termination portion of the data line DTL, parasitic capacitance formed by the scanning line SCL and the data line DTL is small compared to the light-emitting element in other regions. For this reason, the pulse shape of the scanning signal is changed (that is, the difference in the pulse width of the scanning signal between the light-emitting elements increases), and a mobility correction effect (effectiveness) described below is changed, causing a significant decrease in luminance (see a schematic view of FIG. 30B).

Accordingly, it is desirable to provide a display device having a configuration or structure, in which a luminance difference can be made small between a light-emitting element in the central portion of the display device and a light-emitting element adjacent to a scanning circuit, and an electronic apparatus including the display device. It is also desirable to provide a display device having a configuration or structure in which a luminance difference can be made small between light-emitting elements in and near a termination portion of a data line and light-emitting elements in other regions, and an electronic apparatus including the display device.

A first embodiment of the present disclosure is directed to a display device including (A) scanning circuits, (B) a video signal output circuit, (C) a current supply unit, (D) M current supply lines which are connected to the current supply unit and extend in a first direction, (E) M scanning lines which are connected to the scanning circuits and extend in the first direction, (F) N data lines which are connected to the video signal output circuit and extend in a second direction, and (G) N×M light-emitting elements in total of N light-emitting elements in the first direction and M light-emitting elements in the second direction different from the first direction arranged in a two-dimensional matrix, each light-emitting element having a light-emitting unit and a driving circuit for driving the light-emitting unit. The driving circuit constituting each light-emitting element is connected to the corresponding current supply line, the corresponding scanning line, and the corresponding data line, and a capacitive load unit is provided between each scanning line and each scanning circuit.

A second embodiment of the present disclosure is directed to a display device including (A) scanning circuits, (B) video signal output circuit, (C) current supply unit, (D) M current supply lines which are connected to the current supply unit and extend in a first direction, (E) M scanning lines which are connected to the scanning circuits and extend in the first direction, (F) N data lines which are connected to the video signal output circuit and extend in a second direction, and (G) N×M light-emitting elements in total of N light-emitting elements in the first direction and M light-emitting elements in the second direction different from the first direction arranged in a two-dimensional matrix, each light-emitting element having a light-emitting unit and a driving circuit for driving the light-emitting unit. The driving circuit of each light-emitting element is connected to the corresponding current supply line, the corresponding scanning line, and the corresponding data line, and a capacitive load unit is provided in the termination portion of each data line.

In order to make a distinction between the capacitive load unit in the display device according to the first embodiment of the present disclosure and the capacitive load unit in the display device according to the second embodiment of the present disclosure, the former is referred to as "first capacitive load unit" for convenience, and the latter is referred to as "second capacitive load unit" for convenience.

Another embodiment of the present disclosure is an electronic apparatus including the display device according to the first or second embodiment of the present disclosure.

The scanning signal which is sent from each scanning circuit and reaches the gate electrode of the video signal write transistor constituting the light-emitting element through the scanning line is changed depending on the position of the light-emitting element in the first direction. However, in the display device according to the first embodiment of the present disclosure or the display device of the electronic apparatus, the first capacitive load unit is provided between each scanning line and each scanning circuit. For this reason, since the light-emitting element in the central portion of the display device and the light-emitting element adjacent to each scanning circuit have a closer value of wiring capacitance or wiring resistance of the scanning line, the difference in the pulse width of the scanning signal between these light-emitting elements is reduced. That is, there is a small change in the pulse shape of the scanning signal between these light-emitting elements. As a result, it is possible to reduce the difference in luminance between the light-emitting element in the central portion of the display device and the light-emitting element adjacent to each scanning circuit. The scanning signal which is sent from each scanning circuit and reaches the gate electrode of the video signal write transistor constituting the light-emitting element through the scanning line is also changed depending on the position of the light-emitting element in the second direction. For this reason, in the display device according to the second embodiment of the present disclosure or a display device of an electronic apparatus, a capacitive load unit is provided in the termination portion of each data line. For this reason, since the light-emitting elements in and near the termination portion of the data line and the light-emitting elements in other regions have a closer value of parasitic capacitance formed by the scanning line and the data line, the difference in the pulse width of the scanning signal between these light-emitting elements is reduced. That is, there is a small change in the pulse shape of the scanning signal between these light-emitting elements. As a result, it is possible to reduce the difference in luminance between the light-emitting element in and near the termination portion of the data line and the light-emitting element in other regions. As a result, it is possible to provide a display device or an electronic apparatus which is excellent in uniformity with less shading or irregularity.

DETAILED DESCRIPTION

Figure 1:
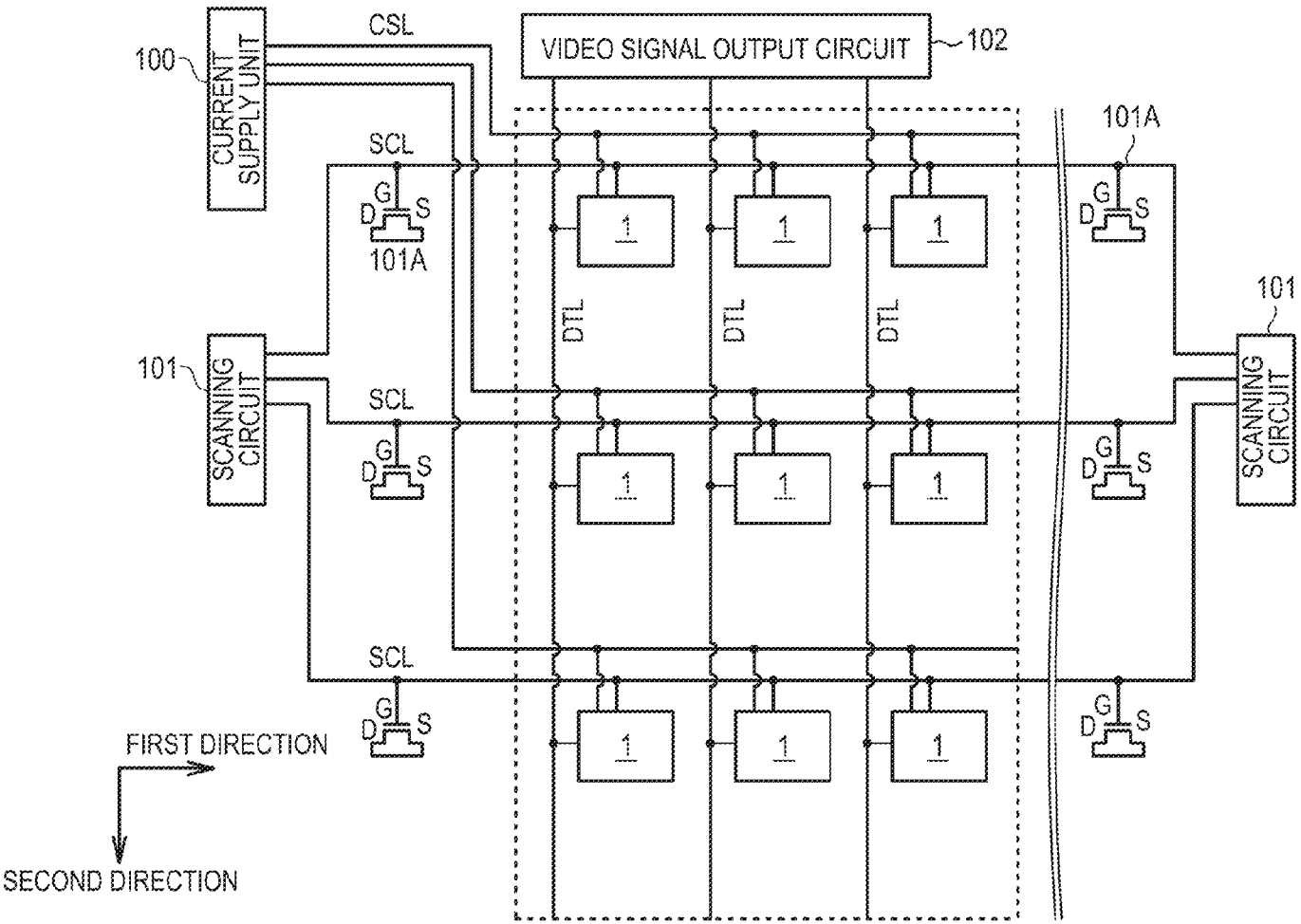
FIG. 1 is a conceptual diagram of a circuit which constitutes a display device of Example 1 or a display device of an electronic apparatus.

Although the present disclosure will be hereinafter described in connection with examples with reference to the drawings, the present disclosure is not limited to the examples, and various numerical values or materials in the examples are for illustration. The description will be provided in the following sequence.

1. Overall description of display device according to first and second embodiments of present disclosure and electronic apparatus
2. Example 1 (display device according to first embodiment of present disclosure and electronic apparatus)
3. Example 2 (display device according to second embodiment of present disclosure and electronic apparatus)
4. Example 3 (Modification of Example 1)
5. Example 4 (Modification of Examples 1 to 3. 5Tr/1C driving circuit)
6. Example 5 (Modification of Examples 1 to 3. 4Tr/1C driving circuit)
7. Example 6 (Modification of Examples 1 to 3. 3Tr/1C driving circuit)
8. Example 7 (Modification of Examples 1 to 3. 2Tr/1C driving circuit) and others

[Overall Description of Display Device According to First and Second Embodiments of Present Disclosure and Electronic Apparatus]

In the display device according to the first embodiment of the present disclosure or the display device of the electronic apparatus, a form in which a second capacitive load unit is provided in the termination portion of each data line can be made. Note that this form may be referred to as "a display device according to Embodiment 1-A of the present disclosure". With the use of the display device according to Embodiment 1-A of the present disclosure, the above-described display device can be realized.

In the display device according to the first embodiment of the present disclosure or the display device of the electronic apparatus, when, from each scanning circuit through the capacitive load unit (first capacitive load unit) and the corresponding scanning line, the pulse width of a scanning signal which is input to a light-emitting element in the central portion along the first direction and the central portion along the second direction is $PW_{1-C}$, and the pulse width of a scanning signal which is input to a light-emitting element adjacent to each scanning circuit in the central portion along the second direction is $PW_{1-E}$, the following condition may be satisfied.

$$0.95 \leq PW_{1-E}/PW_{1-C} < 1$$

Note that the time constant of a driving circuit provided with a capacitive load unit (first capacitive load unit) is preferably 1.01 to 1.5 times greater than the time constant of a driving circuit provided with no capacitive load unit (first capacitive load unit).

In the display device according to the first embodiment of the present disclosure or the display device of the electronic apparatus, the capacitive load unit (first capacitive load unit) may have a transistor, and the capacitance of the capacitive load unit (first capacitive load unit) may be constituted by the gate capacitance of the transistor. Alternatively, the capacitive load unit (first capacitive load unit) may have two electrodes and a dielectric layer interposed between the two electrodes, and one electrode may be constituted by the corresponding scanning line.

In the display device according to the first embodiment of the present disclosure or the display device of the electronic apparatus, the capacitance of the capacitive load unit (first capacitive load unit) may be determined by the luminance difference between luminance of a light-emitting element in the central portion along the first direction and the central portion along the second direction and luminance of a light-emitting element adjacent to each scanning circuit in the central portion along the second direction, a desired value of the luminance difference, and the parasitic capacitance of the corresponding scanning line per light-emitting element.

In the display device according to the first embodiment of the present disclosure or the display device of the electronic apparatus, the capacitance of the capacitive load unit (first capacitive load unit) may be 5 times to 200 times greater than the parasitic capacitance of the corresponding scanning line per light-emitting element. However, the form is not limited to this.

In the display device according to the second embodiment of the present disclosure or the display device of the electronic apparatus, when, from each scanning circuit through the corresponding scanning line, the pulse width of a scanning signal which is input to a light-emitting element adjacent to each scanning circuit in the termination portion of the corresponding data line is $PW_{2-E}$, and the pulse width of a scanning signal which is input to a light-emitting element adjacent to each scanning circuit in the central portion of the corresponding data line is $PW_{2-C}$, the following condition may be satisfied.

$$0.95 \leq PW_{2-E}/PW_{2-C} < 1$$

Note that the time constant of a driving circuit provided with a capacitive load unit (second capacitive load unit) is 1.01 times to 1.5 times greater than the time constant of a driving circuit provided with no capacitive load unit (second capacitive load unit).

In the display device according to the second embodiment of the present disclosure or the display device of the electronic apparatus, the capacitive load unit (second capacitive load unit) may have a transistor, and the capacitance of the capacitive load unit (second capacitive load unit) may be constituted by the gate capacitance of the transistor. Alternatively, capacitive load unit (second capacitive load unit) may have two electrodes and a dielectric layer interposed between the two electrodes, and one electrode may be constituted by the corresponding data line.

In the display device according to the second embodiment of the present disclosure or the display device of the electronic apparatus, the capacitance of the capacitive load unit (second capacitive load unit) may be determined by the luminance difference between luminance of a light-emitting element adjacent to each scanning circuit in the central portion of the corresponding data line and luminance of a light-emitting element adjacent to each scanning circuit in the termination portion of the corresponding data line, a desired value of the luminance difference, and parasitic capacitance between the scanning line and the data line in one light-emitting element in the termination portion.

In the display device according to the second embodiment of the present disclosure or the display device of the electronic apparatus, the capacitance of the capacitive load unit (second capacitive load unit) may be 5 times to 10 times greater than parasitic capacitance between the corresponding scanning line and data line per light-emitting element. However, the form is not limited to this.

In the display device according to the second embodiment of the present disclosure or the display device of the electronic apparatus, the definition of the capacitive load unit (second capacitive load unit) may be applied to the second capacitive load unit in the display device according to Embodiment 1-A of the present disclosure.

In the display device according to the first or second embodiment of the present disclosure or the display device of the electronic apparatus, the driving circuit may at least include (A) a drive transistor having source/drain regions, a channel forming region, and a gate electrode, (B) a video signal write transistor having source/drain regions, a channel forming region, and a gate electrode, and (C) a capacitive unit, in the drive transistor, (A-1) one region of the source/drain regions may be connected to the corresponding current supply line, (A-2) the other of the source/drain regions may be connected to the light-emitting unit and connected to one end of the capacitive unit, and may form a second node, and (A-3) the gate electrode may be connected to the other of the source/drain regions of the video signal write transistor and connected to the other end of the capacitive unit, and may form a first node, and in the video signal write transistor, (B-1) one region of the source/drain regions may be connected to the corresponding data line, and (B-2) the gate electrode may be connected to the corresponding scanning line.

The driving circuit may be, for example, a driving circuit (referred to as "2Tr/1C driving circuit") having two transistors (drive transistor and video signal write transistor) and one capacitive unit, a driving circuit (referred to as "3Tr/1C driving circuit") having three transistors (drive transistor, video signal write transistor, and one transistor) and one capacitive unit, a driving circuit (referred to as "4Tr/1C driving circuit") having four transistors (drive transistor, video signal write transistor, and two transistors) and one capacitive unit, or a driving circuit (referred to as "5Tr/1C driving circuit") having five transistors (drive transistor, video signal write transistor, and three transistors) and one capacitive unit. Specifically, the light-emitting unit may have an organic electroluminescence light-emitting unit (organic EL light-emitting unit).

The first capacitive load unit is preferably arranged for all scanning lines, and in some cases, may be arranged for some scanning lines, for example, for scanning lines in and near the termination portion of each data line. The second capacitive load unit is preferably arranged for all data lines, and in some cases, the second capacitive load unit may be arranged for 5 to 10 data lines in total from a data line closest to each scanning circuit.

The display device according to the embodiments of the present disclosure or the display device of the electronic apparatus may have a configuration in which so-called monochrome display is performed or a configuration in which one pixel has a plurality of subpixels, specifically, one pixel has three subpixels of a red light-emitting subpixel, a green light-emitting subpixel, and a blue light-emitting subpixel. Each pixel may have a set of subpixels including these three kinds of subpixels and one kind of subpixel or a plurality of kinds of subpixels (for example, one set of subpixels including a subpixel which emits white light for improving luminance, one set of subpixels including a subpixel which emits complementary color light for expanding the color reproduction range, one set of subpixels including a subpixel which emits yellow light for expanding the color reproduction range, or one set of subpixels including subpixels which emit yellow and cyan light for expanding the color reproduction range).

In the display device according to the embodiments of the present disclosure or the display device of the electronic apparatus, various circuits, such as the current supply unit, the video signal output circuit, and the scanning circuits, various wirings, such as the current supply lines, the data lines, and the scanning lines, and the configuration or structure of the light-emitting unit may be the known configuration or structure. Specifically, for example, the light-emitting unit which is constituted by an organic EL light-emitting unit may have, for example, an anode electrode, an organic material layer (for example, having a structure in which a hole transport layer, a light-emitting layer, and an electron transport layer are laminated), a cathode electrode, and the like. The capacitive unit which constitutes the driving circuit may have one electrode, the other electrode, and a dielectric layer (insulating layer) interposed between these electrodes. The transistor and the capacitive unit which constitute the driving circuit are formed in a support, and the light-emitting unit is formed above the transistor and the capacitive unit constituting the driving circuit through an insulating interlayer, for example. The other of the source/drain regions of the drive transistor is connected to the anode electrode of the light-emitting unit through a contact hole, for example.

Examples of the support includes a high-strain-point glass substrate, a soda glass ($Na_2O.CaO.SiO_2$) substrate, a borosilicate glass ($Na_2O.B_2O_3.SiO_2$) substrate, a forsterite ($2MgO.SiO_2$) substrate, a lead glass ($Na_2O.PbO.SiO_2$) substrate, various glass substrates with an insulating film formed on the surface thereof, a quartz substrate, a quartz substrate with an insulating film formed on the surface thereof, a silicon substrate with an insulating film formed on the surface thereof, and an organic polymer (in the form of a polymer material, such as a flexible plastic film, a plastic sheet, or a plastic substrate made of a polymer material), such as polymethylmethacrylate (PMMA), polyvinyl alcohol (PVA), polyvinyl phenol (PVP), polyethersulfone (PES), polyimide, polycarbonate, or polyethylene telephthalate (PET).

Example 1

Figure 2:
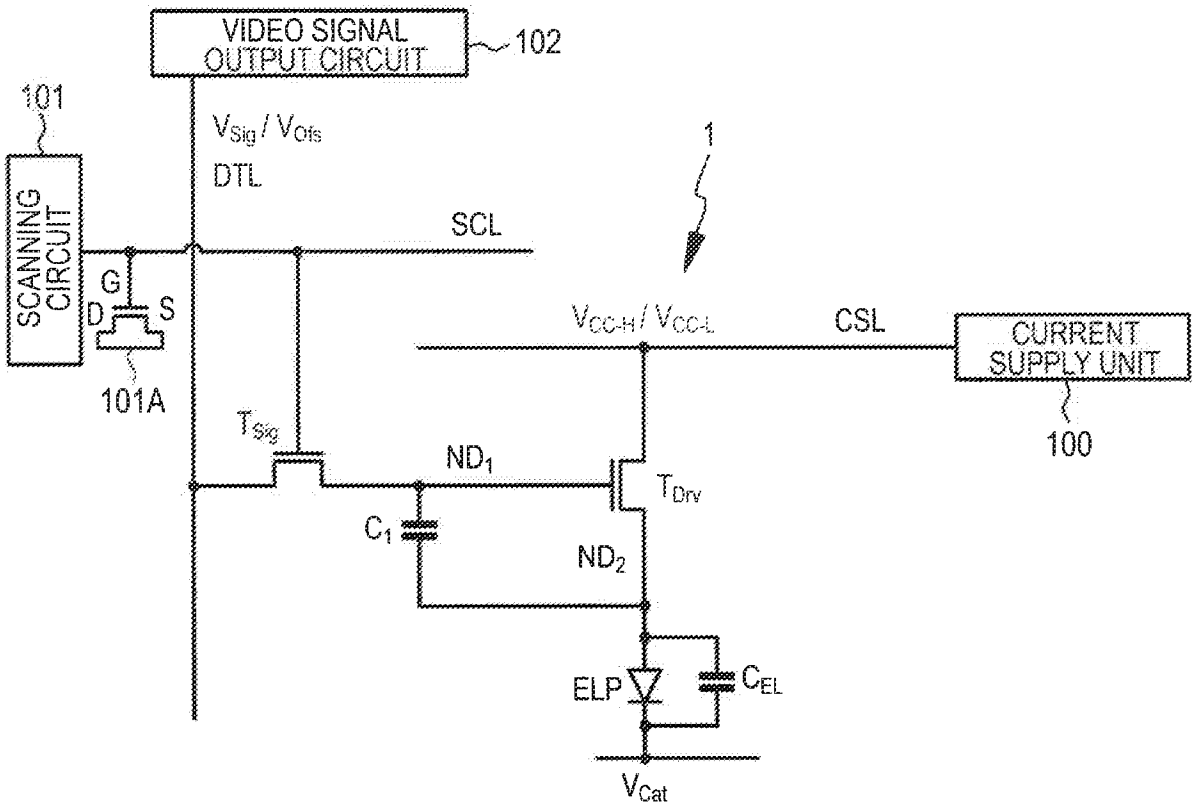
FIG. 2 is an equivalent circuit diagram of a 2Tr/1C driving circuit of Example 1.
Figure 3A:
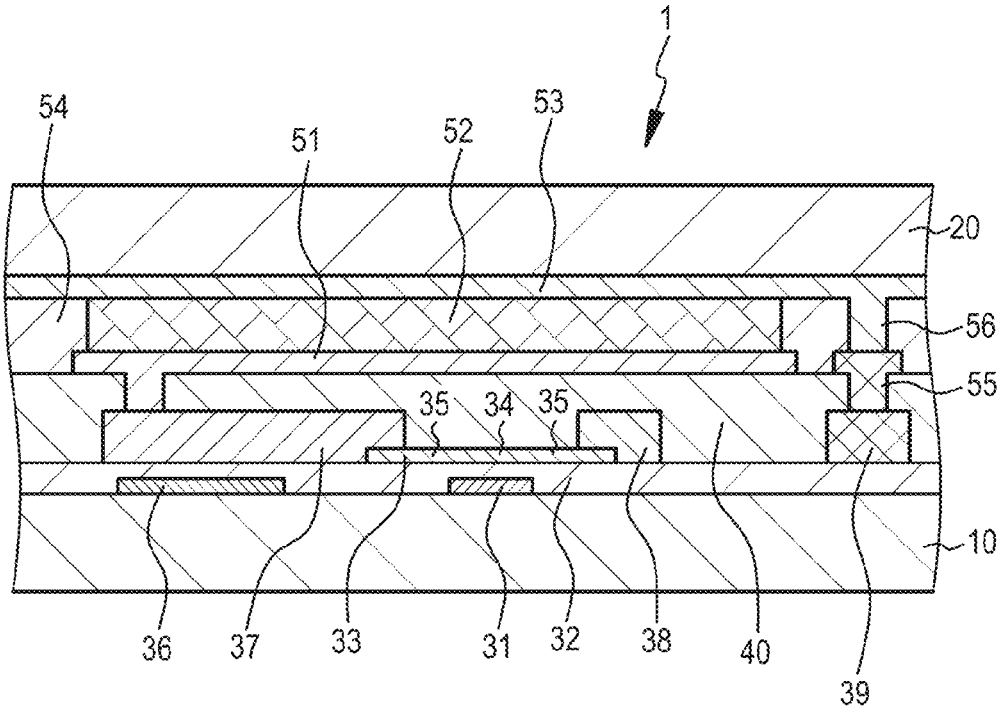
FIGS. 3A and 3B are respectively a schematic partial sectional view of a part of a light-emitting element including a driving circuit and a schematic partial sectional view of a capacitive load unit in a display device of Example 1 or a display device of an electronic apparatus.
Figure 3B:
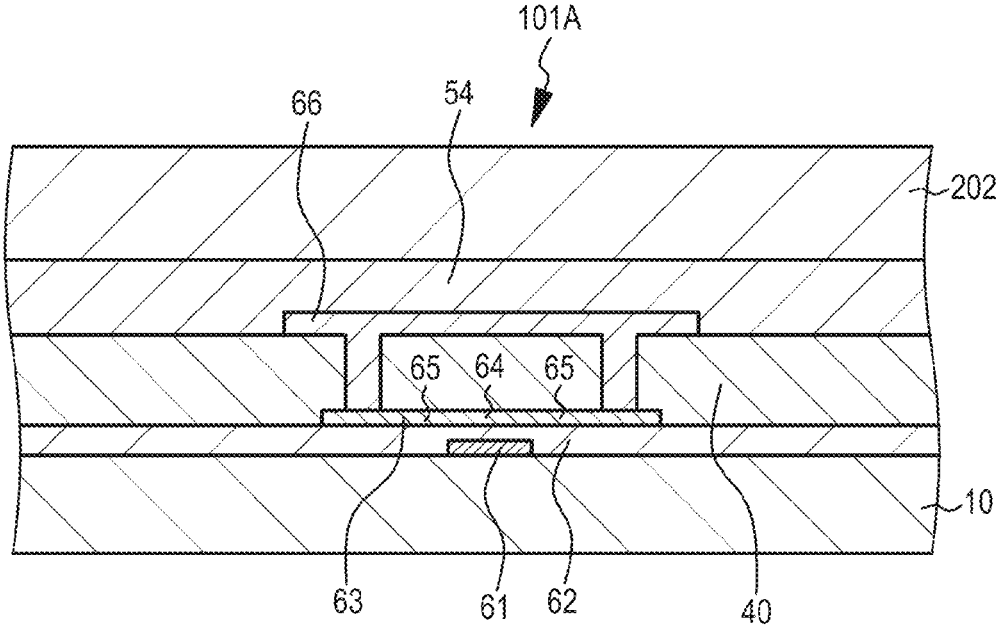

Example 1 relates to the display device according to the first embodiment of the present disclosure and the electronic apparatus, and specifically, to an organic EL display device and an electronic apparatus including the organic EL display device. Hereinafter, the display device of each example and the display device of the electronic apparatus are collectively and simply referred to as "display device of example". FIG. 1 shows a conceptual diagram of a circuit which constitutes a display device of Example 1. FIG. 2 is an equivalent circuit diagram of a light-emitting element including a driving circuit in the display device of Example 1 (in this example, the driving circuit is a driving circuit (2Tr/1C driving circuit) having two transistors $T_{Drv}$ and $T_{Sig}$ and one capacitive unit $C_1$). FIGS. 3A and 3B are a schematic partial sectional view of a part of a light-emitting element including a driving circuit in the display device of Example 1 and a schematic partial sectional view of a capacitive load unit.

The display device of Example 1 includes (A) scanning circuits 101, (B) a video signal output circuit 102, (C) a current supply unit 100, (D) M current supply lines CSL which are connected to the current supply unit 100 and extend in a first direction, (E) M scanning lines SCL which are connected to the scanning circuits 101 and extend in the first direction, (F) N data lines DTL which are connected to the video signal output circuit 102 and extend in a second direction, and (G) N×M light-emitting elements 1 in total of N light-emitting elements 1 in the first direction and M light-emitting elements 1 in the second direction different from the first direction arranged in a two-dimensional matrix, each light-emitting element 1 having a light-emitting unit (specifically, an organic EL light-emitting unit) ELP and a driving circuit for driving the light-emitting unit ELP. The driving circuit of each light-emitting element 1 is connected to the corresponding current supply line CSL, the corresponding scanning line SCL, and the corresponding data line DTL. Although in FIG. 1, 3×3 light-emitting elements 1 are shown, this is merely for illustration. The scanning circuits 101 are arranged at both ends of the scanning line SCL, but may be arranged only at one end.

A capacitive load unit (first capacitive load unit 101A) is provided between each scanning line SCL and each scanning circuit 101.

The display device of Example 1 or Examples 2 to 7 described below has N×M pixels arranged in a two-dimensional matrix. One pixel has three subpixels (a red light-emitting subpixel which emits red light, a green light-emitting subpixel which emits green light, and a blue light-emitting subpixel which emits blue light).

In the display device of Example 1 or Examples 2 to 7 described below, the driving circuit at least includes (A) a drive transistor $T_{Drv}$ having source/drain regions, a channel forming region, and a gate electrode, (B) a video signal write transistor $T_{Sig}$ having source/drain regions, a channel forming region, and a gate electrode, and (C) a capacitive unit $C_1$. Specifically, the drive transistor $T_{Drv}$ and the video signal write transistor $T_{Sig}$ are thin film transistors (TFTs).

In the drive transistor $T_{Drv}$, (A-1) one region of the source/drain regions is connected to the corresponding current supply line CSL, (A-2) the other of the source/drain regions is connected to the light-emitting unit ELP and connected to one end of the capacitive unit $C_1$, and forms a second node $ND_2$, and (A-3) the gate electrode is connected to the other of the source/drain regions of the video signal write transistor $T_{Sig}$ and connected to the other end of the capacitive unit $C_1$, and forms a first node $ND_1$.

In the video signal write transistor $T_{Sig}$, (B-1) one region of the source/drain regions is connected to the corresponding data line DTL, and (B-2) the gate electrode is connected to the corresponding scanning line SCL.

The drive transistor $T_{Drv}$ and the video signal write transistor $T_{Sig}$ or a light-emission control transistor $T_{EL_C}$, a first node initialization transistor $T_{ND1}$, and a second node initialization transistor $T_{ND2}$ are n-channel TFTs which have source/drain regions, a channel forming region, and a gate electrode. The video signal write transistor $T_{Sig}$, the light-emission control transistor $T_{EL_C}$, the first node initialization transistor $T_{ND1}$, and the second node initialization transistor $T_{ND2}$ may be p-channel TFTs.

FIG. 3A is a schematic partial sectional view showing a part of a light-emitting element 1. The transistor and the capacitive unit $C_1$ which constitute the driving circuit of the light-emitting element 1 are formed on each support 10, and the light-emitting unit ELP is formed above the transistor and the capacitive unit $C_1$ constituting the driving circuit through an insulating interlayer 40. The source region of the drive transistor $T_{Drv}$ is connected to an anode electrode 51 of the light-emitting unit ELP through a contact hole. Note that FIG. 3A shows only the drive transistor $T_{Drv}$. A transistor other than the drive transistor $T_{Drv}$ is not shown.

More specifically, the drive transistor $T_{Drv}$ has a gate electrode 31, a gate insulating layer 32, a semiconductor layer 33, source/drain regions 35 in the semiconductor layer 33, and a channel forming region 34 which corresponds to a portion of the semiconductor layer 33 between the source/drain regions 35. The capacitive unit $C_1$ has the other electrode 36, an insulating layer (dielectric layer) which is an extended portion of the gate insulating layer 32, and one electrode 37 (corresponding to the second node $ND_2$). The gate electrode 31, a part of the gate insulating layer 32, and the other electrode 36 of the capacitive unit $C_1$ are formed on the support 10. One of the source/drain regions 35 of the drive transistor $T_{Drv}$ is connected to a wiring 38, and the other of the source/drain regions 35 is connected to one electrode 37 (corresponding to the second node $ND_2$). The drive transistor $T_{Drv}$, the capacitive unit $C_1$, and the like are covered with an insulating interlayer 40, and the light-emitting unit ELP having an anode electrode 51, an organic material layer 52 (for example, having a hole transport layer, a light-emitting layer, and an electron transport layer), and a cathode electrode 53 is provided on the insulating interlayer 40. A second insulating interlayer 54 is provided on a portion of the insulating interlayer 40 where the light-emitting unit ELP is not provided, and a transparent substrate 20 is arranged on the second insulating interlayer 54 and the cathode electrode 53. Light emitted from the light-emitting layer passes through the substrate 20 and is emitted to the outside. One electrode 37 (second node $ND_2$) and the anode electrode 51 are connected together through a contact hole in the insulating interlayer 40. The cathode electrode 53 is connected to a wiring 39 on the extended portion of the gate insulating layer 32 through contact holes 56 and 55 in the second insulating interlayer 54 and the insulating interlayer 40.

In other words, the display device of Example 1 has a plurality of light-emitting elements each having a light-emitting unit and a driving circuit for driving the light-emitting unit. The driving circuit at least has the light-emitting unit ELP, the capacitive unit $C_1$, the video signal write transistor $T_{Sig}$ which holds a driving signal (luminance signal) $V_{Sig}$ in the capacitive unit $C_1$, and the drive transistor $T_{Drv}$ which drives the light-emitting unit ELP on the basis of the driving signal (luminance signal) $V_{Sig}$ held in the capacitive unit $C_1$.

As shown in the schematic partial sectional view of FIG. 3B, the first capacitive load unit 101A which is provided between each scanning line SCL and each scanning circuit 101 has a transistor (more specifically, a transistor having the same structure as a TFT), and the capacitance of the first capacitive load unit 101A is constituted by the gate capacitance of the transistor. More specifically, the transistor has a gate electrode 61, a gate insulating layer 62, a semiconductor layer 63, source/drain regions 65 in the semiconductor layer 63, and a channel forming region 64 which corresponds to a portion of the semiconductor layer 63 between the source/drain regions 65. The source/drain regions 65 are short-circuited by a contact hole in the insulating interlayer 40 and a short-circuit portion 66.

In Example 1, the capacitance of the first capacitive load unit 101A is determined by the luminance difference between luminance of the light-emitting element 1 in the central portion along the first direction and the central portion along the second direction and luminance of the light-emitting element 1 adjacent to the scanning circuit 101 in the central portion along the second direction, a desired value of the luminance difference, and the parasitic capacitance of the corresponding scanning line SCL per light-emitting element.

Figure 27A:
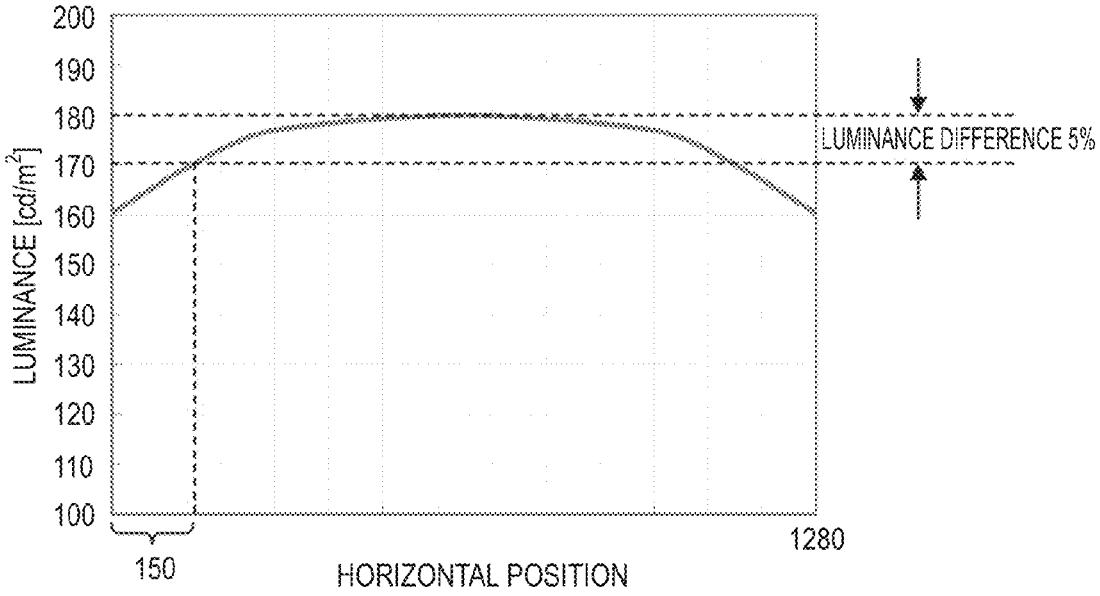
FIGS. 27A and 27B are respectively graphs schematically showing luminance of light-emitting elements depending on the position of light-emitting elements in a horizontal direction in an existing display device and a display device of Example 1.
Figure 27B:
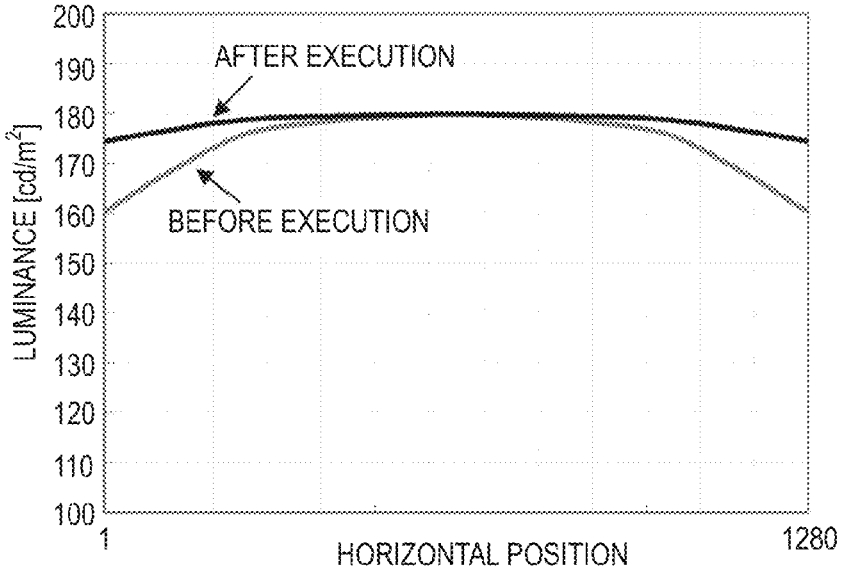
Figure 28:
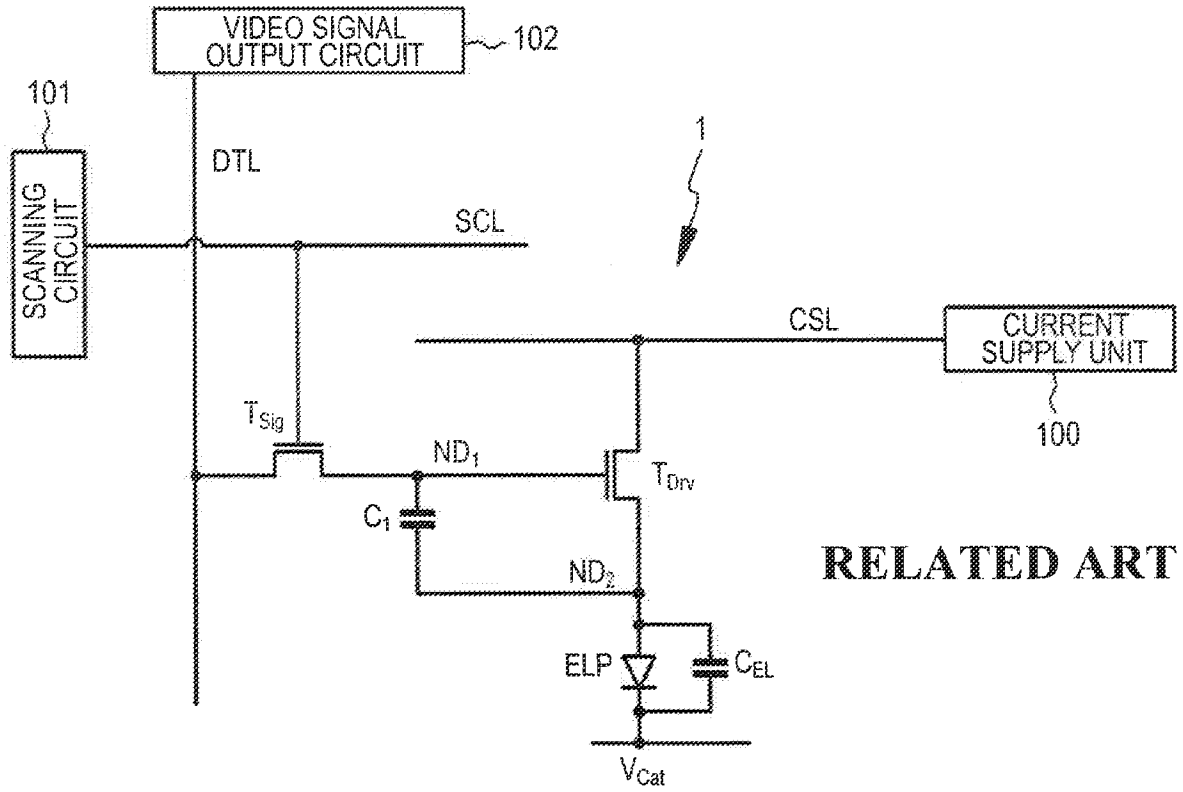
FIG. 28 is an equivalent circuit diagram of an existing 2Tr/1C driving circuit.
Figure 29:
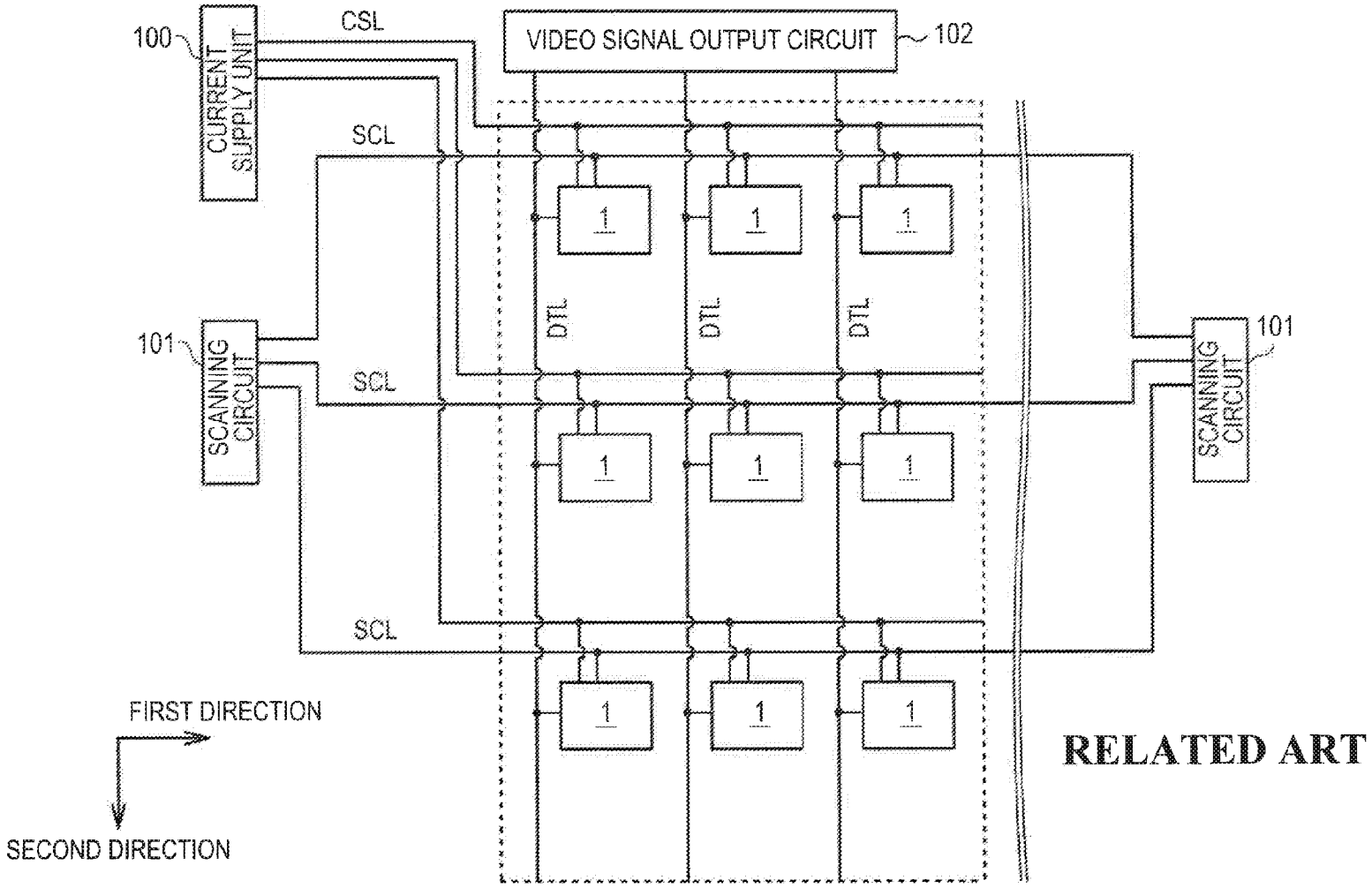
FIG. 29 is a conceptual diagram of a circuit which constitutes an existing display device.
Figure 30A:
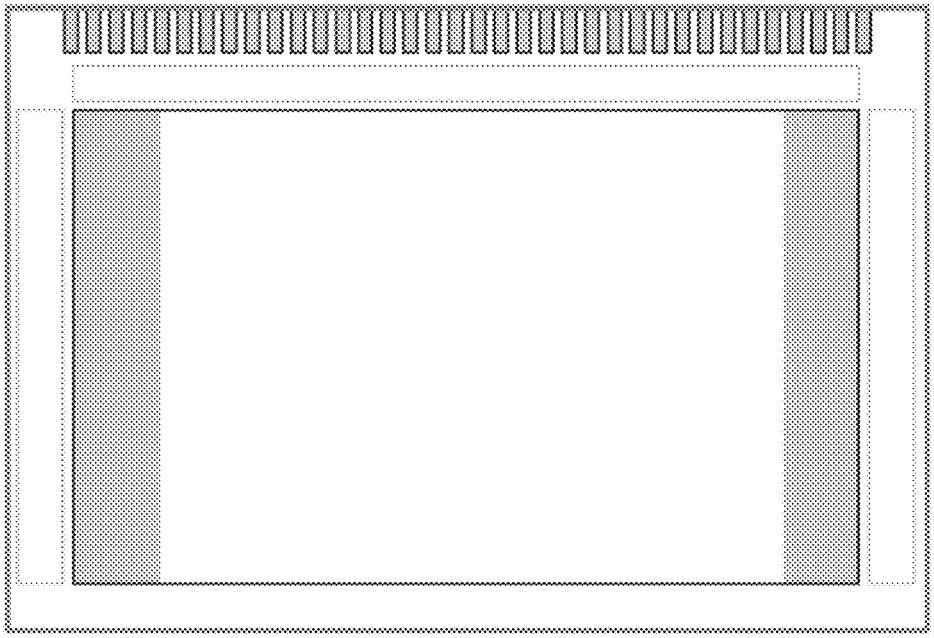
FIGS. 30A and 30B are diagrams schematically showing a state where luminance uniformity is lost in an existing display device.
Figure 30B:
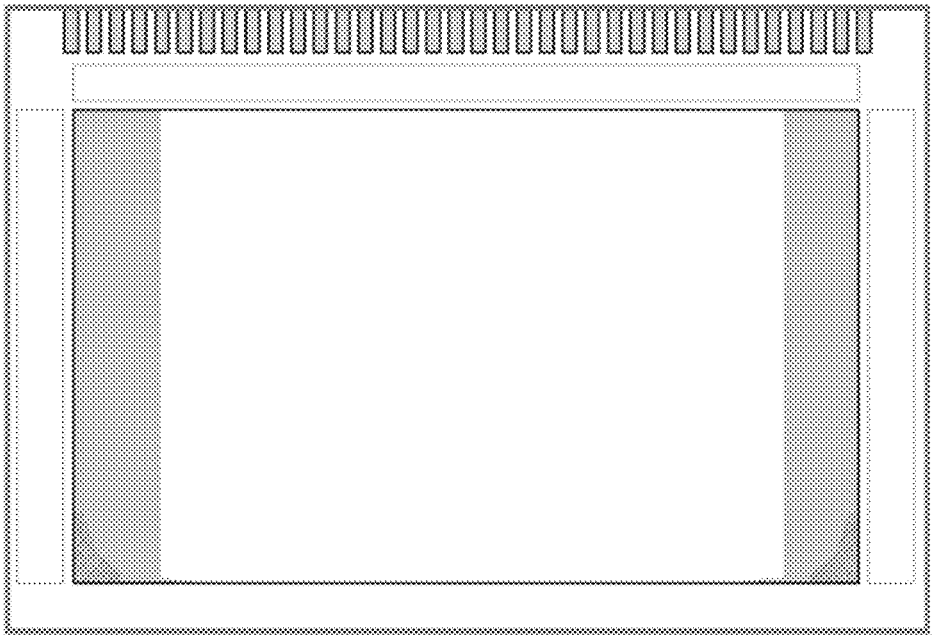

In an example shown in FIG. 27A, the luminance difference between luminance of the light-emitting element 1 in the central portion along the first direction and luminance of the light-emitting element 1 adjacent to the scanning circuit 101 in the central portion along the second direction is about 10%. It is assumed that the luminance difference of 10% is suppressed to the luminance difference within 5%. Specifically, luminance of the light-emitting element 1 in the central portion along the first direction is, for example, 180 cd/m$^2$, and luminance of the light-emitting element 1 adjacent to the scanning circuit 101 in the central portion along the second direction is, for example, 160 cd/m$^2$. That is, the luminance difference is 20 cd/m$^2$. The desired value of the luminance difference, that is, an allowable luminance difference is, for example, 171 cd/m$^2$. In a display device of N=1280, a light-emitting element of 171 cd/m$^2$ is the 150th light-emitting element or the (1280-150)th light-emitting element. For this reason, if the capacitance of the first capacitive load unit 101A is 150 times greater than the parasitic capacitance of the scanning line per light-emitting element, the luminance difference between luminance of the light-emitting element 1 in the central portion along the first direction and luminance of the light-emitting element 1 adjacent to the scanning circuit 101 in the central portion along the second direction can have the desired value (see FIG. 27B). In other words, parasitic capacitance is equivalent to when 150 virtual light-emitting elements are provided at one end of the scanning lines SCL and 150 virtual light-emitting elements are provided at the other end of the scanning lines SCL, and equivalent to when light-emitting elements where the luminance does not reach the desired value are moved outside the display device. In FIG. 27B, the luminance distribution in a display device when the capacitive load unit 101A is provided is represented by "after execution", and the luminance distribution in a display device when no capacitive load unit 101A is provided is represented by "before execution".

Figure 26A:
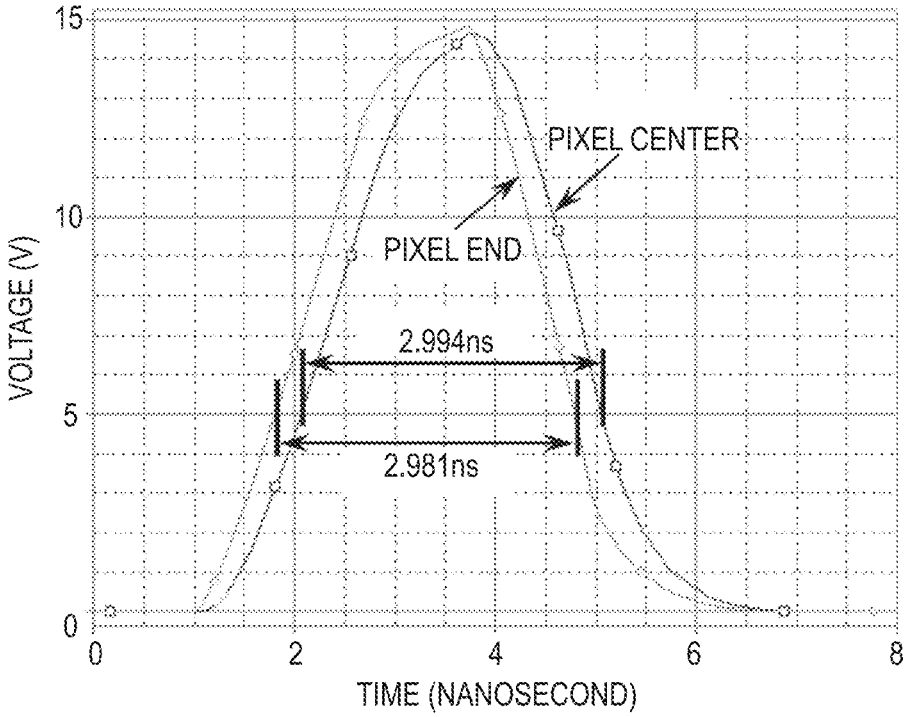
FIGS. 26A and 26B are diagrams showing changes of a scanning signal which is sent from a scanning circuit and reaches a gate electrode of a video signal write transistor through a scanning line depending on the position of a light-emitting element in a display device of Example 1 and an existing display device.
Figure 26B:
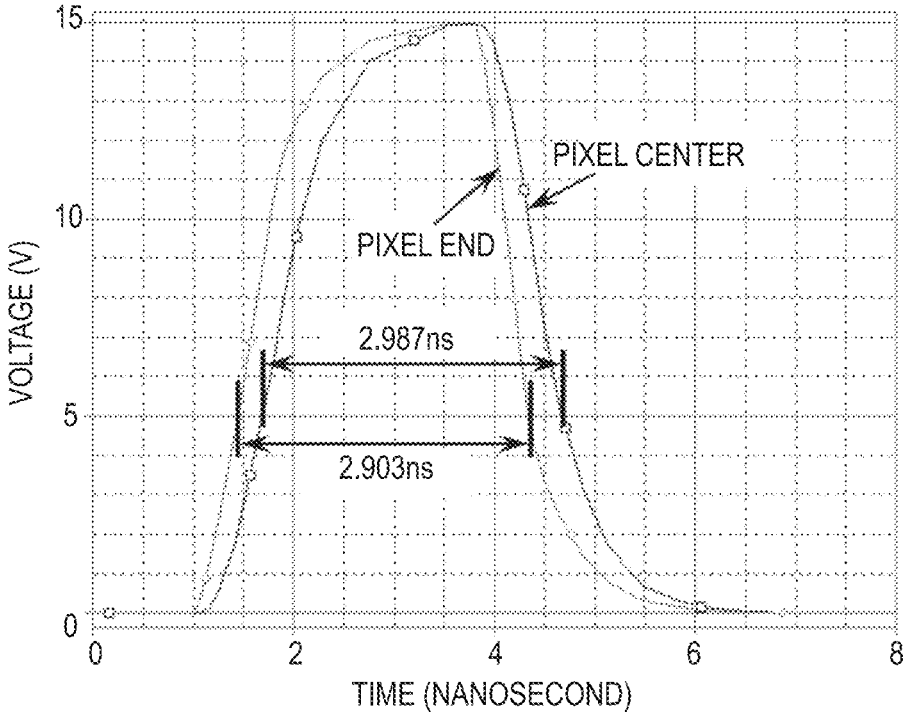

In an example shown in FIG. 26B, a scanning signal (referred to as "pixel end scanning signal") which is input to the gate electrode of the video signal write transistor $T_{Sig}$ constituting a light-emitting element adjacent to the scanning circuit 101 has a steep pulse waveform. The pulse waveform of a scanning signal (referred to as "pixel center scanning signal") which is input to the gate electrode of the video signal write transistor $T_{Sig}$ constituting a light-emitting element in the central portion along the first direction is slower than the pulse waveform of the pixel end scanning signal. Specifically, the difference between the pulse width of the pixel center scanning signal and the pulse width of the pixel end scanning signal is 2.89%. In regard to the pulse width of the scanning signal, if the video signal write transistor $T_{Sig}$ is of an n-channel type, since electrical conduction is provided when the sum of a potential in the data line DTL and a threshold voltage of the video signal write transistor $T_{Sig}$ is exceeded, as a simplified example, comparison is made with the pulse width when the sum of the potential in the data line DTL and the threshold voltage of the video signal write transistor $T_{Sig}$ is 5.0 volt. In Example 1 where the transient (time constant) becomes slow about two times, as shown in FIG. 26A, the difference between the pulse width of the pixel center scanning signal and the pulse width of the pixel end scanning signal is suppressed to 0.436%, such that shading or irregularity can be improved. FIG. 27B schematically shows the luminance distribution of a light-emitting element when the luminance difference between luminance of the light-emitting element 1 in the central portion along the first direction and luminance of the light-emitting element 1 adjacent to the scanning circuit 101 in the central portion along the second direction is reduced. The pulse width of the pixel center scanning signal is the pulse width, $PW_{1\text{-}C}$, of a scanning signal which is input to the light-emitting element 1 in the central portion along the first direction and the central portion along the second direction from the scanning circuit 101 through the first capacitive load unit 101A and the scanning line SCL. The pulse width of the pixel end scanning signal is the pulse width, $PW_{1\text{-}E}$, of a scanning signal which is input to the light-emitting element 1 adjacent to the scanning circuit 101 in the central portion along the second direction. In this case, the following condition is satisfied.

$$0.95 \leq PW_{1\text{-}E}/PW_{1\text{-}C} < 1$$

As described above, the time constant of a driving circuit provided with the first capacitive load unit 101A is about two times greater than the time constant of a driving circuit provided with no first capacitive load unit.

The light-emitting element 1 described above may be manufactured by a known method, and various materials which are used when manufacturing the light-emitting element 1 may be known materials.

The operation of the driving circuit of Example 1 will be described in Example 7 described below.

In the display device of Example 1, the first capacitive load unit 101A is provided between each scanning line SCL and each scanning circuit 101. For this reason, while the scanning signal which is sent from the scanning circuit 101 and reaches the gate electrode of the video signal write transistor $T_{Sig}$ constituting the light-emitting element 1 through the scanning line SCL is changed depending on the position of the light-emitting element 1 in the first direction, the light-emitting element 1 in the central portion of the display device and the light-emitting element 1 adjacent to the scanning circuit 101 have a closer value of wiring capacitance or wiring resistance of the scanning line SCL. For this reason, the difference in the pulse width of the scanning signal becomes smaller. That is, the pulse waveform of a scanning signal which is input to the light-emitting element 1 adjacent to the scanning circuit 101 is slow and brought close to the pulse waveform of the scanning signal which is input to the light-emitting element 1 in the central portion of the display device. As a result, it is possible to reduce the difference in luminance between the light-emitting element 1 in the central portion of the display device and the light-emitting element 1 adjacent to the scanning circuit 101. As a result, it is possible to provide a display device which is excellent in uniformity with less shading or irregularity.

Figure 4A:
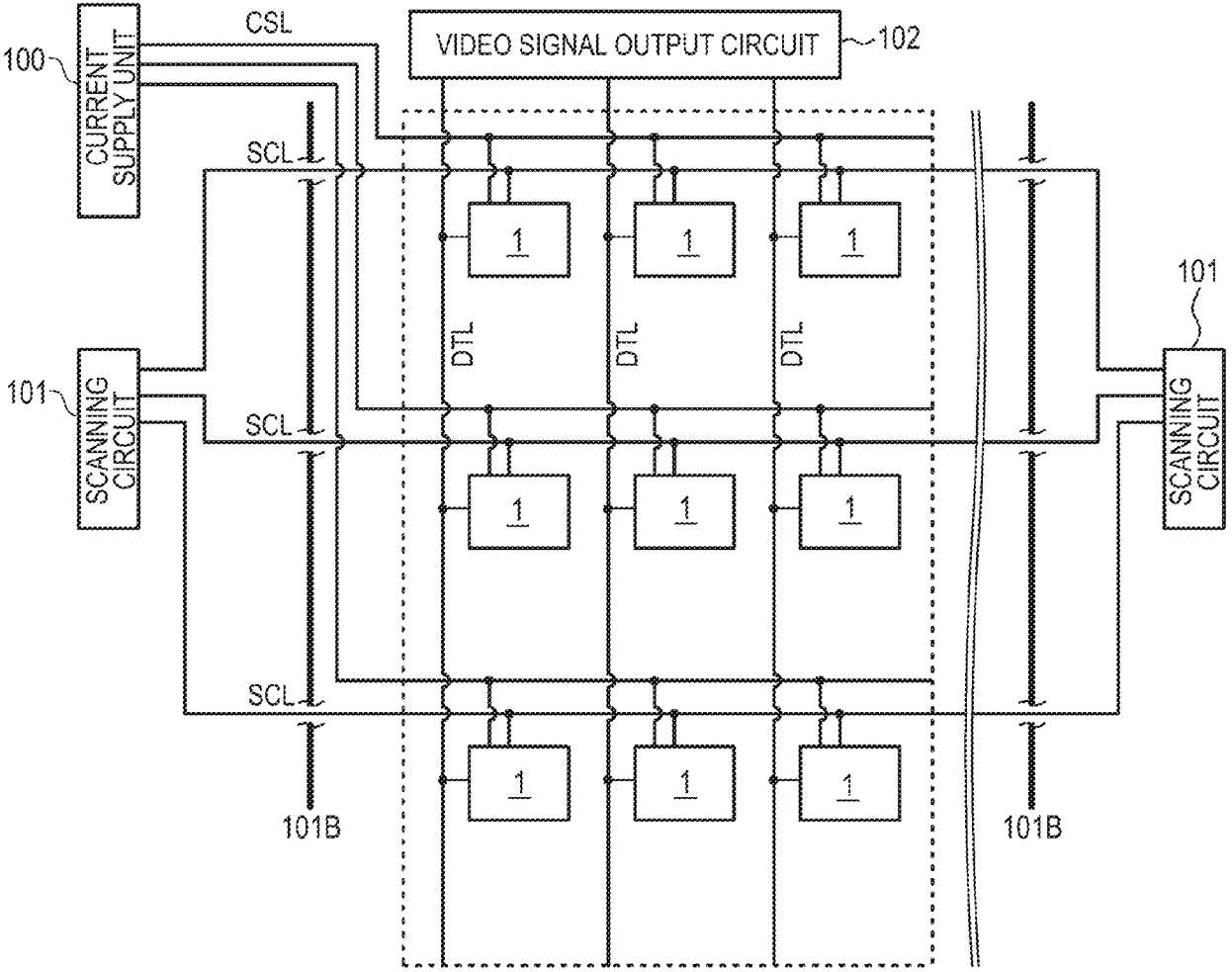
FIGS. 4A and 4B are respectively a conceptual diagram of a modification of a circuit which constitute a display device of Example 1 or a display device of an electronic apparatus and a schematic view of a capacitive load unit (first capacitive load unit).
Figure 4B:
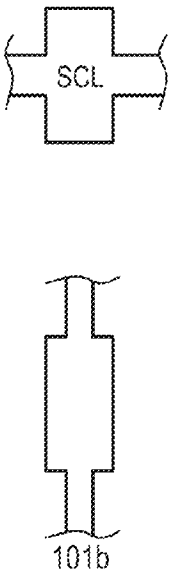

As shown in FIG. 4A which is a conceptual diagram of a modification of a circuit constituting the display device of Example 1, a first capacitive load unit 101B may have two electrodes and a dielectric layer interposed between the two electrodes, and one electrode may be constituted by the scanning line SCL. As shown in a schematic partial plan view of FIG. 4B, the area of a portion where the scanning line SCL corresponding to one electrode extending in the first direction and the other electrode 101*b* overlap through the dielectric layer may be increased. The other electrode 101*b* may be grounded or may be in a floating state.

Example 2

Figure 5:
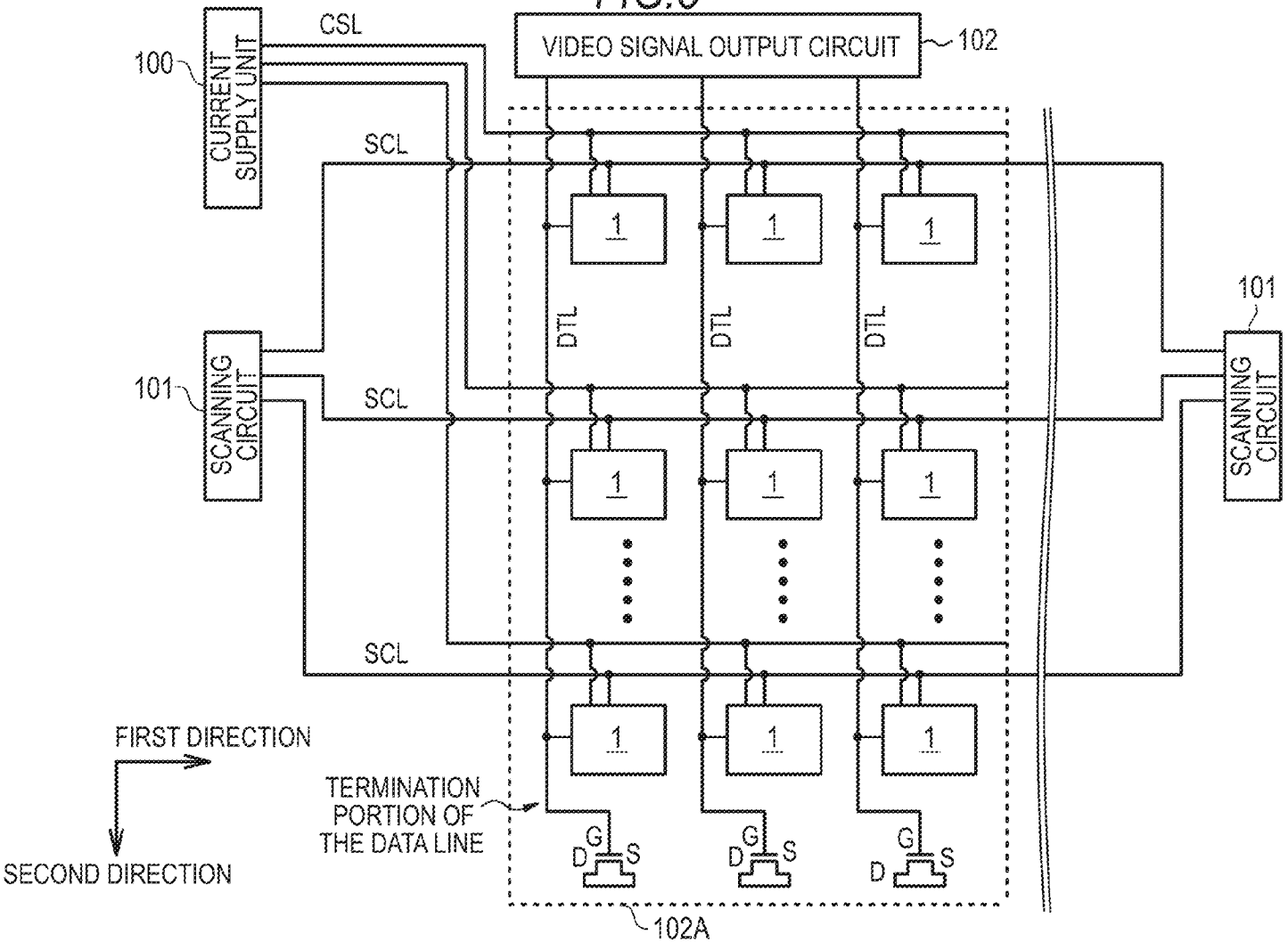
FIG. 5 is a conceptual diagram of a circuit which constitutes a display device of Example 2 or a display device of an electronic apparatus.
Figure 6:
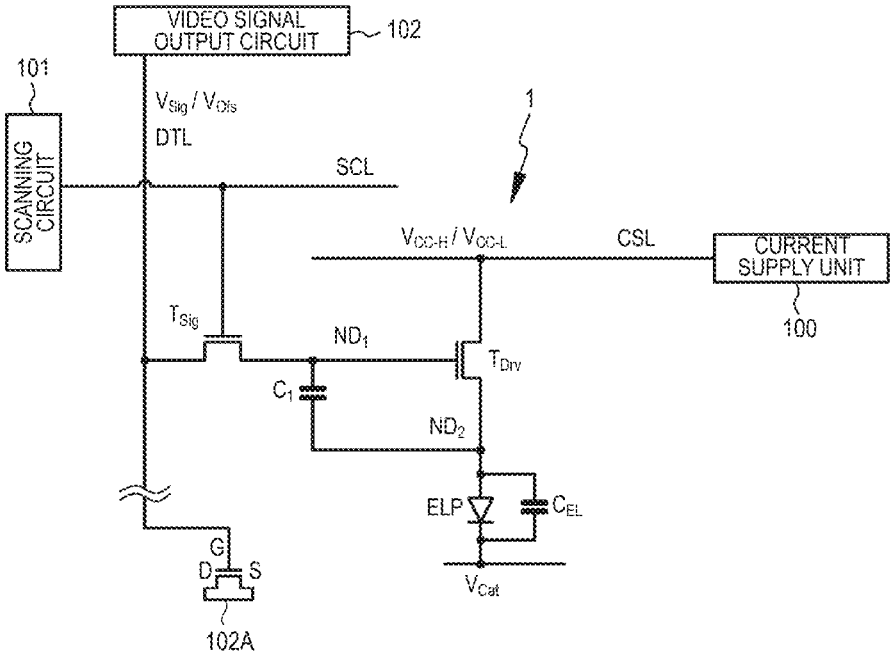
FIG. 6 is an equivalent circuit diagram of a 2Tr/1C driving circuit of Example 2.

Example 2 relates to the display device according to the second embodiment of the present disclosure and the electronic apparatus, and specifically, as in Example 1, to an organic EL display device and an electronic apparatus including the organic EL display device. FIG. 5 is a conceptual diagram of a circuit which constitutes the display device of Example 2. FIG. 6 is an equivalent circuit diagram of a light-emitting element including a driving circuit in the display device of Example 2 (in this example, the driving circuit is a driving circuit (2Tr/1C driving circuit) having two transistors $T_{Drv}$ and $T_{Sig}$ and one capacitive unit $C_1$).

The display device of Example 2 includes (A) scanning circuits 101, (B) a video signal output circuit 102, (C) a current supply unit 100, (D) M current supply lines CSL which are connected to the current supply unit 100 and extend in a first direction, (E) M scanning lines SCL which are connected to the scanning circuits 101 and extend in the first direction, (F) N data lines DTL which are connected to the video signal output circuit 102 and extend in a second direction, and (G) N×M light-emitting elements 1 in total of N light-emitting elements 1 in the first direction and M light-emitting elements 1 in the second direction different from the first direction arranged in a two-dimensional matrix, each light-emitting element 1 having a light-emitting unit (specifically, an organic EL light-emitting unit) ELP and a driving circuit for driving the light-emitting unit ELP. The driving circuit of each light-emitting element 1 is connected to the corresponding current supply line CSL, the corresponding scanning line SCL, and the corresponding data line DTL. Although in FIG. 5, 3×3 light-emitting elements 1 are shown, this is merely for illustration. The scanning circuits 101 are arranged at both ends of the scanning line SCL, but may be arranged only at one end.

A capacitive load unit (second capacitive load unit 102A) is provided in the termination portion of each data line DTL. In Example 2, the second capacitive load unit 102A has a transistor, and the capacitance of the second capacitive load unit 102A is constituted by the gate capacitance of the transistor. The configuration or structure of the second capacitive load unit 102A in the termination portion of each data line DTL is substantially the same as the configuration or structure of the first capacitive load unit 101A which is shown in FIG. 3B and described in Example 1.

In Example 2, the capacitance of the second capacitive load unit 102A is determined by the luminance difference between luminance of the light-emitting element 1 adjacent to the scanning circuit 101 in the central portion of the data line DTL and luminance of the light-emitting element 1 adjacent to the scanning circuit 101 in the termination portion of the data line DTL, a desired value of the luminance difference, and the parasitic capacitance between the scanning line SCL and the data line DTL in one light-emitting element 1 in the termination portion.

In Example 2, the capacitance of the second capacitive load unit 102A is 10 times greater than the parasitic capacitance between the scanning line SCL and the data line DTL per light-emitting element. Alternatively, in the display device of Example 2, when the pulse width of a scanning signal which is input to the light-emitting element 1 adjacent to the scanning circuit 101 in the termination portion of the data line DTL from the scanning circuit 101 through the scanning line SCL is $PW_{2\text{-}E}$, and the pulse width of a scanning signal which is input to the light-emitting element 1 adjacent to the scanning circuit 101 in the central portion of the data line DTL is $PW_{2\text{-}C}$, the following condition is satisfied.

$$0.95 \leq PW_{2\text{-}E}/PW_{2\text{-}C} < 1$$

The time constant of a driving circuit provided with the second capacitive load unit 102A is 0.99 times greater than the time constant of a driving circuit provided with no second capacitive load unit 102A.

In the display device of Example 2, the second capacitive load unit 102A is provided in the termination portion of each data line DTL. For this reason, while the scanning signal which is sent from the scanning circuit 101 and reaches the gate electrode of the video signal write transistor $T_{Sig}$ constituting the light-emitting element 1 through the scanning line SCL is changed depending on the position of the light-emitting element 1 in the second direction, the light-emitting elements 1 in and near the termination portion of the data line DTL and the light-emitting elements 1 in other regions have a closer value of parasitic capacitance formed by the scanning line SCL and the data line DTL. For this reason, the difference in the scanning signal is reduced. That is, the pulse waveform of a scanning signal which is input to the light-emitting elements 1 in and near the termination portion of the data line DTL is slow and brought close to the pulse waveform of a scanning signal which is input to the light-emitting elements 1 in other regions. As a result, it is possible to reduce the difference in luminance between the light-emitting elements 1 in and near the termination portion of the data line DTL and the light-emitting elements 1 in other regions, thereby providing a display device which is excellent in uniformity with less shading or irregularity.

Figures 7A, 7B:
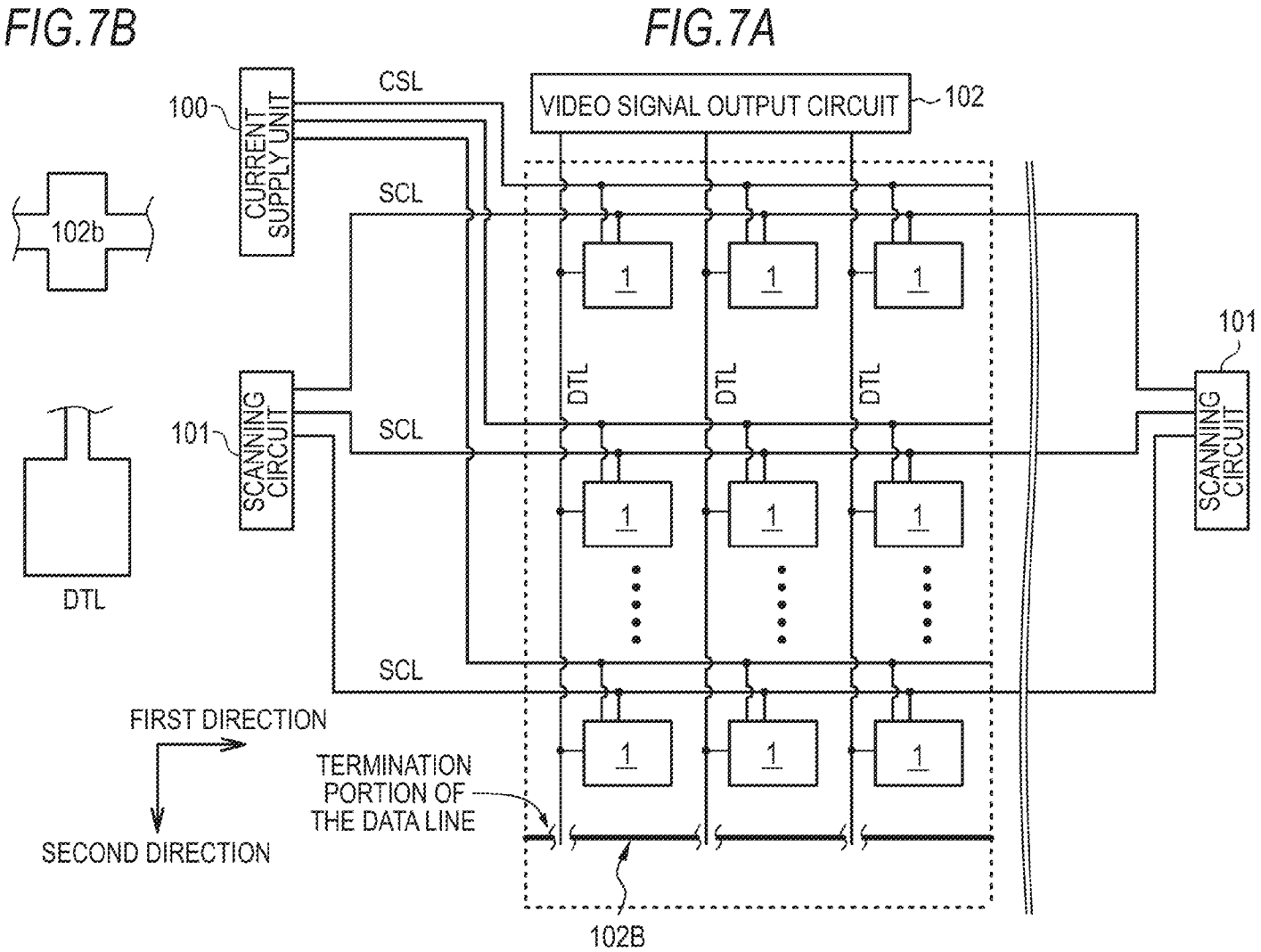
FIGS. 7A and 7B are respectively a conceptual diagram of a modification of a circuit which constitutes a display device of Example 2 or a display device of an electronic apparatus and a schematic view of a capacitive load unit (second capacitive load unit).

As shown in FIG. 7A which is a conceptual diagram of a modification of a circuit which constitutes the display device of Example 2, the second capacitive load unit 102B may two electrodes and a dielectric layer interposed between the two electrodes, and one electrode may be constituted by the data line DTL. As shown in a schematic partial plan view of FIG. 7B, the area of a portion where the data line DTL corresponding to one electrode extending in the second direction and the other electrode 102*b* overlap through the dielectric layer may be increased. The other electrode 102*b* may be grounded or may be in a floating state.

Example 3

Figure 8:
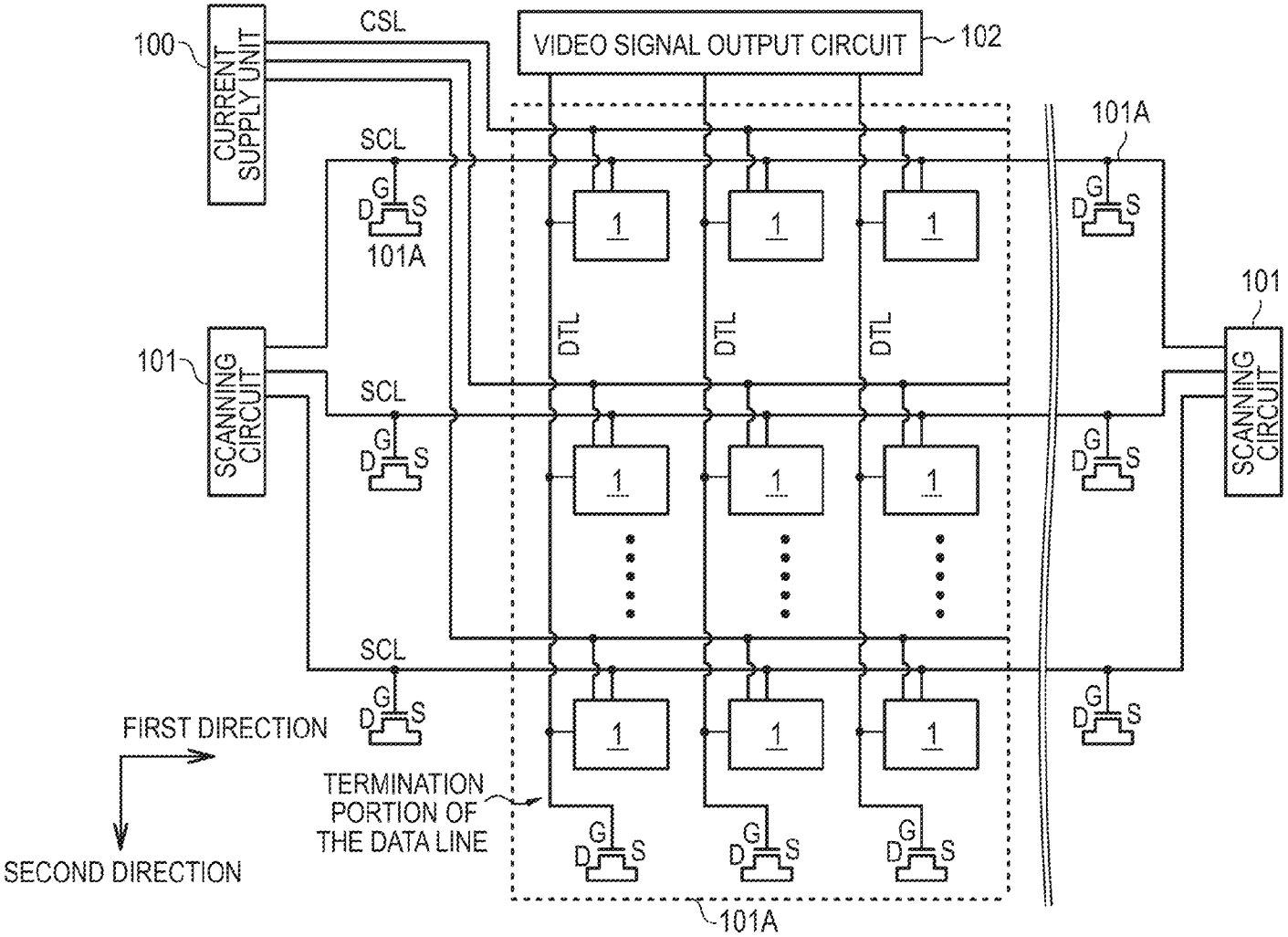
FIG. 8 is a conceptual diagram of a circuit which constitutes a display device of Example 3 or a display device of an electronic apparatus.

Example 3 is a modification of Example 1, and relates to the display device according to Embodiment of 1-A of the present disclosure, specifically, a combination of the first capacitive load unit 101A described in Example 1 and the second capacitive load unit 102A described in Example 2. FIG. 8 is a conceptual diagram of a circuit which constitutes a display device of Example 3. The first capacitive load unit 101B described in Example 1 and the second capacitive load unit 102A described in Example 2 may be combined, the first capacitive load unit 101A described in Example 1 and the second capacitive load unit 102B described in Example 2 may be combined, or the first capacitive load unit 101B described in Example 1 and the second capacitive load unit 102B described in Example 2 may be combined.

The display device, the light-emitting elements, and the driving circuit of Example 3 have the same configuration or structure as the display device, the light-emitting elements, and the driving circuit of Examples 1 and 2 excluding the above-described point, and thus detailed description thereof will not be repeated.

Example 4

In Example 4 or Examples 5 to 7 described below, the operation of the driving circuit according to the embodiment of the present disclosure is performed. The outline of a method of driving a driving circuit in Example 4 or Examples 5 to 7 described below is as follows, for example. That is, the method of driving a driving circuit includes the steps of (a) performing a preprocess for applying a first node initialization voltage to the first node $ND_1$ and applying a second node initialization voltage to the second node $ND_2$ such that the potential difference between the first node $ND_1$ and the second node $ND_2$ exceeds the threshold voltage $V_{th}$ of the drive transistor $T_{Drv}$, and the potential difference between the second node $ND_2$ and the cathode electrode of the light-emitting unit ELP does not exceed the threshold voltage $V_{th\text{-}EL}$ of the light-emitting unit ELP, (b) setting the potential of the drain region of the drive transistor $T_{Drv}$ to be higher than the potential of the second node $ND_2$ in the step (a) in a state where the potential of the first node $ND_1$ is held to increase the potential of the second node $ND_2$ and performing a threshold voltage cancel process for bringing the potential difference between the first node $ND_1$ and the second node $ND_2$ close to the threshold voltage $V_{th}$ of the drive transistor $T_{Drv}$, (c) performing a write process for applying a video signal voltage from the data line DTL to the first node $ND_1$ through the video signal write transistor $T_{Sig}$ which becomes the on state in response to a signal from the scanning line SCL and placing the drive transistor $T_{Drv}$ in the on state, (d) placing the video signal write transistor $T_{Sig}$ in the off state in response to a signal from the scanning line SCL to place the first node $ND_1$ in the floating state, and (e) allowing a current based on the value of the potential difference between the first node $ND_1$ and the second node $ND_2$ to flow into the light-emitting unit ELP from the current supply unit 100 through the drive transistor $T_{Drv}$ to drive the light-emitting unit ELP.

As described above, in the step (b), the threshold voltage cancel process is performed in which the potential difference between the first node and the second node is brought close to the threshold voltage of the drive transistor. Qualitatively, in the threshold voltage cancel process, how much the potential difference between the first node $ND_1$ and the second node $ND_2$ (in other words, the potential difference $V_{gs}$ between the gate electrode and the source region of the drive transistor $T_{Drv}$) is brought close to the threshold voltage $V_{th}$ of the drive transistor $T_{Drv}$ depends on the time of the threshold voltage cancel process. Accordingly, for example, in a form in which a sufficient time for the threshold voltage cancel process is secured, the potential difference between the first node $ND_1$ and the second node $ND_2$ reaches the threshold voltage $V_{th}$ of the drive transistor $T_{Drv}$, and the drive transistor $T_{Drv}$ is placed in the off state. In a form in which the time of the threshold voltage cancel process just has to be set to be short, the potential difference between the first node $ND_1$ and the second node $ND_2$ is greater than the threshold voltage $V_{th}$ of the drive transistor $T_{Drv}$, and the drive transistor $T_{Drv}$ may not be placed in the off state. As a result of the threshold voltage cancel process, it is not necessary that the drive transistor $T_{Drv}$ is placed in the off state.

It is assumed that the light-emitting elements which constitute each pixel are line-sequentially driven, and a display frame rate is FR (times/second). That is, the light-emitting elements which constitute each of N pixels (3×N subpixels) arranged in the m-th (where m=1, 2, 3, . . . , and M) row are driven simultaneously. In other words, in each of the light-emitting elements which constitute one row, the light-emission/non-light-emission timing is controlled in terms of rows to which these light-emitting elements belong. A process for writing a video signal to each pixel constituting one row may be a process (simultaneous write process) for writing a video signal to all pixels simultaneously, or a process (sequential write process) for sequentially writing a video signal to each pixel. These write processes may be appropriately selected in accordance with the configuration of the light-emitting element or the driving circuit.

Hereinafter, the driving or operation of a light-emitting element which constitutes one subpixel in a pixel in the m-th row and the n-th column (where n=1, 2, 3, . . . , and N) will be described. A relevant subpixel or light-emitting element is hereinafter referred to as the (n,m)th subpixel or the (n,m)th light-emitting element. Various processes (a threshold voltage cancel process, a write process, and a mobility correction process described below) are performed until the horizontal scanning period (the m-th horizontal scanning period) of each light-emitting element arranged in the m-th row ends. It is necessary that the write process or the mobility correction process is performed within the m-th horizontal scanning period. The threshold voltage cancel process or the associated preprocess may be performed ahead of the m-th horizontal scanning period depending on the type of light-emitting element or driving circuit.

After various processes described above end, the light-emitting unit which constitute each light-emitting element arranged in the m-th row emits light. The light-emitting unit may emit light immediately or when a predetermined period (for example, horizontal scanning periods for a predetermined number of rows) elapses after various processes described above end. The predetermined period may be appropriately set in accordance with the specification of the display device, the configuration of the light-emitting element or the driving circuit, or the like. In the following description, for convenience of description, it is assumed that the light-emitting unit emits light immediately after various processes end. Light emission of the light-emitting unit which constitutes each light-emitting element arranged in the m-th row continues immediately before the start of the horizontal scanning period of each light-emitting element arranged in the (m+m')th row. "m'" is determined the design specification of the display device. That is, light emission of the light-emitting unit which constitutes each light-emitting element arranged in the m-th row in a certain display frame continues up to the (m+m'−1)th horizontal scanning period. The light-emitting unit which constitutes each light-emitting element arranged in the m-th row is maintained in the non-light-emission state from the beginning of the (m+m')th horizontal scanning period until the write process or the mobility correction process is completed within the m-th horizontal scanning period in the next display frame. If the period (hereinafter, simply referred to as a non-light-emission period) of the above-described non-light-emission state is provided, after-image blurring due to active matrix driving can be reduced, and excellent motion image quality can be obtained. The light-emission state/non-light-emission state of each sub-pixel (light-emitting element) is not limited to the state described above. The time length of the horizontal scanning period is the time length smaller than (1/FR)×(1/M). When the value of (m+m') exceeds M, the horizontal scanning period for the excess is processed in the next display frame.

In the following description, of the two source/drain regions of one transistor, the term "one region of the source/drain regions" means the source/drain region which is connected to the current supply unit or a power supply unit. When a transistor is in the on state, this means a state where a channel is formed between the source/drain regions. It does not matter whether a current flows from one region of the source/drain regions of a certain transistor to the other of the source/drain regions. When a transistor is in the off state, this means a state where a channel is not formed between the source/drain regions. When the source/drain regions of a certain transistor are connected to the source/drain regions of another transistor, this includes a form in which the source/drain regions of the certain transistor and the source/drain regions of another transistor occupy the same region. The source/drain regions may be formed of a conductive material, such as polysilicon or amorphous silicon containing an impurity, or may be formed of metal, alloy, conductive particles, a laminated structure thereof, or a layer made of an organic material (conductive polymer). In a timing chart which is used in the following description, the length (time length) of the horizontal axis which represents each period is schematically shown, and is not intended to represent the ratio of the time length of each period.

Figure 9:
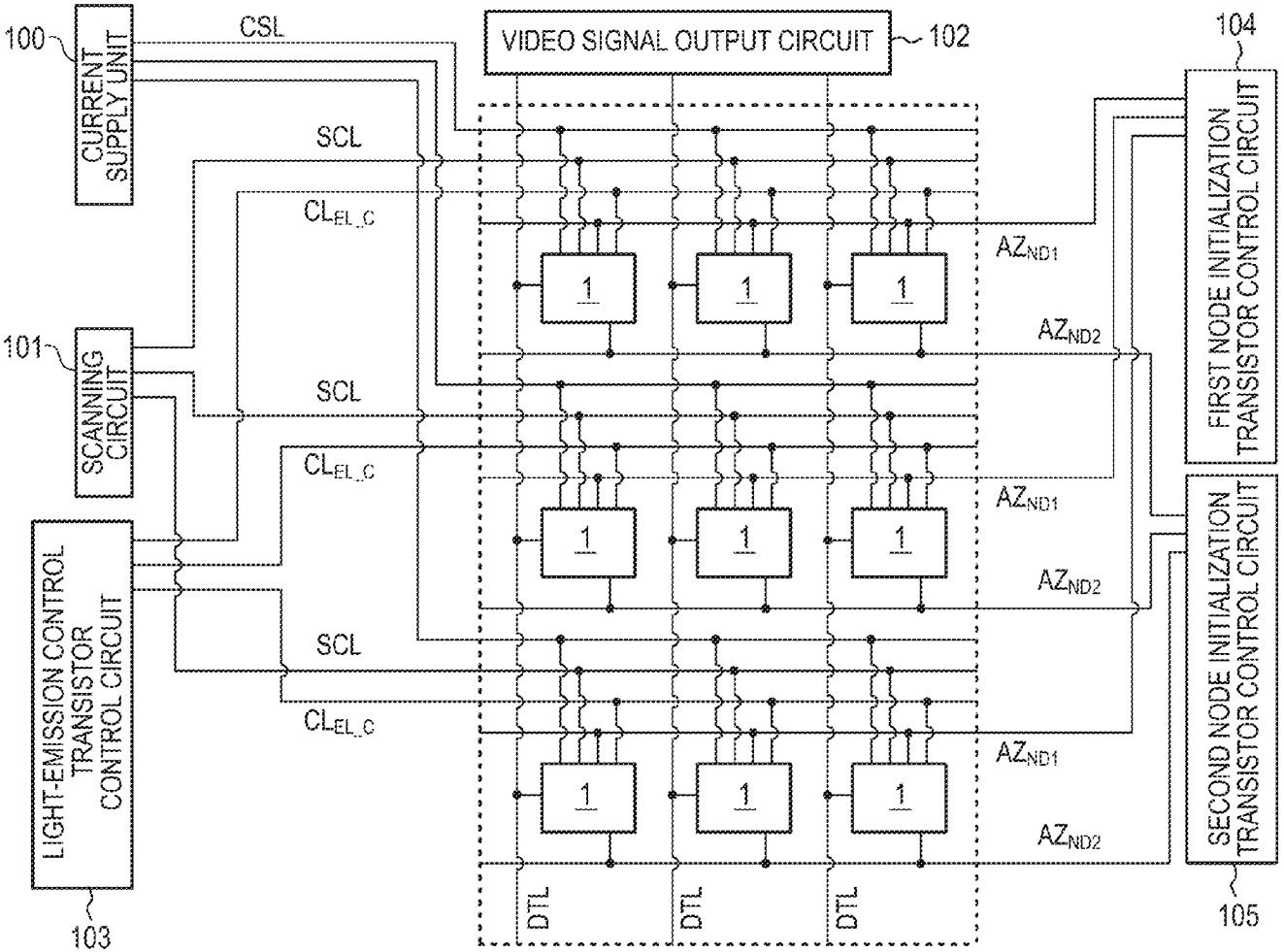
FIG. 9 is a conceptual diagram of a circuit which constitutes a display device of Example 4 or a display device of an electronic apparatus.
Figure 10:
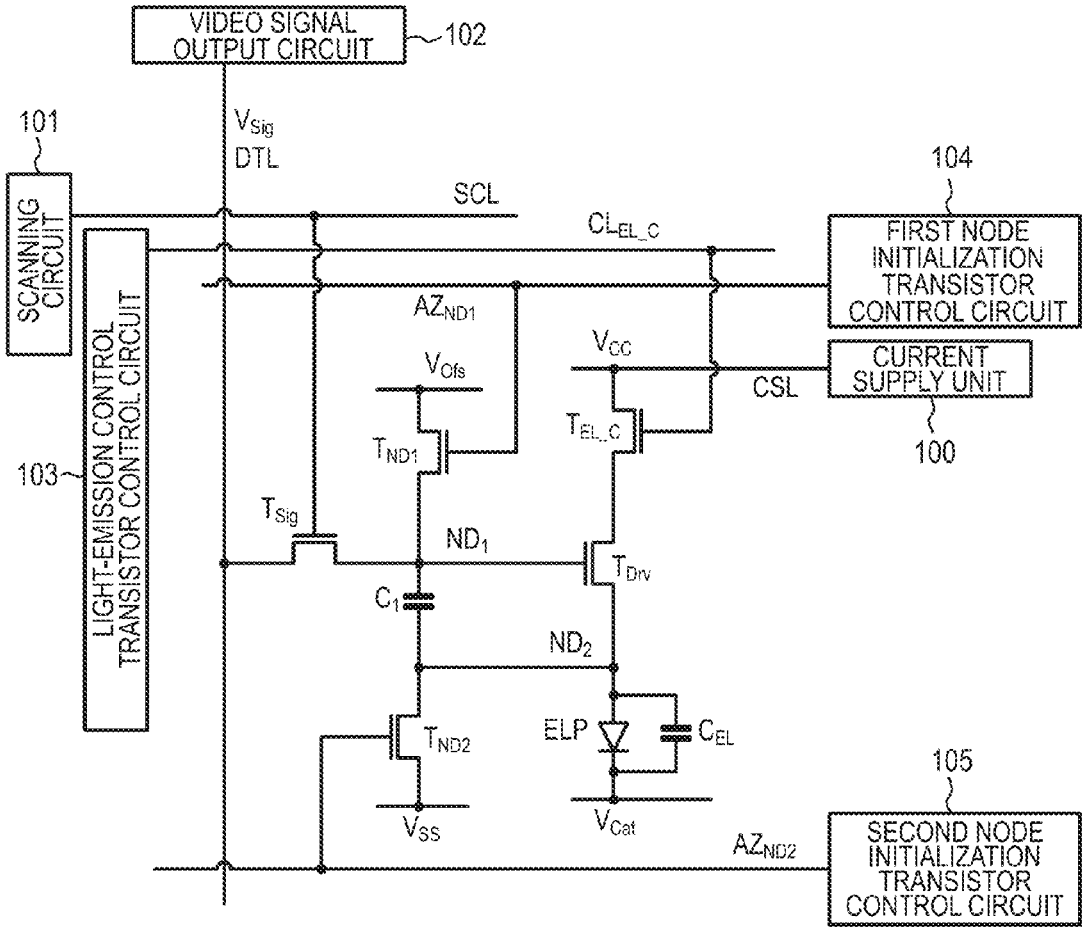
FIG. 10 is an equivalent circuit diagram of a 5Tr/1C driving circuit of Example 4.
Figure 11:
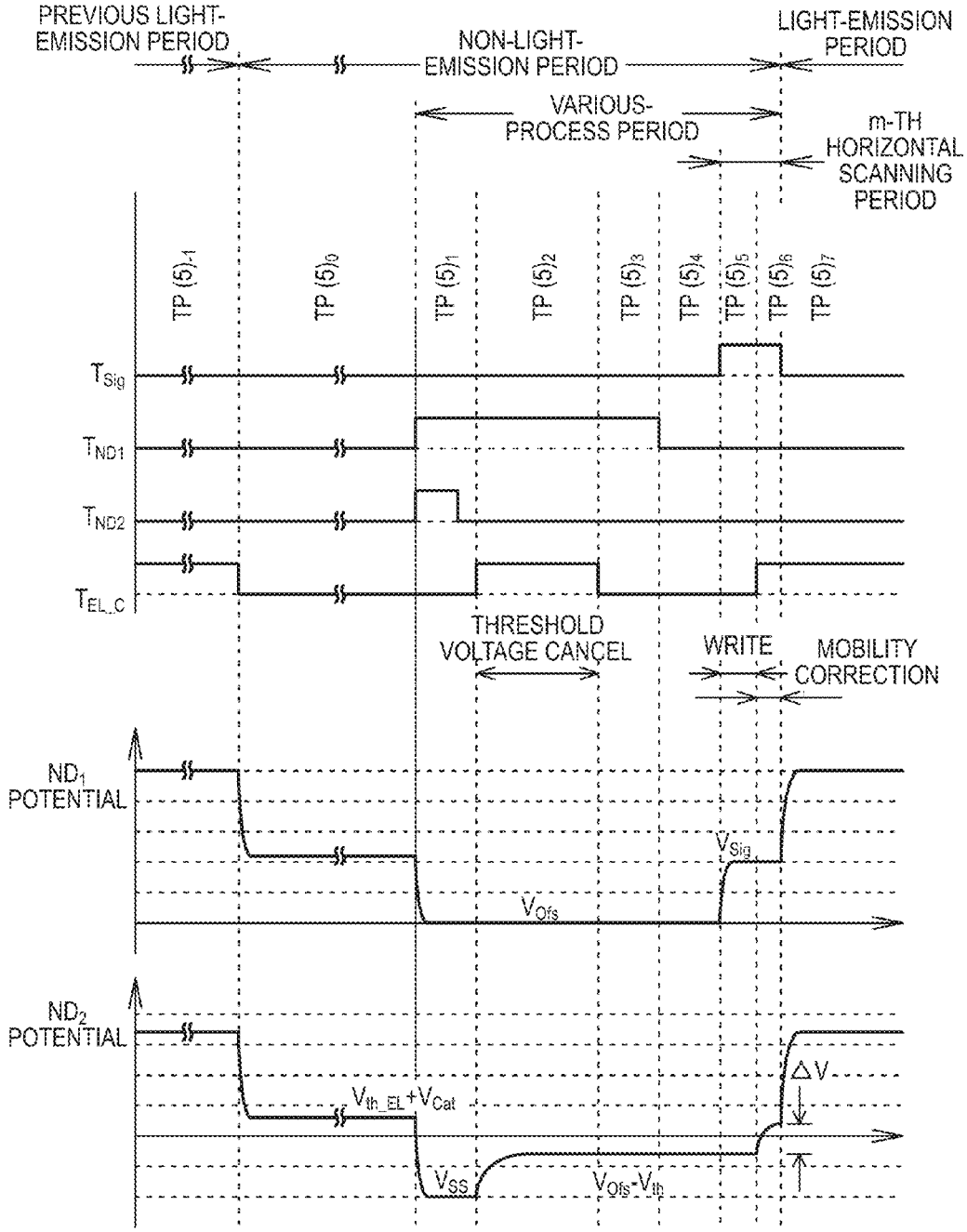
FIG. 11 is a diagram schematically showing a driving timing chart of a 5Tr/1C driving circuit of Example 4.

Specifically, the driving circuit of Example 4 is a driving circuit (5Tr/1C driving circuit) having five transistors and one capacitive unit $C_1$. FIG. 9 is a conceptual diagram of a circuit which constitutes the display device of Example 4. FIG. 10 is an equivalent circuit diagram of a 5Tr/1C driving circuit. FIG. 11 is a schematic driving timing chart. FIGS. 12A to 12D and 13A to 13E schematically show the on/off state and the like of each transistor. In FIGS. 9, 10, 14, 15, 19, and 20, only one scanning circuit 101 is shown, and the first capacitive load unit and/or the second capacitive load unit are not shown.

The 5Tr/1C driving circuit has five transistors of the video signal write transistor $T_{Sig}$ and the drive transistor $T_{Drv}$ including the first capacitive load unit and/or the second capacitive load unit described in Examples 1 to 3, a light-emission control transistor $T_{EL_C}$, a first node initialization transistor $T_{ND1}$, a second node initialization transistor $T_{ND2}$, and one capacitive unit $C_1$.

[Light-Emission Control Transistor $T_{EL_C}$]

One of the source/drain regions of the light-emission control transistor $T_{EL_C}$ is connected to the current supply unit (voltage $V_{CC}$) 100, and the other of the source/drain regions of the light-emission control transistor $T_{EL_C}$ is connected to one region of the source/drain regions of the drive transistor $T_{Drv}$. The on/off operation of the light-emission control transistor $T_{EL_C}$ is controlled by a light-emission control transistor control line $CL_{EL_C}$ connected to the gate electrode of the light-emission control transistor $T_{EL_C}$.

[Drive Transistor $T_{Drv}$]

As described above, one region of the source/drain regions of the drive transistor $T_{Drv}$ is connected to the other of the source/drain regions of the light-emission control transistor $T_{EL_C}$. That is, the drive transistor $T_{Drv}$ is connected to the current supply unit 100 through the light-emission control transistor $T_{EL_C}$. The other of the source/drain regions of the drive transistor $T_{Drv}$ is connected to (1) the anode electrode of the light-emitting unit ELP, (2) the other of the source/drain regions of the second node initialization transistor $T_{ND2}$, and (3) one electrode of the capacitive unit $C_1$, and forms a second node $ND_2$. The gate electrode of the drive transistor $T_{Drv}$ is connected to (1) the other of the source/drain regions of the video signal write transistor $T_{Sig}$, (2) the other of the source/drain regions of the first node initialization transistor $T_{ND1}$, and (3) the other electrode of the capacitive unit $C_1$, and forms a first node $ND_1$.

In the light-emission state of the light-emitting unit ELP, the drive transistor $T_{Drv}$ is driven such that a drain current $I_{ds}$ flows in accordance with Expression (1). In the light-emission state of the light-emitting unit ELP, one region of the source/drain regions of the drive transistor $T_{Drv}$ operates as a drain region, and the other of the source/drain regions operates as a source region. As described in Example 1, hereinafter, one region of the source/drain regions of the drive transistor $T_{Drv}$ is simply referred to as a drain region, and the other of the source/drain regions is simply referred to as a source region.

μ: effective mobility

L: channel length

W: channel width $V_{gs}$: potential difference between gate electrode and source region $V_{th}$: threshold voltage $C_{ox}$: (relative dielectric constant of gate insulating layer)×(dielectric constant of vacuum)/(thickness of gate insulating layer)

$$k=(1/2)\cdot(W/L)\cdot C_{ox}$$

$$I_{ds}=k\cdot\mu\cdot(V_{gs}-V_{th})^2 \quad (1)$$

If the drain current $I_{ds}$ flows in the light-emitting unit ELP, the light-emitting unit ELP emits light. The light-emission state (luminance) of the light-emitting unit ELP is controlled depending on the magnitude of the value of the drain current $I_{ds}$.

[Video Signal Write Transistor $T_{Sig}$]

As described in Example 1, the other of the source/drain regions of the video signal write transistor $T_{Sig}$ is connected to the gate electrode of the drive transistor $T_{Drv}$. One of the source/drain regions of the video signal write transistor $T_{Sig}$ is connected to the data line DTL. A driving signal (luminance signal) $V_{Sig}$ for controlling luminance of the light-emitting unit ELP is supplied from the video signal output circuit 102 to one region of the source/drain regions through the data line DTL. Various signals/voltages (a signal for precharge driving, various reference voltages, and the like) other than $V_{Sig}$ may be supplied to one region of the source/drain regions through the data line DTL. The on/off operation of the video signal write transistor $T_{Sig}$ is controlled by the scanning signal in the scanning line SCL connected to the gate electrode of the video signal write transistor $T_{Sig}$. The pulse waveform of the scanning signal in the scanning line SCL becomes a slowed pulse waveform through the first capacitive load unit and/or the second capacitive load unit described in Examples 1 to 3. In the following description, the scanning signal may be referred to as "slowed scanning signal".

[First Node Initialization Transistor $T_{ND1}$]

As described above, the other of the source/drain regions of the first node initialization transistor $T_{ND1}$ is connected to the gate electrode of the drive transistor $T_{Drv}$. A voltage $V_{Ofs}$ for initializing the potential of the first node $ND_1$ (that is, the potential of the gate electrode of the drive transistor $T_{Drv}$) is supplied to one region of the source/drain regions of the first node initialization transistor $T_{ND1}$. The on/off operation of the first node initialization transistor $T_{ND1}$ is controlled by a first node initialization transistor control line $AZ_{ND1}$ connected to the gate electrode of the first node initialization transistor $T_{ND1}$. The first node initialization transistor control line $AZ_{ND1}$ is connected to a first node initialization transistor control circuit 104.

[Second Node Initialization Transistor $T_{ND2}$]

As described above, the other of the source/drain regions of the second node initialization transistor $T_{ND2}$ is connected to the source region of the drive transistor $T_{Drv}$. A voltage $V_{SS}$ for initializing the potential of the second node $ND_2$ (that is, the potential of the source region of the drive transistor $T_{Drv}$) is supplied to one region of the source/drain regions of the second node initialization transistor $T_{ND2}$. The on/off operation of the second node initialization transistor $T_{ND2}$ is controlled by a second node initialization transistor control line $AZ_{ND2}$ connected to the gate electrode of the second node initialization transistor $T_{NE2}$. The second node initialization transistor control line $AZ_{ND2}$ is connected to a second node initialization transistor control circuit 105.

[Light-Emitting Unit ELP]

As described above, the anode electrode of the light-emitting unit ELP is connected to the source region of the drive transistor $T_{Drv}$. A voltage $V_{Cat}$ is applied to the cathode electrode of the light-emitting unit ELP. The parasitic capacitance of the light-emitting unit ELP is represented by reference numeral $C_{EL}$. It is assumed that a threshold voltage which is required for light emission of the light-emitting unit ELP is $V_{th\text{-}EL}$. That is, if a voltage equal to or higher than $V_{th\text{-}EL}$ is applied between the anode electrode and the cathode electrode of the light-emitting unit ELP, the light-emitting unit ELP emits light.

Although in the following description, the values of the voltages or potentials are as follows, these values are just for illustration, and the voltages or potentials are not limited to these values.

$V_{Sig}$: driving signal (luminance signal) for controlling luminance of light-emitting unit ELP . . . 0 volt to 10 volt $V_{CC}$: voltage of current supply unit for controlling light emission of light-emitting unit ELP . . . 20 volt $V_{Ofs}$: voltage for initializing potential of gate electrode of drive transistor $T_{Drv}$ (potential of first node $ND_1$) . . . 0 volt $V_{SS}$: voltage for initializing potential of source region of drive transistor $T_{Drv}$ (potential of second node $ND_2$) . . . −10 volt $V_{th}$: threshold voltage of drive transistor $T_{Drv}$ . . . 3 volt $V_{Cat}$ voltage applied to cathode electrode of light-emitting unit ELP . . . 0 volt $V_{th\text{-}EL}$: threshold voltage of light-emitting unit ELP . . . 3 volt Hereinafter, the operation of the 5Tr/1C driving circuit will be described. As described above, although a case where the light-emission state starts immediately after various processes (threshold voltage cancel process, write process, and mobility correction process) are completed will be described, the form is not limited to this. The same applies to a 4Tr/1C driving circuit, a 3Tr/1C driving circuit, and a 2Tr/1C driving circuit described below.

Figure 12A:
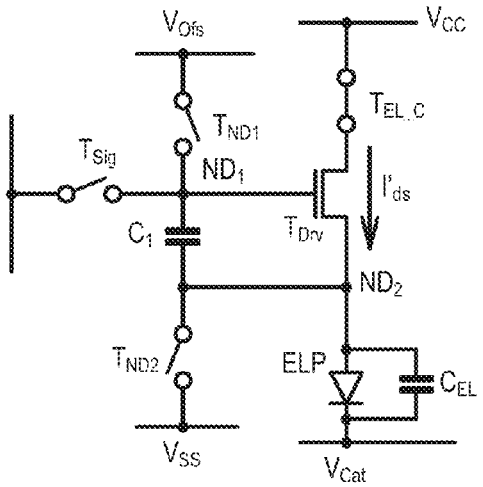
FIGS. 12A to 12D are diagrams schematically showing the on/off state and the like of each transistor which constitutes a 5Tr/1C driving circuit of Example 4.

[Period-TP$(5)_{-1}$] (see FIGS. 11 and 12A)

[Period-TP$(5)_{-1}$] is, for example, the operation in the previous display frame, and the period in which the (n,m)th light-emitting unit ELP is in the light-emission state after various previous processes are completed. That is, a drain current $I'_{ds}$ based on Expression (5) flows in the light-emitting unit ELP which constitutes the (n,m)th subpixel, and luminance of the light-emitting unit ELP which constitutes the (n,m)th subpixel has a value corresponding to the relevant drain current $I'_{ds}$. The video signal write transistor $T_{Sig}$, the first node initialization transistor $T_{ND1}$, and the second node initialization transistor $T_{ND2}$ are in the off state, and the light-emission control transistor $T_{EL_C}$ and the drive transistor $T_{Drv}$ are in the on state. The light-emission state of the (n,m)th light-emitting unit ELP continues immediately before the start of the horizontal scanning period of the light-emitting unit ELP arranged in the (m+m')th row.

[Period-TP$(5)_0$] to [Period-TP$(5)_4$] shown in FIG. 11 are the operation period from when the light-emission state ends after various previous processes are completed immediately before the next write process is performed. That is, [Period-TP$(5)_0$] to [Period-TP$(5)_4$] is the period of a certain time length from the start of the (m+m')th horizontal scanning period in the previous display frame until the end of the (m−1)th horizontal scanning period in the current display frame. [Period-TP$(5)_1$] to [Period-TP$(5)_4$] may be included within the m-th horizontal scanning period in the current display frame.

In [Period-TP$(5)_0$] to [Period-TP$(5)_4$], the (n,m)th light-emitting unit ELP is in the non-light-emission state. That is, in [Period-TP$(5)_0$] to [Period-TP$(5)_1$] and [Period-TP$(5)_3$] to [Period-TP$(5)_4$], since the light-emission control transistor $T_{EL_C}$ is in the off state, the light-emitting unit ELP does not emit light. In [Period-TP$(5)_2$], the light-emission control transistor $T_{EL_C}$ is placed in the on state. However, in this period, a threshold voltage cancel process described below is performed. Although the threshold voltage cancel process will be described below in detail, if it is assumed that Expression (2) is satisfied, the light-emitting unit ELP does not emit light.

Hereinafter, each period of [Period-TP$(5)_0$] to [Period-TP$(5)_4$] will be first described. Note that the length of the beginning of [Period-TP$(5)_1$] or each period of [Period-TP$(5)_1$] to [Period-TP$(5)_4$] may be appropriately set in accordance with design for a display device.

[Period-TP$(5)_0$]

As described above, in [Period-TP$(5)_0$], the (n,m)th light-emitting unit ELP is in the non-light-emission state. The video signal write transistor $T_{Sig}$, the first node initialization transistor $T_{ND1}$, and the second node initialization transistor $T_{ND2}$ are in the off state. At the time of change from [Period-TP$(5)_{-1}$] to [Period-TP$(5)_0$], since the light-emission control transistor $T_{EL_C}$ is placed in the off state, the potential of the second node $ND_2$ (the source region of the drive transistor $T_{Drv}$ or the anode electrode of the light-emitting unit ELP) drops down to ($V_{th\text{-}EL}$+$V_{Cat}$), and the light-emitting unit ELP is placed in the non-light-emission state. In order to follow the potential drop of the second node $ND_2$, the potential of the first node $ND_2$ (the gate electrode of the drive transistor $T_{Drv}$) in the floating state also drops.

Figure 12B:
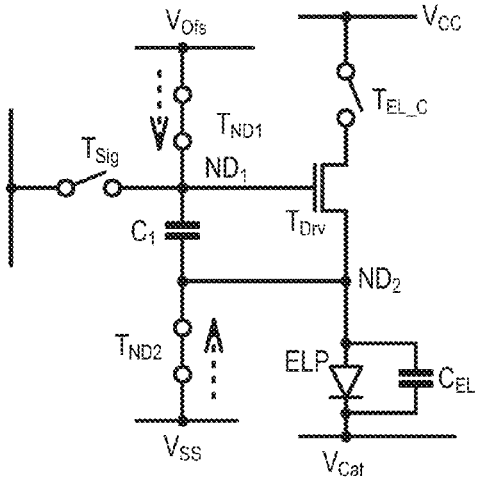
Figure 12C:
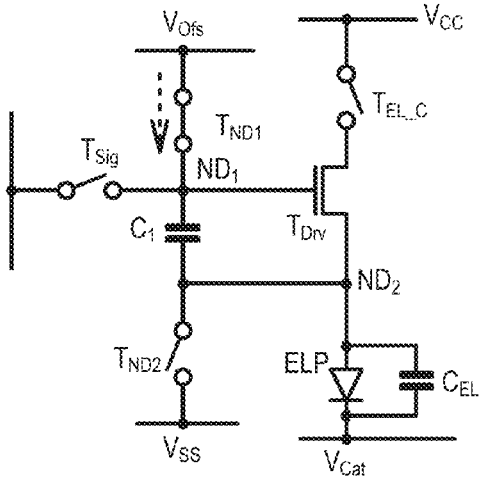

[Period-TP$(5)_1$] (see FIGS. 12B and 12C)

In [Period-TP$(5)_1$], a preprocess for performing a threshold voltage cancel process described below is performed. That is, at the time of the start of [Period-TP$(5)_1$], if the first node initialization transistor control line $AZ_{ND1}$ and the second node initialization transistor control line $AZ_{ND2}$ are at high level on the basis of the operation of the first node initialization transistor control circuit 104 and the second node initialization transistor control circuit 105, the first node initialization transistor $T_{ND1}$ and the second node initialization transistor $T_{ND2}$ are placed in the on state. As a result, the potential of the first node $ND_1$ becomes $V_{Ofs}$ (for example, 0 volt). The potential of the second node $ND_2$ becomes $V_{SS}$ (for example, −10 volt). Before [Period-TP$(5)_1$] is completed, if the second node initialization transistor control line $AZ_{ND2}$ is at low level on the basis of the operation of the second node initialization transistor control circuit 105, the second node initialization transistor $T_{ND2}$ is placed in the off state. The first node initialization transistor $T_{ND1}$ and the second node initialization transistor $T_{ND2}$ may be placed in the on state simultaneously, the first node initialization transistor $T_{ND1}$ may be placed in the on state ahead, or the second node initialization transistor $T_{ND2}$ may be placed in the on state ahead.

With the above-described process, the potential difference between the gate electrode and the source region of the drive transistor $T_{Drv}$ is equal to or greater than $V_{th}$, and the drive transistor $T_{Drv}$ becomes the on state.

Figure 12D:
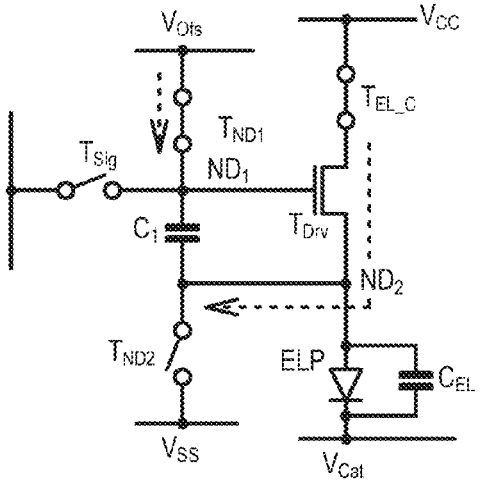

[Period-TP$(5)_2$] (see FIG. 12D)

Next, the threshold voltage cancel process is performed. That is, if the light-emission control transistor control line $CL_{EL_C}$ is at high level on the basis of the operation of a light-emission control transistor control circuit 103 while the first node initialization transistor $T_{ND1}$ is maintained in the on state, the light-emission control transistor $T_{EL_C}$ is placed in the on state. As a result, while the potential of the first node $ND_1$ is not changed (maintained at $V_{Ofs}$=0 volt), the potential of the second node $ND_2$ in the floating state rises, and the potential difference between the first node $ND_1$ and the second node $ND_2$ is brought close to the threshold voltage $V_{th}$ of the drive transistor $T_{Drv}$. If the potential difference between the gate electrode and the source region of the drive transistor $T_{Drv}$ reaches $V_{th}$, the drive transistor $T_{Drv}$ is placed in the off state. Specifically, the potential of the second node $ND_2$ in the floating state is brought close to ($V_{Ofs}-V_{th}$=−3 volt>$V_{SS}$), and finally becomes ($V_{Ofs}-V_{th}$). If Expression (2) is assured, in other words, if the potential is selected and determined so as to satisfy Expression (2), the light-emitting unit ELP does not emit light. Qualitatively, in the threshold voltage cancel process, how much the potential difference between the first node $ND_1$ and the second node $ND_2$ (in other words, the potential difference between the gate electrode and the source region of the drive transistor $T_{Drv}$) is brought close to the threshold voltage $V_{th}$ of the drive transistor $T_{Drv}$ depends on the time of the threshold voltage cancel process. Accordingly, for example, when a sufficient time for the threshold voltage cancel process is secured, the potential difference between the first node $ND_1$ and the second node $ND_2$ reaches the threshold voltage $V_{th}$ of the drive transistor $T_{Drv}$, and the drive transistor $T_{Drv}$ is placed in the off state. For example, when the time of the threshold voltage cancel process is set to be short, the potential difference between the first node $ND_1$ and the second node $ND_2$ is greater than the threshold voltage $V_{th}$ of the drive transistor $T_{Drv}$, and the drive transistor $T_{Drv}$ may not be placed in the off state. That is, as a result of the threshold voltage cancel process, it is not necessary that the drive transistor $T_{Drv}$ is placed in the off state.

$$(V_{Ofs}-V_{th})<(V_{th\text{-}EL}+V_{Cat}) \quad (2)$$

In [Period-TP$(5)_2$], the potential of the second node $ND_2$ finally becomes, for example, ($V_{Ofs}-V_{th}$). That is, the potential of the second node $ND_2$ is determined depending on only the threshold voltage $V_{th}$ of the drive transistor $T_{Drv}$ and the voltage $V_{Ofs}$ for initializing the gate electrode of the drive transistor $T_{Drv}$. In other words, the potential of the second node $ND_2$ does not depend on the threshold voltage $V_{th\text{-}EL}$ of the light-emitting unit ELP.

Figure 13A:
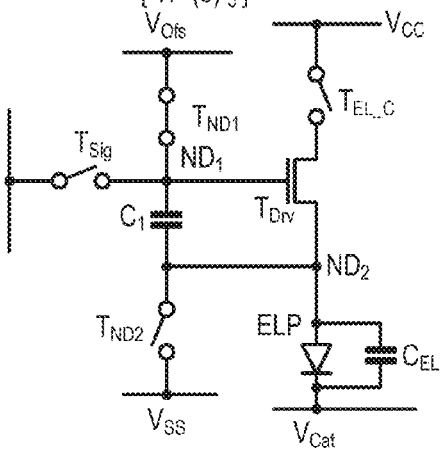
FIGS. 13A to 13E are diagrams, subsequent to FIG. 12D, schematically showing the on/off state and the like of each transistor which constitutes a 5Tr/1C driving circuit of Example 4.

[Period-TP$(5)_3$] (see FIG. 13A)

Thereafter, if the light-emission control transistor control line $CL_{EL_C}$ is at low level on the basis of the operation of the light-emission control transistor control circuit 103 while the first node initialization transistor $T_{ND1}$ is maintained in the on state, the light-emission control transistor $T_{EL_C}$ is placed in the off state. As a result, the potential of the first node $ND_1$ is not changed (maintained at $V_{Ofs}$=0 volt), and the potential of the second node $ND_2$ in the floating state is not also changed and held at ($V_{Ofs}-V_{th}$=−3 volt).

Figure 13B:
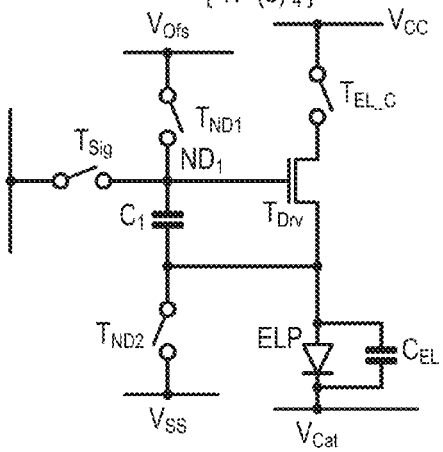

[Period-TP$(5)_4$] (see FIG. 13B)

Next, if the first node initialization transistor control line $AZ_{ND1}$ is at low level on the basis of the operation of the first node initialization transistor control circuit 104, the first node initialization transistor $T_{ND1}$ is placed in the off state. The potentials of the first node $ND_1$ and the second node $ND_2$ are not substantially changed (actually, a change in the potential occurs due to electrostatic coupling, such as parasitic capacitance, but this change is normally negligible).

Next, each period of [Period-TP$(5)_5$] to [Period-TP$(5)_7$] will be described. As described below, a write process is performed in [Period-TP$(5)_5$], and a mobility correction process is performed in [Period-TP$(5)_6$]. As described above, it is necessary that these processes are performed within the m-th horizontal scanning period. For convenience of description, description will be provided assuming that the beginning of [Period-TP$(5)_5$] and the end of [Period-TP$(5)_6$]respectively match the beginning and end of the m-th horizontal scanning period.

Figure 13C:
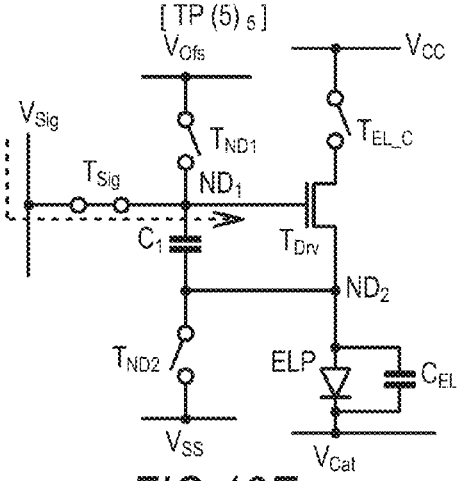

[Period-TP$(5)_5$] (see FIG. 13C)

Thereafter, the write process to the drive transistor $T_{Drv}$ is performed. Specifically, while the first node initialization transistor $T_{ND1}$, the second node initialization transistor $T_{ND2}$, and the light-emission control transistor $T_{EL_C}$ are maintained in the off state, if the potential of the data line DTL is set as the driving signal (luminance signal) $V_{Sig}$ for controlling luminance of the light-emitting unit ELP on the basis of the operation of the video signal output circuit 102, and then the scanning line SCL is at high level on the basis of the operation of the scanning circuit 101 (that is, by the slowed scanning signal), the video signal write transistor $T_{Sig}$ is placed in the on state. As a result, the potential of the first node $ND_1$ rises to $V_{Sig}$.

The capacitance of the capacitive unit $C_1$ has a value $c_1$, and the capacitance of parasitic capacitance $C_{EL}$ of the light-emitting unit ELP has a value $c_{EL}$. It is assumed that the value of parasitic capacitance between the gate electrode and the source region of the drive transistor $T_{Drv}$ is $c_{gs}$. When the potential of the gate electrode of the drive transistor $T_{Drv}$ is changed from $V_{Ofs}$ to $V_{Sig}$ (>$V_{Ofs}$), in principle, the potentials at both ends of the capacitive unit $C_1$ (the potentials of the first node $ND_1$ and the second node $ND_2$) are changed. That is, electric charges based on the change ($V_{Sig}-V_{Ofs}$) in the potential (=the potential of the first node $ND_1$) of the gate electrode of the drive transistor $T_{Drv}$ are divided into the capacitive unit $C_1$, the parasitic capacitance $C_{EL}$ of the light-emitting unit ELP, and parasitic capacitance between the gate electrode and the source region of the drive transistor $T_{Drv}$. Incidentally, if the value $c_{EL}$ is sufficiently greater than the value $c_1$ and the value $c_{gs}$, a change in the potential of the source region (second node $ND_2$) of the drive transistor $T_{Drv}$ based on the change ($V_{Sig}-V_{Ofs}$) in the potential of the gate electrode of the drive transistor $T_{Drv}$ is small. In general, the capacitance value $c_{EL}$ of the parasitic capacitance $C_{EL}$ of the light-emitting unit ELP is greater than the capacitance value $c_1$ of the capacitive unit $C_1$ and the value $c_{gs}$ of parasitic capacitance of the drive transistor $T_{Drv}$. For convenience of description, unless particularly required, description will be provided without taking into consideration a change in the potential of the second node $ND_2$ due to a change in the potential of the first node $ND_1$. The same applies to other driving circuits. The driving timing charge of FIG. 11 is shown without taking into consideration a change in the potential of the second node $ND_2$ due to a change in the potential of the first node $ND_1$. When the potential of the gate electrode of the drive transistor $T_{Drv}$ (first node $ND_1$) is $V_g$, and the potential of the source region of the drive transistor $T_{Drv}$ (second node $ND_2$) is $V_s$, the value of $V_g$ and the value of $V_s$ are as follows. For this reason, the potential difference between the first node $ND_2$ and the second node $ND_2$, that is, the potential difference $V_{gs}$ between the gate electrode and the source region of the drive transistor $T_{Drv}$ can be expressed by Expression (3).

$$V_g = V_{Sig}$$

$$V_s \cong V_{Ofs} - V_{th}$$

$$V_{gs} \cong V_{Sig} - (V_{Ofs} - V_{th}) \quad (3)$$

That is, $V_{gs}$ which is obtained in the write process to the drive transistor $T_{Drv}$ depends on only the driving signal (luminance signal) $V_{Sig}$ for controlling luminance of the light-emitting unit ELP, the threshold voltage $V_{th}$ of the drive transistor $T_{Drv}$, and the voltage $V_{Ofs}$ for initializing the gate electrode of the drive transistor $T_{Drv}$. $V_{gs}$ does not depend on the threshold voltage $V_{th\text{-}EL}$ of the light-emitting unit ELP.

Figure 13D:
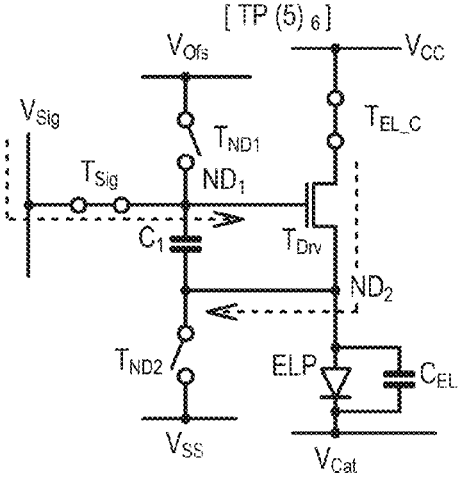

[Period-TP$(5)_6$] (see FIG. 13D)

Thereafter, the potential of the source region of the drive transistor $T_{Drv}$ (second node $ND_2$) is corrected on the basis of the magnitude of mobility μ of the drive transistor $T_{Drv}$ (mobility correction process).

In general, when the drive transistor $T_{Drv}$ is manufactured using a polysilicon thin film transistor or the like, variation in mobility μ is inevitably generated between transistors. Accordingly, even when the driving signal $V_{Sig}$ of the same value is applied to the gate electrodes of a plurality of drive transistors $T_{Drv}$ which are different in mobility there is a difference between the drain current $I_{ds}$ which flows in the drive transistor $T_{Drv}$ having large mobility μ and the drain current $I_{ds}$ which flows in the drive transistor $T_{Drv}$ having small mobility μ. If this difference is generated, screen uniformity of the display device is damaged.

Accordingly, specifically, if the light-emission control transistor control line $CL_{EL_C}$ is at high level on the basis of the operation of the light-emission control transistor control circuit 103 while the drive transistor $T_{Drv}$ is maintained in the on state, the light-emission control transistor $T_{EL_C}$ is placed in the on state. Next, if the scanning line SCL is at low level on the basis of the operation of the scanning circuit 101 when a predetermined time ($t_0$) has elapsed, the video signal write transistor $T_{Sig}$ is placed in the off state, and the first node $ND_1$ (the gate electrode of the drive transistor $T_{Drv}$) is placed in the floating state. As a result, when the value of mobility μ of the drive transistor $T_{Drv}$ is large, the amount ΔV (potential correction value) of rise in the potential of the source region of the drive transistor $T_{Drv}$ increases. When the value of mobility μ of the drive transistor $T_{Drv}$ is small, the amount ΔV (potential correction value) of rise in the potential of the source region of the drive transistor $T_{Drv}$ decreases. The potential difference $V_{gs}$ between the gate electrode and the source region of the drive transistor $T_{Drv}$ is modified from Expression (3) to Expression (4).

$$V_{gs} \cong V_{Sig} - (V_{Ofs} - V_{th}) - \Delta V \quad (4)$$

A predetermined time (the full time $t_0$ of [Period-TP$(5)_6$]) for performing the mobility correction process may be determined in advance as a design value at the time of design of the display device. The full time $t_0$ of [Period-TP$(5)_6$] is determined such that the potential ($V_{Ofs} - V_{th} + \Delta V$) of the source region of the drive transistor $T_{Drv}$ at this time satisfies Expression (2'). Accordingly, in [Period-TP$(5)_6$], the light-emitting unit ELP does not emit light. With the mobility correction process, variation in the coefficient k ($\equiv(1/2)\cdot(W/L)\cdot C_{ox}$) is corrected simultaneously.

$$(V_{Ofs} - V_{th} + \Delta V) < (V_{th\text{-}EL} + V_{Cat}) \quad (2')$$

Figure 13E:
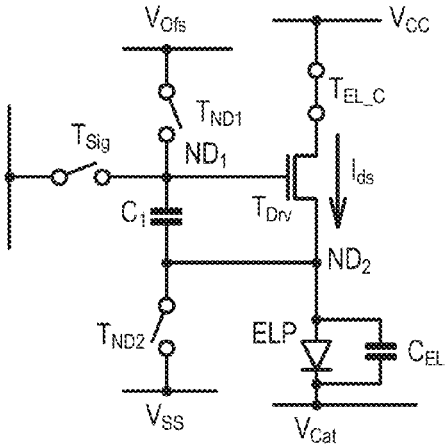

[Period-TP$(5)_7$] (see FIG. 13E)

With the above-described operation, the threshold voltage cancel process, the write process, and the mobility correction process are completed. On the other hand, if the scanning line SCL is at low level on the basis of the operation of the scanning circuit 101, as a result, the video signal write transistor $T_{Sig}$ is placed in the off state, and the first node $ND_1$, that is, the gate electrode of the drive transistor $T_{Drv}$ is placed in the floating state. The light-emission control transistor $T_{EL_C}$ is maintained in the on state, and the drain region of the light-emission control transistor $T_{EL_C}$ is connected to the current supply unit 100 (the voltage $V_{CC}$, for example, 20 volt) for controlling light emission of the light-emitting unit ELP. As a result, the potential of the second node $ND_2$ rises.

As described above, since the gate electrode of the drive transistor $T_{Drv}$ is in the floating state, and the capacitive unit $C_1$ is provided, the gate electrode of the drive transistor $T_{Drv}$ undergoes the same phenomenon as in a so-called bootstrap circuit, and the potential of the first node $ND_1$ also rises. As a result, the potential difference $V_{gs}$ between the gate electrode and the source region of the drive transistor $T_{Drv}$ is held at the value of Expression (4).

Since the potential of the second node $ND_2$ rises and exceeds ($V_{th\text{-}EL} + V_{Cat}$), the light-emitting unit ELP start to emit light. At this time, since a current which flows in the light-emitting unit ELP is the drain current $I_{ds}$ which flows from the drain region to the source region of the drive transistor $T_{Drv}$, this current can be expressed by Expression (1). From Expressions (1) and (4), Expression (1) may be modified to Expression (5).

$$I_{ds} = k\cdot\mu\cdot(V_{Sig} - V_{Ofs} - \Delta V)^2 \quad (5)$$

Accordingly, when $V_{Ofs}$ is set to 0 volt, the current $I_{ds}$ which flows in the light-emitting unit ELP is in proportion to the square of a value obtained by subtracting the potential correction value ΔV of the second node $ND_2$ (the source region of the drive transistor $T_{Drv}$) due to mobility μ of the drive transistor $T_{Drv}$ from the value of the driving signal (luminance signal) $V_{Sig}$ for controlling luminance of the light-emitting unit ELP. In other words, the current $I_{ds}$ which flows in the light-emitting unit ELP does not depend on the threshold voltage $V_{th\text{-}EL}$ of the light-emitting unit ELP and the threshold voltage $V_{th}$ of the drive transistor $T_{Drv}$. That is, the light-emission amount (luminance) of the light-emitting unit ELP is not affected by the threshold voltage $V_{th\text{-}EL}$ of the light-emitting unit ELP and the threshold voltage $V_{th}$ of the drive transistor $T_{Drv}$. Luminance of the (n,m)th light-emitting unit ELP has a value corresponding to the relevant current $I_{ds}$.

As the drive transistor $T_{Drv}$ has larger mobility μ, the potential correction value ΔV increases, such that the value of $V_{gs}$ on the left side of Expression (4) decreases. Accordingly, in Expression (5), even when the value of mobility μ is large, the value of $(V_{Sig} - V_{Ofs} - \Delta V)^2$ decreases, thereby correcting the drain current $I_{ds}$. That is, in the drive transistor $T_{Drv}$ having different mobility μ, if the value of the driving signal (luminance signal) $V_{Sig}$ is the same, and the drain current $I_{ds}$ is substantially the same. As a result, the current $I_{ds}$ which flows in the light-emitting unit ELP and controls luminance of the light-emitting unit ELP is uniformized. That is, variation in luminance of the light-emitting unit due to variation in mobility μ (also variation in k) can be corrected.

The light-emission state of the light-emitting unit ELP continues up to the (m+m'−1)th horizontal scanning period. This time corresponds to the end of [Period-TP$(5)_{-1}$].

With the above, the operation of light emission of the light-emitting unit ELP [the (n,m)th subpixel] is completed.

In the write process of [Period-TP$(5)_7$] (see FIG. 13E), the scanning signal which is sent from the scanning circuit 101 and reaches the gate electrode of the video signal write transistor $T_{Sig}$ constituting the light-emitting element 1 through the scanning line SCL is long and short depending on the position of the light-emitting element 1. Accordingly, in this state, the potential of the first node $ND_1$ rises toward $V_{Sig}$, but the potential of the first node $ND_1$ does not correspond to $V_{Sig}$. As a result, shading or irregularity occurs in the display of the display device. Incidentally, in the display device of Example, the first capacitive load unit and/or the second capacitive load unit is provided. For this reason, the difference in the pulse width of the scanning signal which reaches the gate electrode of the video signal write transistor $T_{Sig}$ between the light-emitting element in the central portion of the display device and the light-emitting element adjacent to the scanning circuit is reduced. As a result, the phenomenon in which the potential of the first node $ND_1$ does not correspond to $V_{Sig}$ can be suppressed, and the difference in luminance between the light-emitting element in the central portion of the display device and the light-emitting element adjacent to the scanning circuit can be reduced, thereby solving the problem, such as shading or irregularity in the display of the display device. The same applies to Examples 5 to 7 described below.

Example 5

Figure 14:
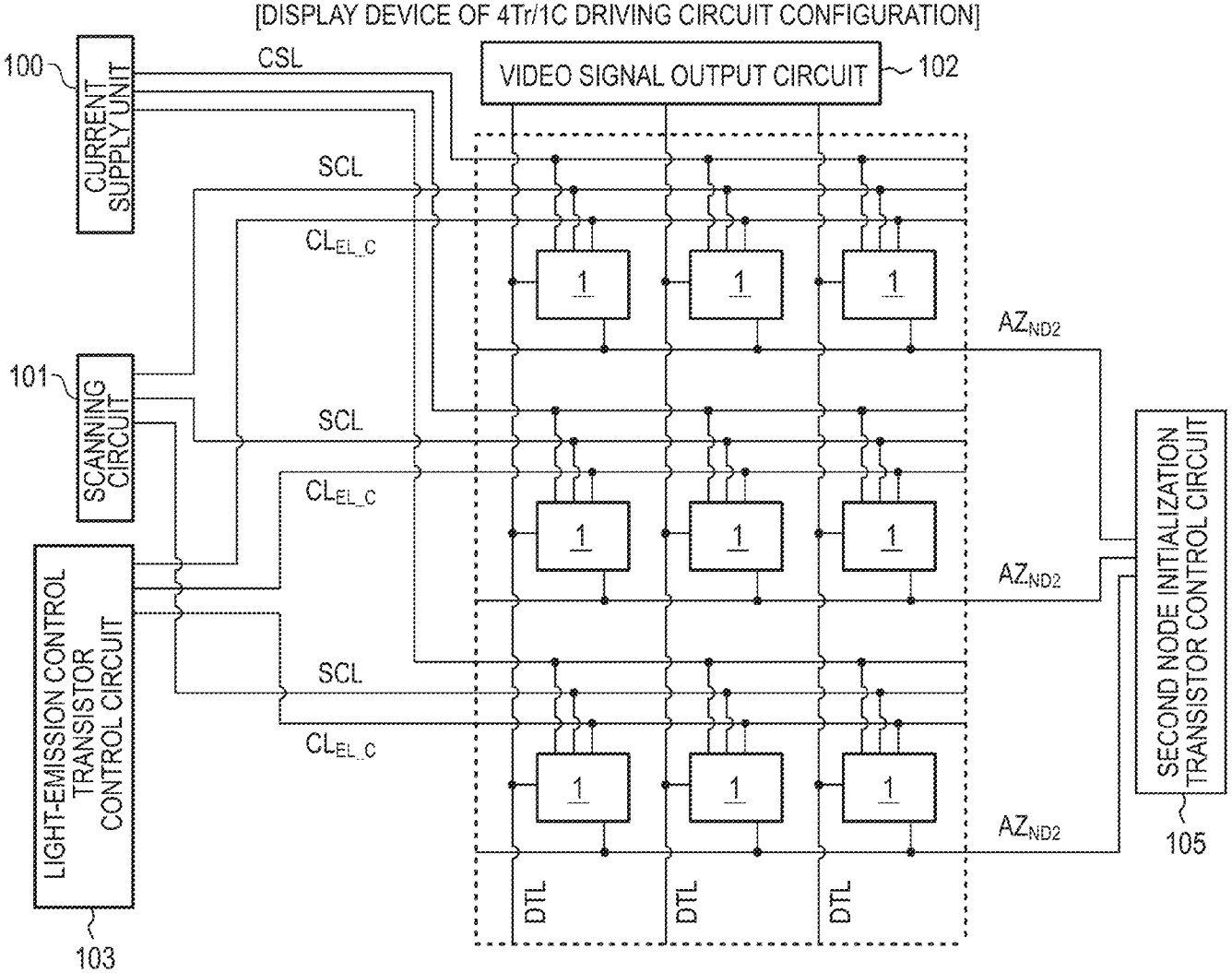
FIG. 14 is a conceptual diagram of a circuit which constitutes a display device of Example 5 or a display device of an electronic apparatus.
Figure 15:
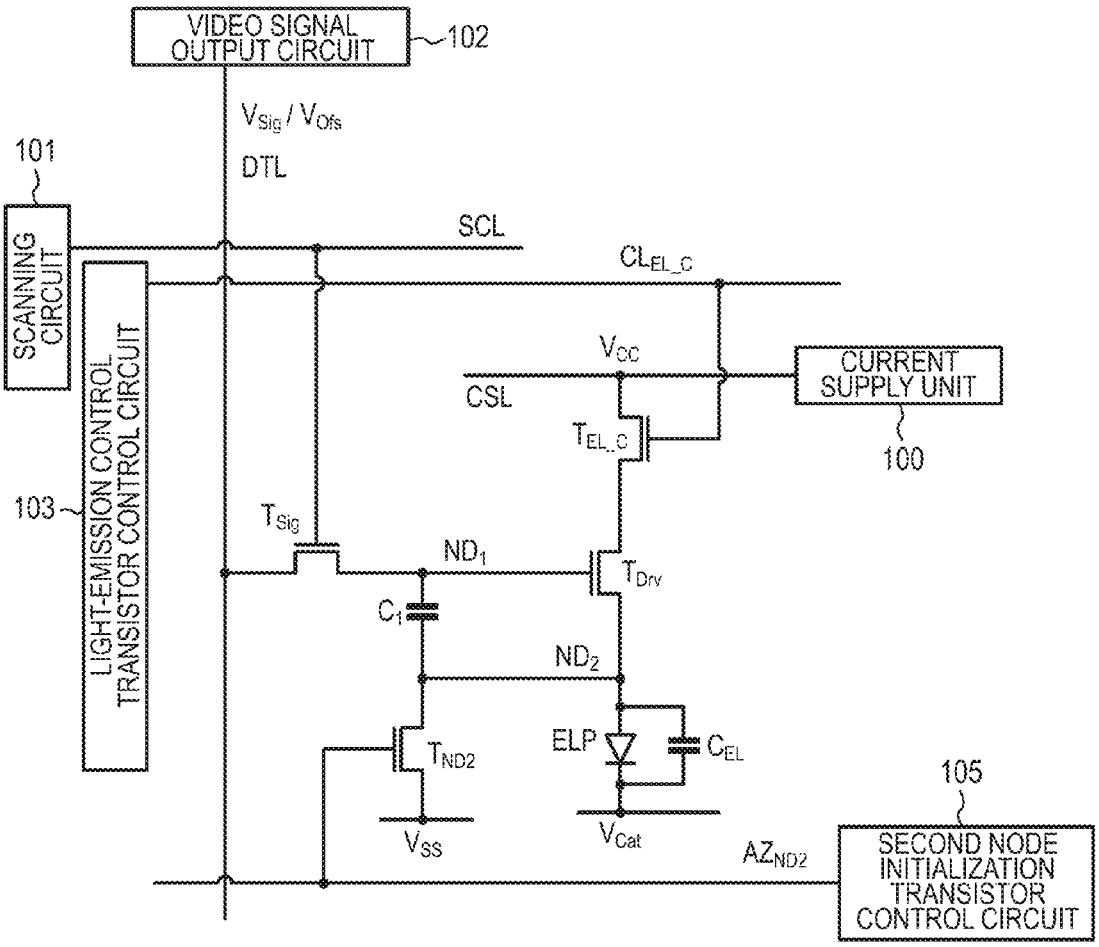
FIG. 15 is an equivalent circuit diagram of a 4Tr/1C driving circuit of Example 5.
Figure 16:
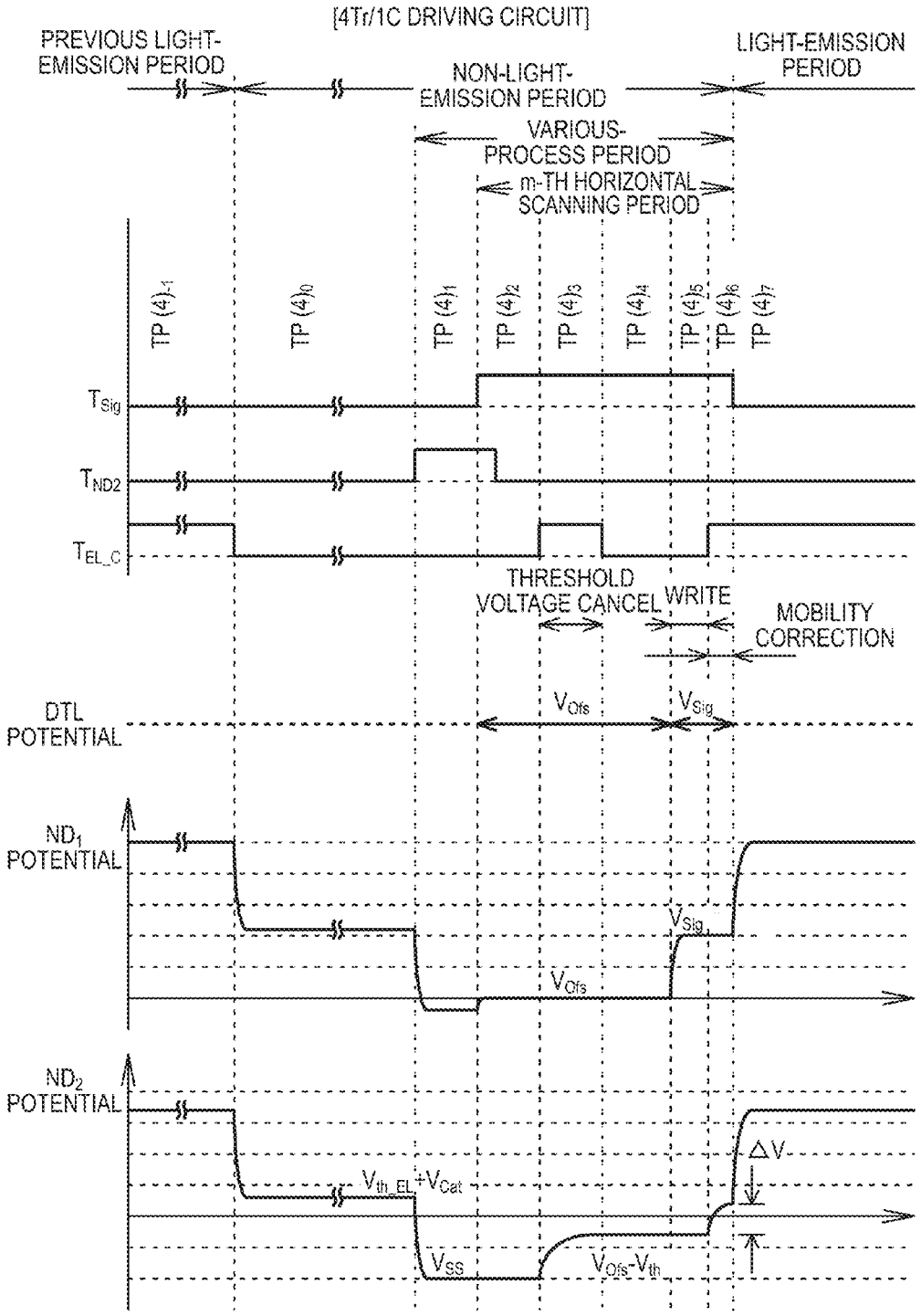
FIG. 16 is a diagram schematically showing a driving timing chart of a 4Tr/1C driving circuit of Example 5.

Example 5 relates to a 4Tr/1C driving circuit. FIG. 14 is a conceptual diagram of a driving circuit of Example 5. FIG. 15 is an equivalent circuit diagram of a 4Tr/1C driving circuit. FIG. 16 is a schematic driving timing chart. FIGS. 17A to 17D and 18A to 18D schematically show the on/off state and the like of each transistor.

In the 4Tr/1C driving circuit, the first node initialization transistor $T_{ND1}$ is removed from the above-described 5Tr/1C driving circuit. That is, the 4Tr/1C driving circuit has four transistors of a video signal write transistor $T_{Sig}$, a drive transistor $T_{Drv}$, a light-emission control transistor $T_{EL_C}$, and a second node initialization transistor $T_{ND2}$, and one capacitive unit $C_1$.

[Light-Emission Control Transistor $T_{EL_C}$]

The configuration of the light-emission control transistor $T_{EL_C}$ is the same as the light-emission control transistor $T_{EL_C}$ described in the 5Tr/1C driving circuit, and thus detailed description thereof will not be repeated.

[Drive Transistor $T_{Drv}$]

The configuration of the drive transistor $T_{Drv}$ is the same as the drive transistor $T_{Drv}$ described in the 5Tr/1C driving circuit, and thus detailed description thereof will not be repeated.

[Second Node Initialization Transistor $T_{ND2}$]

The configuration of the second node initialization transistor $T_{ND2}$ is the same as the second node initialization transistor $T_{ND2}$ described in the 5Tr/1C driving circuit, and thus detailed description thereof will not be repeated.

[Video Signal Write Transistor $T_{Sig}$]

The configuration of the video signal write transistor $T_{Sig}$ is the same as the video signal write transistor $T_{Sig}$ described in the 5Tr/1C driving circuit, and thus detailed description thereof will not be repeated. While one region of the source/drain regions of the video signal write transistor $T_{Sig}$ is connected to the data line DTL, not only the driving signal (luminance signal) $V_{Sig}$ for controlling luminance of the light-emitting unit ELP but also the voltage $V_{Ofs}$ for initializing the gate electrode of the drive transistor $T_{Drv}$ are supplied from the video signal output circuit 102. This point is different from the operation of the video signal write transistor $T_{Sig}$ described in the 5Tr/1C driving circuit. Signals/voltages (for example, a signal for precharge driving) other than $V_{Sig}$ or $V_{Ofs}$ may be supplied from the video signal output circuit 102 to one region of the source/drain regions through the data line DTL.

[Light-Emitting Unit ELP]

The configuration of the light-emitting unit ELP is the same as the light-emitting unit ELP described in the 5Tr/1C driving circuit, and thus detailed description thereof will not be repeated.

Hereinafter, the operation of the 4Tr/1C driving circuit will be described.

Figure 17A:
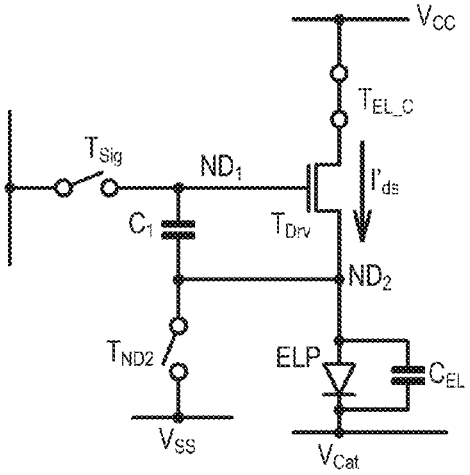
FIGS. 17A to 17D are diagrams schematically showing the on/off state and the like of each transistor which constitutes a 4Tr/1C driving circuit of Example 5.

[Period-TP$(4)_{-1}$] (see FIGS. 16 and 17A)

[Period-TP$(4)_{-2}$] is, for example, the operation in the previous display frame and is the same operation as [Period-TP$(5)_{-2}$] in the 5Tr/1C driving circuit.

[Period-TP$(4)_0$] to [Period-TP$(4)_4$] shown in FIG. 16 are the periods corresponding to [Period-TP$(5)_0$] to [Period-TP$(5)_4$] shown in FIG. 11, and are the operation periods immediately before the next write process is performed. Similarly to the 5Tr/1C driving circuit, in [Period-TP$(4)_0$] to [Period-TP$(4)_4$], the (n,m)th light-emitting unit ELP is in the non-light-emission state. The operation of the 4Tr/1C driving circuit is different from the operation of the 5Tr/1C driving circuit in that, in addition to [Period-TP$(4)_5$] to [Period-TP$(4)_6$] shown in FIG. 11, [Period-TP$(4)_2$] to [Period-TP$(4)_4$] are also included in the m-th horizontal scanning period. For convenience of description, description will be provided assuming that the beginning of [Period-IP $(4)_2$] and the end of [Period-TP$(4)_6$] respectively match the beginning and end of the m-th horizontal scanning period.

Hereinafter, each period of [Period-TP$(4)_0$] to [Period-TP$(4)_4$] will be described. As described in the 5Tr/1C driving circuit, the length of the beginning of [Period-TP$(4)_1$] or each period of [Period-TP$(4)_1$] to [Period-TP$(4)_4$] may be appropriately set in accordance with design for the display device.

[Period-TP$(4)_0$]

[Period-TP$(4)_0$] is, for example, the operation from the previous display frame to the current display frame, and is substantially the same operation as [Period-TP$(5)_0$] described in the 5Tr/1C driving circuit.

Figure 17B:
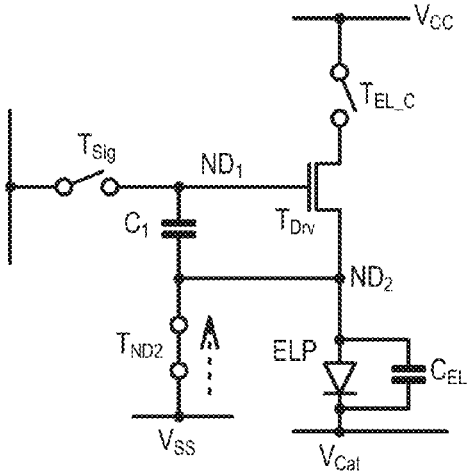

[Period-TP$(4)_1$] (see FIG. 17B)

[Period-TP$(4)_1$] corresponds to [Period-TP$(5)_1$] described in the 5Tr/1C driving circuit. In [Period-TP$(4)_1$], a preprocess for performing a threshold voltage cancel process described below is performed. At the time of the start of [Period-TP$(4)_2$], if the second node initialization transistor control line $AZ_{ND2}$ is at high level on the basis of the operation of the second node initialization transistor control circuit 105, the second node initialization transistor $T_{ND2}$ is placed in the on state. As a result, the potential of the second node $ND_2$ becomes $V_{SS}$ (for example, −10 volt). In order to follow the potential drop of the second node $ND_2$, the potential of the first node $ND_1$ (the gate electrode of the drive transistor $T_{Drv}$) in the floating state also drops. Since the potential of the first node $ND_1$ in [Period-TP$(4)_1$] depends on the potential (defined in accordance with the value of $V_{Sig}$ in the previous frame) of the first node $ND_1$ in the [Period-TP$(4)_{-1}$], the potential of the first node $ND_1$ does not have a constant value.

Figure 17C:
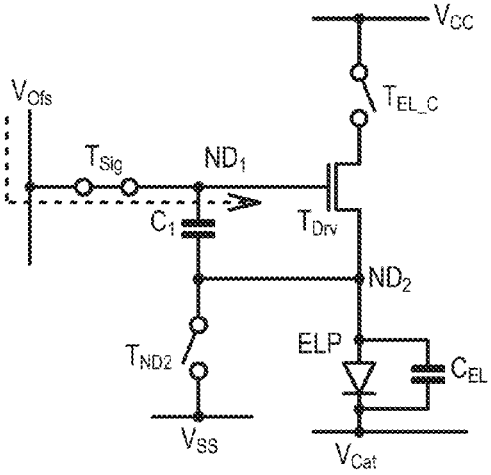

[Period-TP$(4)_2$] (see FIG. 17C)

Thereafter, if the potential of the data line DTL is set to $V_{Ofs}$ on the basis of the operation of the video signal output circuit 102, and the scanning line SCL is at high level on the basis of the operation of the scanning circuit 101, the video signal write transistor $T_{Sig}$ is placed in the on state. As a result, the potential of the first node $ND_1$ becomes $V_{Ofs}$ (for example, 0 volt). The potential of the second node $ND_2$ is held at $V_{SS}$ (for example, −10 volt). Thereafter, if the second node initialization transistor control line $AZ_{ND2}$ is at low level on the basis of the operation of the second node initialization transistor control circuit 105, the second node initialization transistor $T_{ND2}$ is placed in the off state.

Simultaneously with the start of [Period-TP$(4)_1$] or halfway of [Period-TP$(4)_2$], the video signal write transistor $T_{Sig}$ may be placed in the on state.

With the above-described process, the potential difference between the gate electrode and the source region of the drive transistor $T_{Drv}$ is equal to or greater than $V_{th}$, and the drive transistor $T_{Drv}$ is placed in the on state.

Figure 17D:
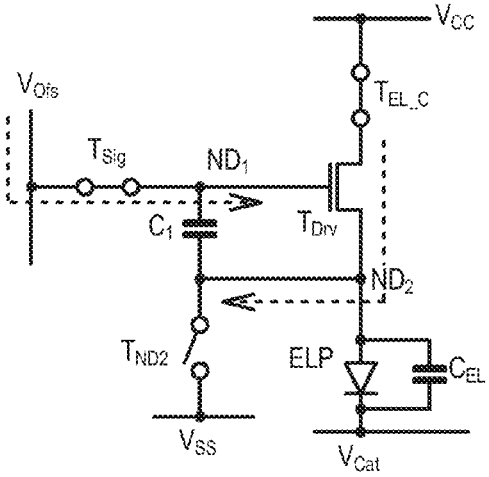

[Period-TP$(4)_3$] (see FIG. 17D)

Next, the threshold voltage cancel process is performed. That is, if the light-emission control transistor control line $CL_{EL_C}$ is at high level on the basis of the operation of the light-emission control transistor control circuit 103 while the video signal write transistor $T_{Sig}$ is maintained in the on state, the light-emission control transistor $T_{EL_C}$ is placed in the on state. As a result, while the potential of the first node $ND_1$ is not changed (maintained at $V_{Ofs}$=0 volt), the potential of the second node $ND_2$ in the floating state rises, and the potential difference between the first node $ND_1$ and the second node $ND_2$ is brought close to the threshold voltage $V_{th}$ of the drive transistor $T_{Drv}$. If the potential difference between the gate electrode and the source region of the drive transistor $T_{Drv}$ reaches $V_{th}$, the drive transistor $T_{Drv}$ is placed in the off state. Specifically, the potential of the second node $ND_2$ in the floating state is brought close to ($V_{Ofs}-V_{th}$=−3 volt) and finally becomes ($V_{Ofs}-V_{th}$). If Expression (2) is assured, in other words, if the potential is selected and determined so as to satisfy Expression (2), the light-emitting unit ELP does not emit light.

In [Period-TP$(4)_3$], the potential of the second node $ND_2$ finally becomes, for example, ($V_{Ofs}-V_{th}$). That is, the potential of the second node $ND_2$ is determined depending on only the threshold voltage $V_{th}$ of the drive transistor $T_{Drv}$ and the voltage $V_{Ofs}$ for initializing the gate electrode of the drive transistor $T_{Drv}$. The potential of the second node $ND_2$ does not depend on the threshold voltage $V_{th-EL}$ of the light-emitting unit ELP.

Figure 18A:
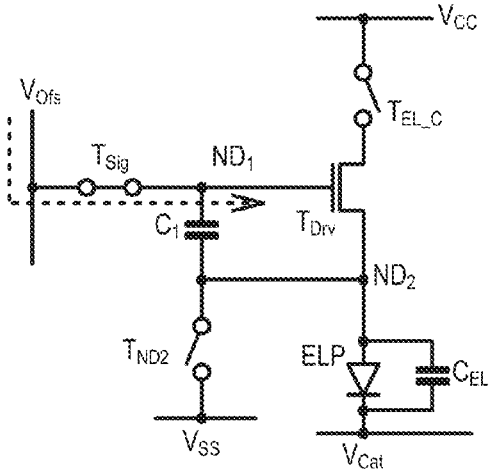
FIGS. 18A to 18D are diagrams, subsequent to FIG. 17D, schematically showing the on/off state and the like of each transistor which constitutes a 4Tr/1C driving circuit of Example 5.

[Period-TP$(4)_4$] (see FIG. 18A)

Thereafter, if the light-emission control transistor control line $CL_{EL_C}$ is at low level on the basis of the operation of the light-emission control transistor control circuit 103 while the video signal write transistor $T_{Sig}$ is maintained in the on state, the light-emission control transistor $T_{EL_C}$ is placed in the off state. As a result, the potential of the first node $ND_1$ is not changed (maintained at $V_{Ofs}$=0 volt), and the potential of the second node $ND_2$ in the floating state is not substantially changed (actually, a change in the potential occurs due to electrostatic coupling, such as parasitic capacitance, but this change is normally negligible) and held at ($V_{Ofs}-V_{th}$=−3 volt).

Next, each period of [Period-TP$(4)_5$] to [Period-TP$(4)_7$] will be described. These periods are substantially the same operations as [Period-TP$(5)_5$] to [Period-TP$(5)_7$] described in the 5Tr/1C driving circuit.

Figure 18B:
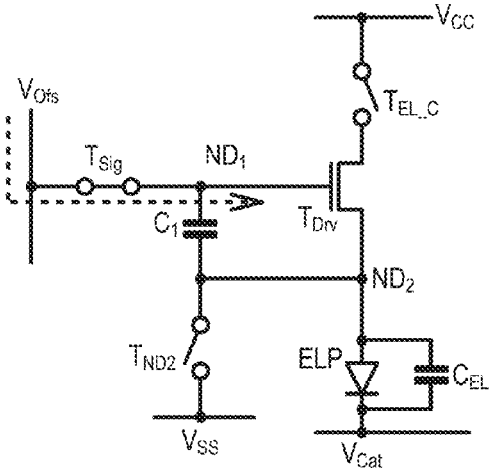

[Period-TP$(4)_5$] (see FIG. 18B)

Next, the write process to the drive transistor $T_{Drv}$ is performed. Specifically, the video signal write transistor $T_{Sig}$ is placed in the off state once, and while the video signal write transistor $T_{Sig}$, the second node initialization transistor $T_{ND2}$, and the light-emission control transistor $T_{EL_C}$ are maintained in the off state, the potential of the data line DTL is changed to the driving signal (luminance signal) $V_{Sig}$ for controlling luminance of the light-emitting unit ELP on the basis of the operation of the video signal output circuit 102. Thereafter, if the scanning line SCL is at high level (that is, by the slowed scanning signal) while the second node initialization transistor $T_{ND2}$ and the light-emission control transistor $T_{EL_C}$ are maintained in the off state, the video signal write transistor $T_{Sig}$ is placed in the on state.

Accordingly, as described in the 5Tr/1C driving circuit, the value described in Expression (3) can be obtained as the potential difference between the first node $ND_1$ and the second node $ND_2$, that is, the potential difference $V_{gs}$ between the gate electrode and the source region of the drive transistor $T_{Drv}$.

That is, in the 4Tr/1C driving circuit, $V_{gs}$ which is obtained in the write process to the drive transistor $T_{Drv}$ depends on only the driving signal (luminance signal) $V_{Sig}$ for controlling luminance of the light-emitting unit ELP, the threshold voltage $V_{th}$ of the drive transistor $T_{Drv}$, and the voltage $V_{Ofs}$ for initializing the gate electrode of the drive transistor $T_{Drv}$. $V_{gs}$ does not depend on the threshold voltage $V_{th-EL}$ of the light-emitting unit ELP.

Figure 18C:
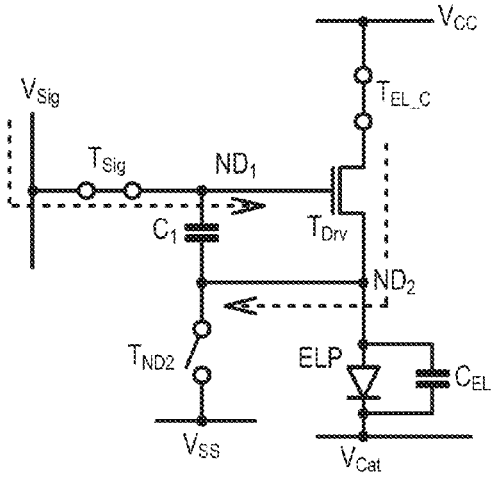

[Period-TP$(4)_6$] (see FIG. 18C)

Thereafter, the potential of the source region of the drive transistor $T_{Drv}$ (the second node $ND_2$) is corrected on the basis of the magnitude of mobility μ of the drive transistor $T_{Drv}$ is corrected (mobility correction process). Specifically, the same operation as [Period-TP$(5)_6$] described in the 5Tr/1C driving circuit may be performed. A predetermined time (the full time $t_0$ of [Period-TP$(4)_6$]) for performing the mobility correction process may be determined in advance as a design value at the time of design of the display device.

Figure 18D:
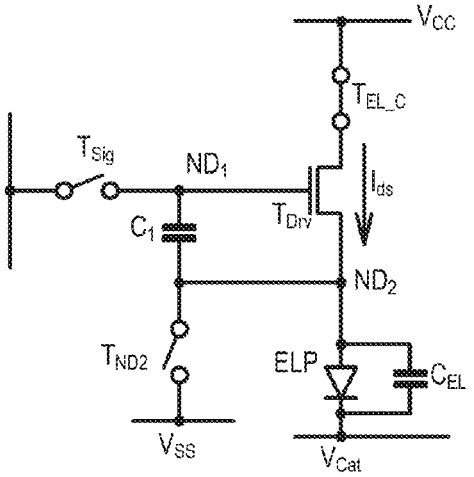

[Period-TP$(4)_7$] (see FIG. 18D)

With the above-described operation, the threshold voltage cancel process, the write process, and the mobility correction process are completed. Since the same process as [Period-TP$(5)_7$] described in the 5Tr/1C driving circuit is performed, and the potential of the second node $ND_2$ rises and exceeds ($V_{th-EL}+V_{Cat}$), the light-emitting unit ELP starts to emit light. At this time, since a current which flows in the light-emitting unit ELP can be obtained by Expression (5), the $I_{ds}$ which flows in the light-emitting unit ELP does not depend on the threshold voltage $V_{th-EL}$ of the light-emitting unit ELP and the threshold voltage $V_{th}$ of the drive transistor $T_{Drv}$. That is, the light-emission amount (luminance) of the light-emitting unit ELP is not affected by the threshold voltage $V_{th-EL}$ of the light-emitting unit ELP and the threshold voltage $V_{th}$ of the drive transistor $T_{Drv}$. It is also possible to suppress the occurrence of variation in the drain current $I_{ds}$ due to variation in mobility μ of the drive transistor $T_{Drv}$.

The light-emission state of the light-emitting unit ELP continues up to the (m+m'−1)th horizontal scanning period. This time corresponds to the end of [Period-TP$(4)_{-1}$].

With the above, the operation of light emission of the light-emitting unit ELP [the (n,m)th subpixel] is completed.

Example 6

Figure 19:
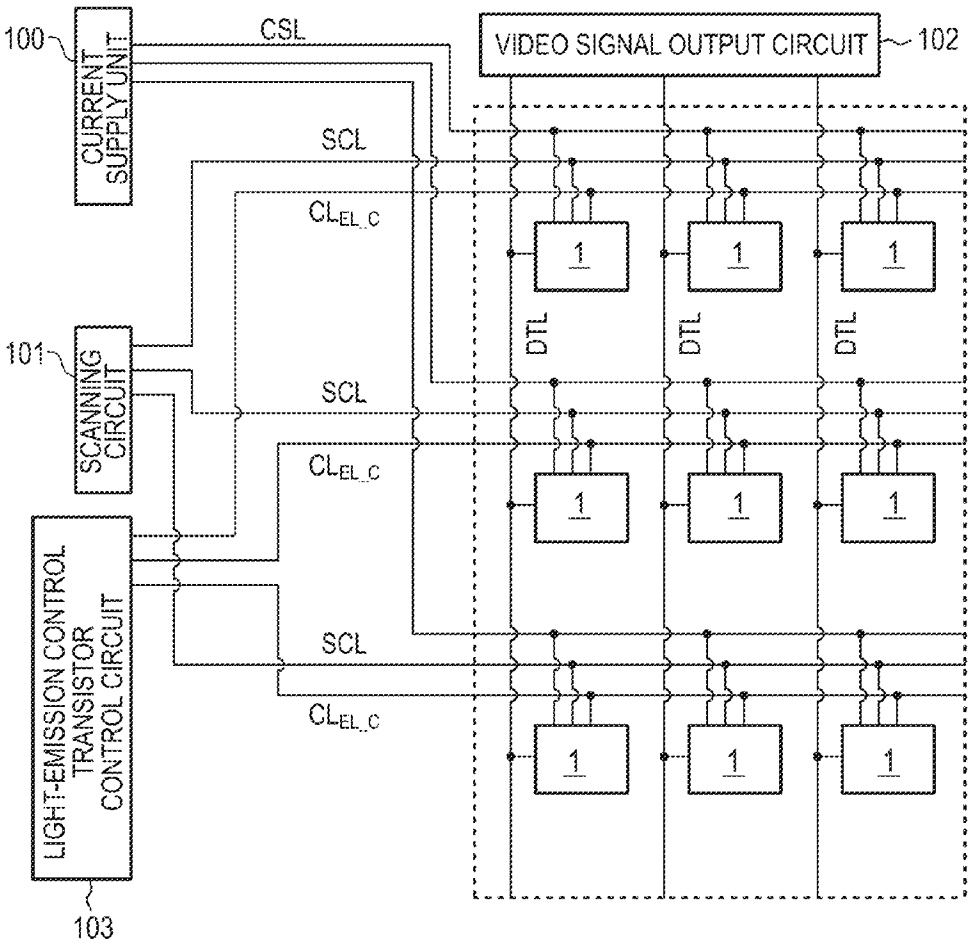
FIG. 19 is a conceptual diagram of a circuit which constitutes a display device of Example 6 or a display device of an electronic apparatus.
Figure 20:
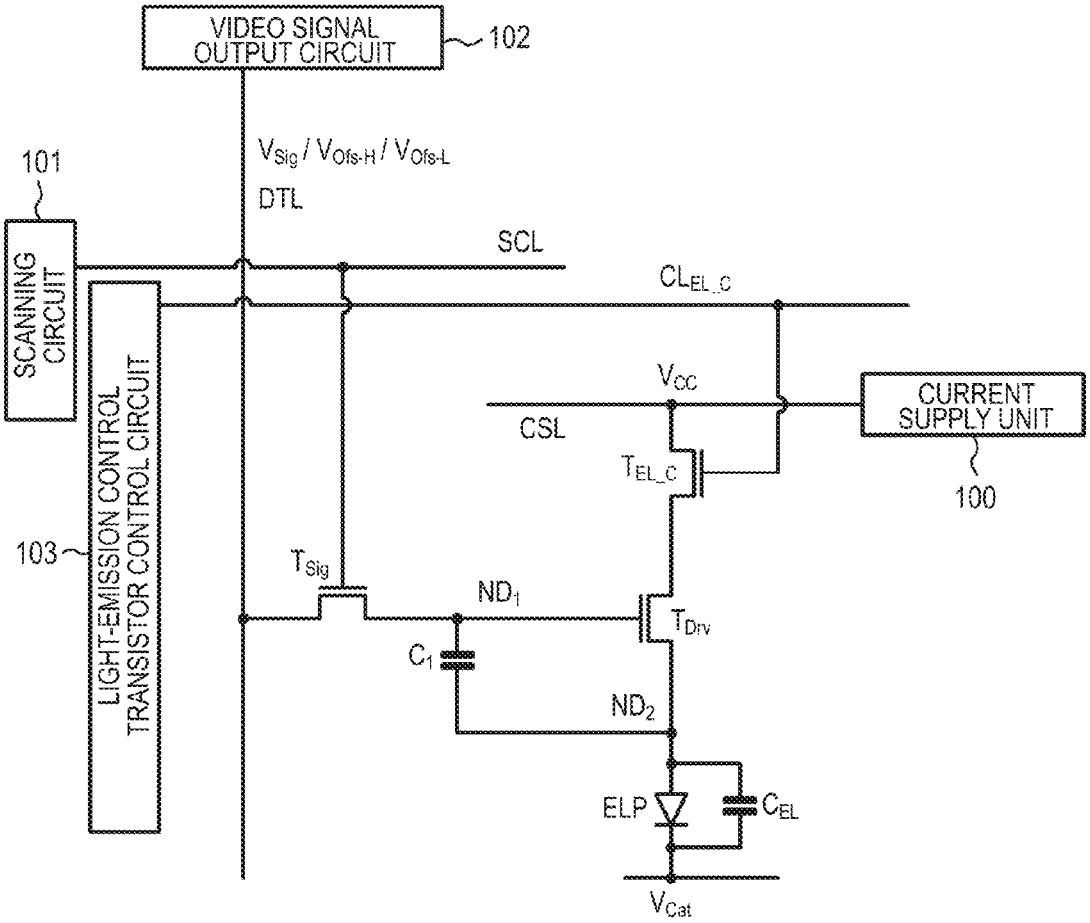
FIG. 20 is an equivalent circuit diagram of a 3Tr/1C driving circuit of Example 6.
Figure 21:
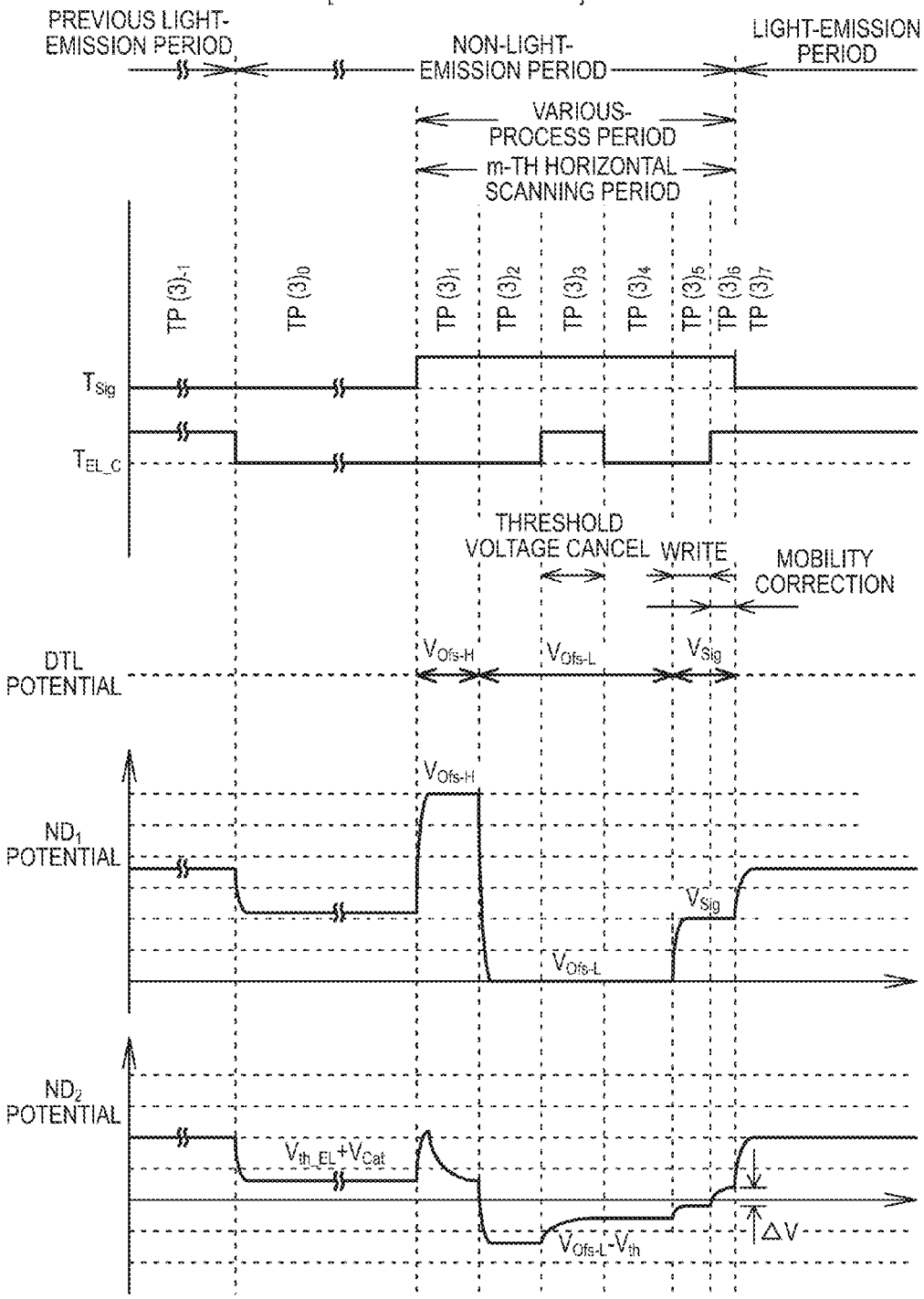
FIG. 21 is a diagram schematically showing a driving timing chart of a 3Tr/1C driving circuit of Example 6.

Example 6 relates to a 3Tr/1C driving circuit. FIG. 19 is a conceptual diagram of a driving circuit of Example 6. FIG. 20 is an equivalent circuit diagram of a 3Tr/1C driving circuit. FIG. 21 is a schematic driving timing chart. FIGS. 22A to 22D and 23A to 23E schematically show the on/off state and the like of each transistor.

In the 3Tr/1C driving circuit, two transistors of the first node initialization transistor $T_{ND1}$ and the second node initialization transistor $T_{ND2}$ are removed from the above-described 5Tr/1C driving circuit. That is, the 3Tr/1C driving circuit has three transistors of a video signal write transistor $T_{Sig}$, a light-emission control transistor $T_{EL_C}$, and a drive transistor $T_{Drv}$, and one capacitive unit $C_1$.

[Light-emission control transistor $T_{EL_C}$]

The configuration of the light-emission control transistor $T_{EL_C}$ is the same as the light-emission control transistor $T_{EL_C}$ described in the 5Tr/1C driving circuit, and thus detailed description thereof will not be repeated.

[Drive transistor $T_{Drv}$]

The configuration of the drive transistor $T_{Drv}$ is the same as the drive transistor $T_{Drv}$ described in the 5Tr/1C driving circuit, and thus detailed description thereof will not be repeated.

[Video Signal Write Transistor $T_{Sig}$]

The configuration of the video signal write transistor $T_{Sig}$ is the same as the video signal write transistor $T_{Sig}$ described in the 5Tr/1C driving circuit, and thus detailed description thereof will not be repeated. While one region of the source/drain regions of the video signal write transistor $T_{Sig}$ is connected to the data line DTL, not only the driving signal (luminance signal) $V_{Sig}$ for controlling luminance of the light-emitting unit ELP but also a voltage $V_{Ofs-H}$ for initializing the gate electrode of the drive transistor $T_{Drv}$ and a voltage $V_{Ofs-L}$ are supplied from the video signal output circuit 102. This point is different from the operation of the video signal write transistor $T_{Sig}$ described in the 5Tr/1C driving circuit. Signals/voltages (for example, a signal for precharge driving) other than $V_{Sig}$ or $V_{Ofs-H}/V_{Ofs-L}$ may be supplied from the video signal output circuit 102 to one region of the source/drain regions through the data line DTL. The values of the voltage $V_{Ofs-H}$ and the voltage $V_{Ofs-L}$ are, not limited to, as follows, for example.

$V_{Ofs-H}$=about 30 volt $V_{Ofs-L}$=about 0 volt

[Relationship between values $C_{EL}$ and $C_1$]

As described below, in the 3Tr/1C driving circuit, it is necessary to change the potential of the second node $ND_2$ using the data line DTL. In the 5Tr/1C driving circuit or the 4Tr/1C driving circuit described above, description has been provided assuming that the value $c_{EL}$ is sufficiently greater than the value $c_1$ and the value $c_{gs}$ without taking into consideration a change in the potential of the source region of the drive transistor $T_{Drv}$ (the second node $ND_2$) based on the change ($V_{Sig}-V_{Ofs}$) in the potential of the gate electrode of the drive transistor $T_{Drv}$ (the same applies to a 2Tr/1C driving circuit described below). In the 3Tr/1C driving circuit, for design, the value $c_1$ is set to be greater than other driving circuits (for example, the value $c_1$ is about ¼ to ⅓ of the value $c_{EL}$). Accordingly, a change in the potential of the second node $ND_2$ due to a change in the potential of the first node $ND_1$ is large compared to other driving circuits. For this reason, in case of 3Tr/1C, description will be provided taking into consideration a change in the potential of the second node $ND_2$ due to a change in the potential of the first node $ND_1$. A driving timing chart of FIG. 21 is shown taking into consideration a change in the potential of the second node $ND_2$ due to a change in the potential of the first node $ND_1$.

[Light-Emitting Unit ELP]

The configuration of the light-emitting unit ELP is the same as the light-emitting unit ELP described in the 5Tr/1C driving circuit, and thus detailed description thereof will not be repeated.

Hereinafter, the operation of the 3Tr/1C driving circuit will be described.

Figure 22A:
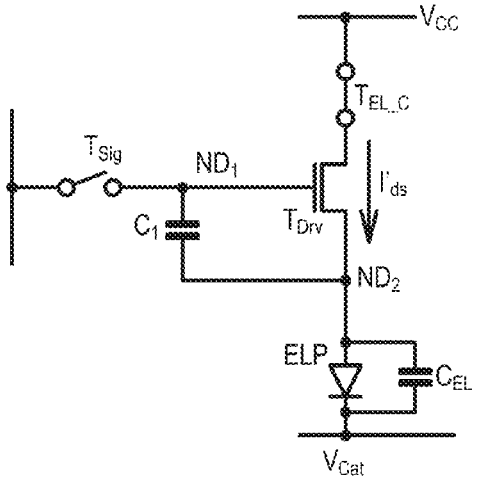
FIGS. 22A to 22D are diagrams schematically showing the on/off state and the like of each transistor which constitutes a 3Tr/1C driving circuit of Example 6.

[Period-TP$(3)_{-1}$] (see FIGS. 21 and 22A)

[Period-TP$(3)_{-1}$] is, for example, the operation in the previous display frame, and is substantially the same operation as [Period-TP$(5)_{-1}$] described in the 5Tr/1C driving circuit.

[Period-TP$(3)_0$] to [Period-TP$(3)_4$] shown in FIG. 21 are the period corresponding to [Period-TP$(5)_0$] to [Period-TP$(5)_4$] shown in FIG. 11, and are the operation periods immediately before the next write process is performed. Similarly to the 5Tr/1C driving circuit, in [Period-TP$(3)_0$] to [Period-TP$(3)_4$], the (n,m)th light-emitting unit ELP is in the non-light-emission state. As shown in FIG. 21, the operation of the 3Tr/1C driving circuit is different from the operation of the 5Tr/1C driving circuit in that, in addition to [Period-TP$(3)_5$] to [Period-TP$(3)_6$], [Period-TP$(3)_1$] to [Period-TP$(3)_4$] are also included in the m-th horizontal scanning period. For convenience of description, description will be provided assuming that the beginning of [Period-TP$(3)_1$] and the end of [Period-TP$(3)_6$] respectively match the beginning and end of the m-th horizontal scanning period.

Hereinafter, each period of [Period-TP$(3)_0$] to [Period-TP$(3)_4$] will be described. As described in the 5Tr/1C driving circuit, the length of each period of [Period-TP$(3)_1$] to [Period-TP$(3)_4$] may be appropriately set in accordance with design for the display device.

Figure 22B:
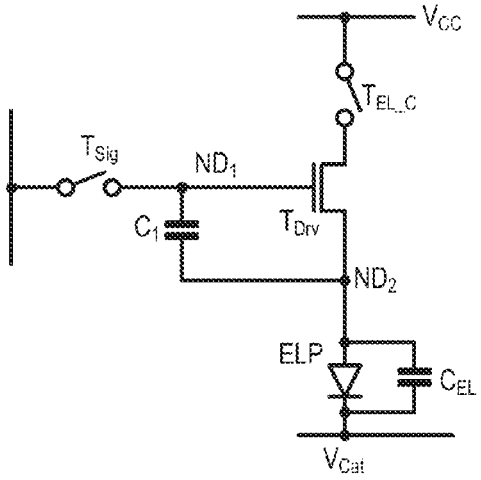

[Period-TP$(3)_0$] (see FIG. 22B)

[Period-TP$(3)_0$] is, for example, the operation from the previous display frame to the current display frame, and is substantially the same operation as [Period-TP$(5)_0$] described in the 5Tr/1C driving circuit.

Figure 22C:
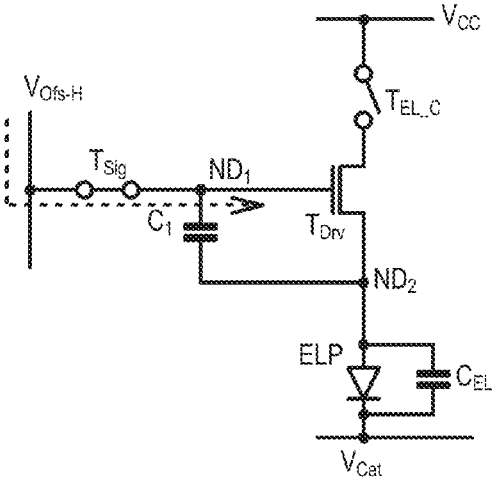

[Period-TP$(3)_1$] (see FIG. 22C)

The horizontal scanning period of the m-th row in the current display frame starts. At the time of the start of [Period-TP$(3)_1$], if the potential of the data line DTL is set to the voltage $V_{Ofs-H}$ for initializing the gate electrode of the drive transistor $T_{Drv}$ on the basis of the operation of the video signal output circuit 102, and then if the scanning line SCL is at high level on the basis of the operation of the scanning circuit 101, the video signal write transistor $T_{Sig}$ is placed in the on state. As a result, the potential of the first node $ND_1$ becomes $V_{Ofs-H}$. As described above, for design, since the value $c_1$ of the capacitive unit $C_1$ is greater than other driving circuits, the potential of the source region (the potential of the second node $ND_2$) rises. Since the potential difference between both ends of the light-emitting unit ELP exceeds the threshold voltage $V_{th-EL}$, the light-emitting unit ELP is placed in a conduction state, but the potential of the source region of the drive transistor $T_{Drv}$ drops directly to ($V_{th-EL}+V_{Cat}$) again. During this, although the light-emitting unit ELP can emit light, light emission is instantaneous, and there is no problem for practical use. The gate electrode of the drive transistor $T_{Drv}$ is held at the voltage $V_{Ofs-H}$.

Figure 22D:
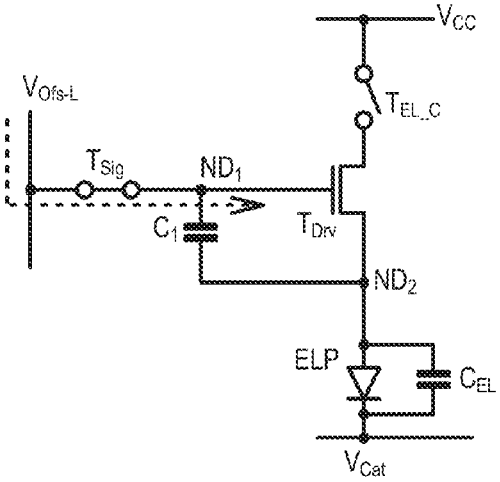

[Period-TP$(3)_2$] (see FIG. 22D)

Thereafter, if the potential of the data line DTL is changed from the voltage $V_{Ofs-H}$ for initializing the gate electrode of the drive transistor $T_{Drv}$ to the voltage $V_{Ofs-L}$ on the basis of the operation of the video signal output circuit 102, the potential of the first node $ND_1$ becomes $V_{Ofs-L}$. With the potential drop of the first node $ND_1$, the potential of the second node $ND_2$ also drops. That is, electric charges based on the change ($V_{Ofs-L}-V_{Ofs-H}$) in the potential of the gate electrode of the drive transistor $T_{Drv}$ are divided into the capacitive unit $C_1$, the parasitic capacitance $C_{EL}$ of the light-emitting unit ELP, and parasitic capacitance between the gate electrode and the source region of the drive transistor $T_{Drv}$. As the assumption of the operation in [Period-TP$(3)_3$] described below, at the time of the end of [Period-TP$(3)_2$], it is necessary that the potential of the second node $ND_2$ is lower than $V_{Ofs-L}-V_{th}$. The values of $V_{Ofs-H}$ and like are set so as to satisfy the conditions. That is, with the above-described process, the potential difference between the gate electrode and the source region of the drive transistor $T_{Drv}$ is equal to or greater than $V_{th}$, and the drive transistor $T_{Drv}$ is placed in the on state.

Figure 23A:
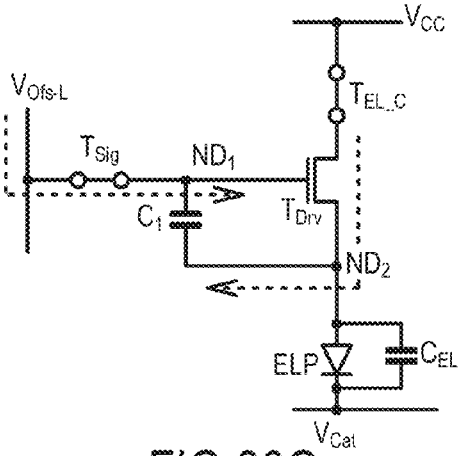
FIGS. 23A to 23E are diagrams, subsequent to FIG. 22D, schematically showing the on/off state and the like of each transistor which constitutes a 3Tr/1C driving circuit of Example 6.

[Period-TP$(3)_3$] (see FIG. 23A)

Next, the threshold voltage cancel process is performed. That is, if the light-emission control transistor control line $CL_{EL_C}$ is at high level on the basis of the operation of the light-emission control transistor control circuit 103 while the video signal write transistor $T_{Sig}$ is maintained in the on state, the light-emission control transistor $T_{EL_C}$ is placed in the on state. As a result, while the potential of the first node $ND_1$ is not changed (maintained at $V_{Ofs\text{-}L}$=0 volt), the potential of the second node $ND_2$ in the floating state rises, and the potential difference between the first node $ND_1$ and the second node $ND_2$ is brought close to the threshold voltage $V_{th}$ of the drive transistor $T_{Drv}$. If the potential difference between the gate electrode and the source region of the drive transistor $T_{Drv}$ reaches $V_{th}$, the drive transistor $T_{Drv}$ is placed in the off state. Specifically, the potential of the second node $ND_2$ in the floating state is brought close to ($V_{Ofs\text{-}L}-V_{th}$=−3 volt) and finally becomes ($V_{Ofs\text{-}L}-V_{th}$). If Expression (2) is assured, in other words, if the potential is selected and determined so as to satisfy Expression (2), the light-emitting unit ELP does not emit light.

In [Period-TP$(3)_3$], the potential of the second node $ND_2$ becomes, for example, ($V_{Ofs\text{-}L}-V_{th}$). That is, the potential of the second node $ND_2$ is determined depending on only the threshold voltage $V_{th}$ of the drive transistor $T_{Drv}$ and the voltage $V_{Ofs\text{-}L}$ for initializing the gate electrode of the drive transistor $T_{Drv}$. The potential of the second node $ND_2$ does not depend on the threshold voltage $V_{th\text{-}EL}$ of the light-emitting unit ELP.

Figure 23B:
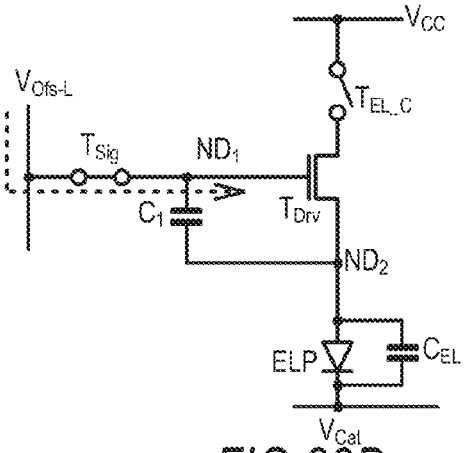

[Period-TP$(3)_4$] (see FIG. 23B)

Thereafter, if the light-emission control transistor control line $CL_{EL_C}$ is at low level on the basis of the operation of the light-emission control transistor control circuit 103 while the video signal write transistor $T_{Sig}$ is maintained in the on state, the light-emission control transistor $T_{EL_C}$ is placed in the off state. As a result, the potential of the first node $ND_1$ is not changed (maintained at $V_{Ofs\text{-}L}$=0 volt), and the potential of the second node $ND_2$ in the floating state is not changed and held at ($V_{Ofs\text{-}L}-V_{th}$=−3 volt).

Next, each period of [Period-TP$(3)_5$] to [Period-TP$(3)_7$] will be described. These periods are substantially the same operations as [Period-TP$(5)_5$] to [Period-TP$(5)_7$] described in the 5Tr/1C driving circuit.

Figure 23C:
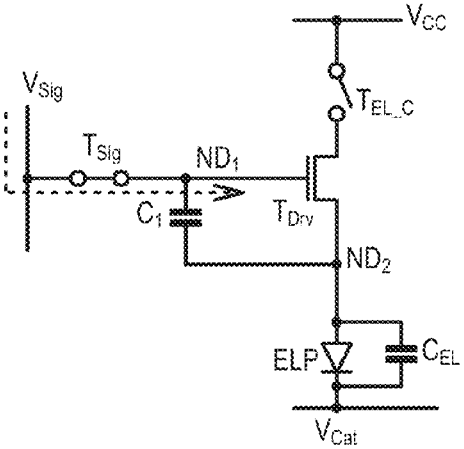

[Period-TP$(3)_5$] (see FIG. 23C)

Next, the write process to the drive transistor $T_{Drv}$ is performed. Specifically, the video signal write transistor $T_{Sig}$ is placed in the off state once, and while the video signal write transistor $T_{Sig}$ and the light-emission control transistor $T_{EL_C}$ are maintained in the off state, the potential of the data line DTL is changed to the driving signal (luminance signal) $V_{Sig}$ for controlling luminance of the light-emitting unit ELP. Thereafter, if the scanning line SCL is at high level (that is, by the slowed scanning signal) while the light-emission control transistor $T_{EL_C}$ is maintained in the off state, the video signal write transistor $T_{Sig}$ is placed in the on state.

In [Period-TP$(3)_5$], the potential of the first node $ND_1$ rises from $V_{Ofs\text{-}L}$ to $V_{Sig}$. For this reason, if a change in the potential of the second node $ND_2$ due to a change in the potential of the first node $ND_1$ is taken into consideration, the potential of the second node $ND_1$ slightly rises. That is, the potential of the second node $ND_1$ can be expressed by $V_{Ofs\text{-}L}-V_{th}+\alpha\cdot(V_{Sig}-V_{Ofs\text{-}L})$. The relationship $0\leq\alpha\leq1$ is established, and the value of $\alpha$ is defined by the capacitive unit $C_1$, the parasitic capacitance $C_{EL}$ of the light-emitting unit ELP, and the like.

Accordingly, as described in the 5Tr/1C driving circuit, a value described in Expression (3') can be obtained as the potential difference between the first node $ND_1$ and the second node $ND_2$, that is, the potential difference $V_{gs}$ between the gate electrode and the source region of the drive transistor $T_{Drv}$.

$$V_{gs}\cong V_{Sig}-(V_{Ofs\text{-}L}-V_{th})-\alpha\cdot(V_{Sig}-V_{Ofs\text{-}L}) \quad (3')$$

That is, in the 3Tr/1C driving circuit, $V_{gs}$ which is obtained in the write process to the drive transistor $T_{Drv}$ depends on only the driving signal (luminance signal) $V_{Sig}$ for controlling luminance of the light-emitting unit ELP, the threshold voltage $V_{th}$ of the drive transistor $T_{Drv}$, and the voltage $V_{Ofs\text{-}L}$ for initializing the gate electrode of the drive transistor $T_{Drv}$. $V_{gs}$ does not depend on the threshold voltage $V_{th\text{-}EL}$ of the light-emitting unit ELP.

Figure 23D:
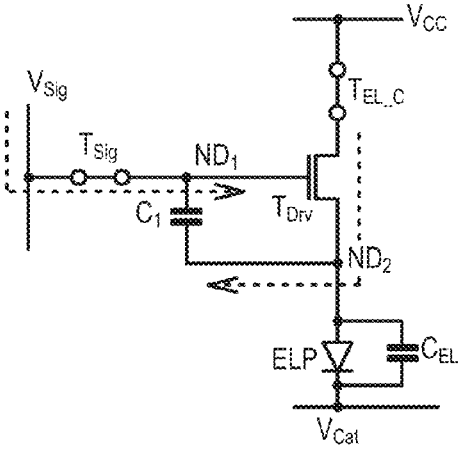

[Period-TP$(3)_6$] (see FIG. 23D)

Thereafter, the potential of the source region of the drive transistor $T_{Drv}$ (second node $ND_2$) is corrected on the basis of the magnitude of mobility $\mu$ of the drive transistor $T_{Drv}$ (mobility correction process). Specifically, the same operation as [Period-TP$(5)_6$] described in the 5Tr/1C driving circuit may be performed. A predetermined time (the full time $t_0$ of [Period-TP$(3)_6$]) for performing the mobility correction process may be determined in advance as a design value at the time of design for the display device.

Figure 23E:
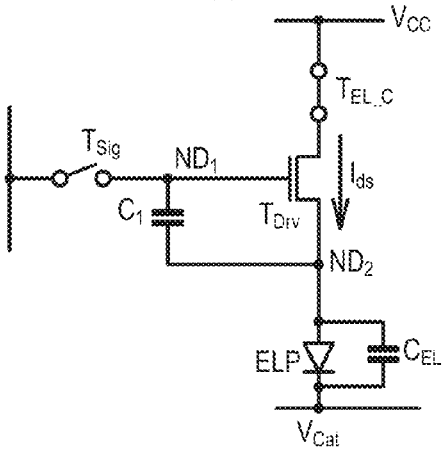

[Period-TP$(3)_7$] (see FIG. 23E)

With the above-described operation, the threshold voltage cancel process, the write process, and the mobility correction process are completed. Since the same process as [Period-TP$(5)_7$] described in the 5Tr/1C driving circuit is performed, and the potential of the second node $ND_2$ rises and exceeds ($V_{th\text{-}EL}+V_{Cat}$), the light-emitting unit ELP starts to emit light. At this time, since a current which flows in the light-emitting unit ELP can be obtained by Expression (5), the current $I_{ds}$ which flows in the light-emitting unit ELP does not depend on the threshold voltage $V_{th\text{-}EL}$ of the light-emitting unit ELP and the threshold voltage $V_{th}$ of the drive transistor $T_{Drv}$. That is, the light-emission amount (luminance) of the light-emitting unit ELP is not affected by the threshold voltage $V_{th\text{-}EL}$ of the light-emitting unit ELP and the threshold voltage $V_{th}$ of the drive transistor $T_{Drv}$. It is also possible to suppress the occurrence of variation in the drain current $I_{ds}$ due to variation in mobility $\mu$ of the drive transistor $T_{Drv}$.

The light-emission state of the light-emitting unit ELP continues up to the (m+m'−1)th horizontal scanning period. This time corresponds to the end of [Period-TP$(3)_{-1}$].

With the above, the operation of light emission of the light-emitting unit ELP [the (n,m)th subpixel] is completed.

Example 7

Figure 24:
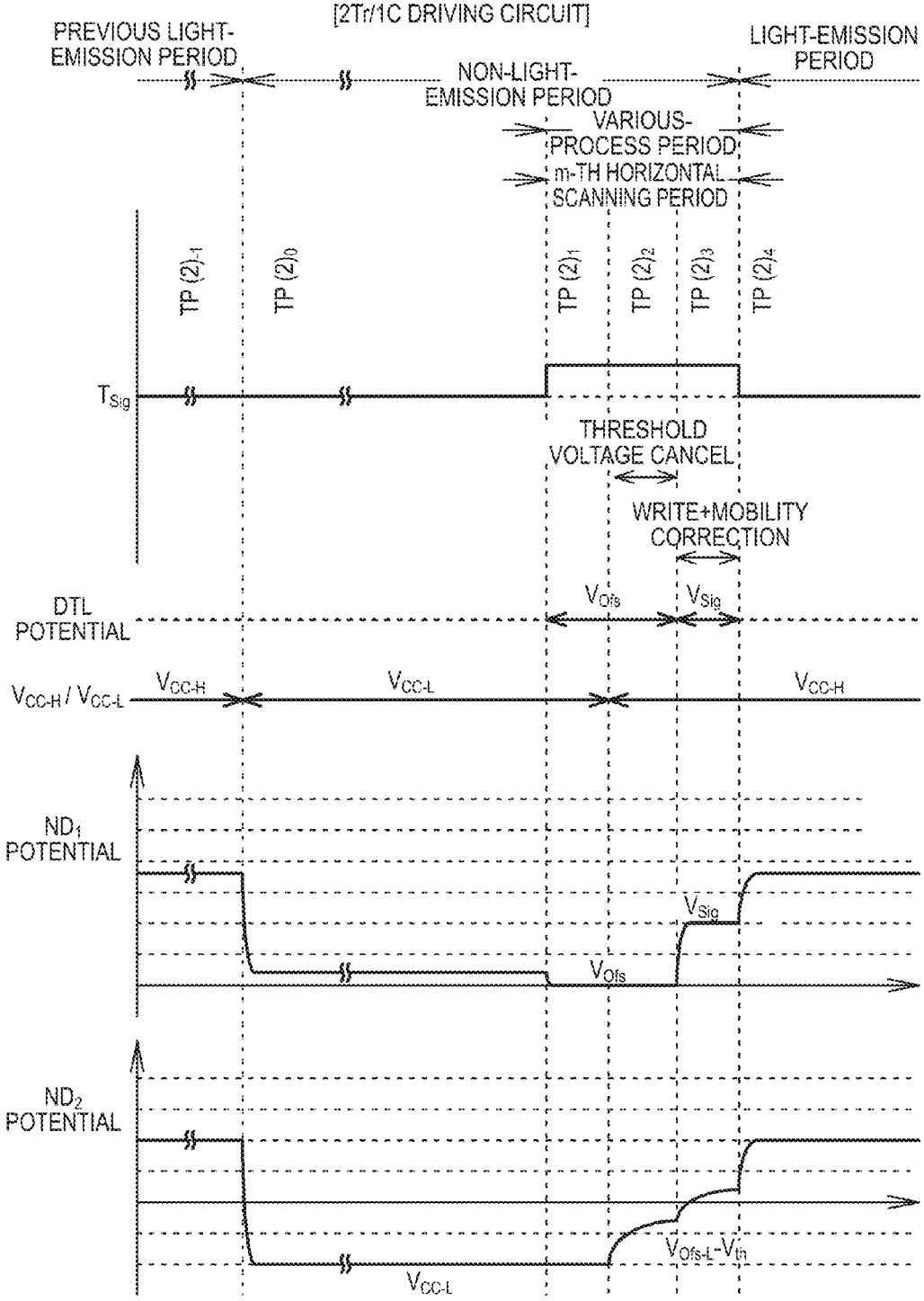
FIG. 24 is a diagram schematically showing a driving timing chart of a 2Tr/1C driving circuit of Examples 1 and 7.

Example 7 relates to a 2Tr/1C driving circuit. FIG. 1 is a conceptual diagram of a circuit which constitutes a display device of Example 7. FIG. 2 shows an equivalent circuit diagram of a 2Tr/1C driving circuit. FIG. 24 is a schematic driving timing chart. FIGS. 25A to 25F schematically show the on/off state and the like of each transistor.

In the 2Tr/1C driving circuit, three transistors of the first node initialization transistor $T_{ND1}$, the light-emission control transistor $T_{EL_C}$, and the second node initialization transistor $T_{ND2}$ are removed from the above-described 5Tr/1C driving circuit. That is, the 2Tr/1C driving circuit has two transistors of a video signal write transistor $T_{Sig}$ and a drive transistor $T_{Drv}$, and one capacitive unit $C_1$.

[Drive Transistor $T_{Drv}$]

The configuration of the drive transistor $T_{Drv}$ is the same as the drive transistor $T_{Drv}$ described in the 5Tr/1C driving circuit, and thus detailed description thereof will not be repeated. The drain region of the drive transistor $T_{Drv}$ is connected to the current supply unit 100. The voltage $V_{CC-H}$ for controlling light emission of the light-emitting unit ELP and the voltage $V_{CC-L}$ for controlling the potential of the source region of the drive transistor $T_{Drv}$ are supplied from the current supply unit 100. The values of the voltage $V_{CC-H}$ and $V_{CC-L}$ may be as follows.

$V_{CC-H}$=20 volt $V_{CC-L}$=−10 volt

However, the voltage $V_{CC-H}$ and $V_{CC-L}$ are not limited to these values.

[Video Signal Write Transistor $T_{Sig}$]

The configuration of the video signal write transistor $T_{Sig}$ is the same as the video signal write transistor $T_{Sig}$ described in the 5Tr/1C driving circuit, and thus detailed description thereof will not be repeated.

[Light-Emitting Unit ELP]

The configuration of the light-emitting unit ELP is the same as the light-emitting unit ELP described in the 5Tr/1C driving circuit, and thus detailed description thereof will not be repeated.

Hereinafter, the operation of the 2Tr/1C driving circuit will be described.

Figure 25A:
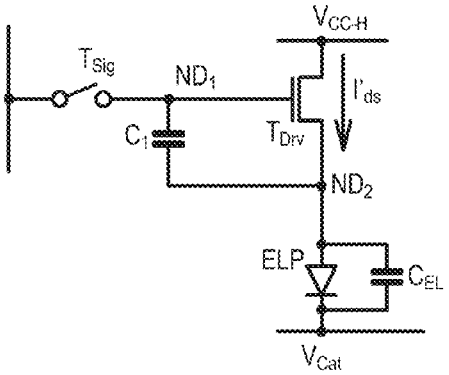
FIGS. 25A to 25F are diagrams schematically showing the on/off state and the like of each transistor which constitutes a 2Tr/1C driving circuit of Examples 1 and 7.

[Period-TP$(2)_{-1}$] (see FIGS. 24 and 25A)

[Period-TP$(2)_{-1}$] is, for example, the operation in the previous display frame, and is substantially the same operation as [Period-TP$(5)_{-1}$] in the 5Tr/1C driving circuit.

[Period-TP$(2)_0$] to [Period-TP$(2)_2$] shown in FIG. 24 are the periods corresponding to [Period-TP$(5)_0$] to [Period-TP$(5)_4$] shown in FIG. 11, and are the operation periods immediately before the next write process is performed. Similarly to the 5Tr/1C driving circuit, in [Period-TP$(2)_0$] to [Period-TP$(2)_2$], the (n,m)th light-emitting unit ELP is in the non-light-emission state. As shown in FIG. 24, the operation of the 2Tr/1C driving circuit is different from the operation of the 5Tr/1C driving circuit in that, in addition to [Period-TP$(2)_3$], [Period-TP$(2)_1$] to [Period-TP$(2)_2$] are also included in the m-th horizontal scanning period. For convenience of description, description will be provided assuming that the beginning of [Period-TP$(2)_1$] and the end of [Period-TP$(2)_3$] respectively match the beginning and end of the m-th horizontal scanning period.

Hereinafter, each period of [Period-TP$(2)_0$] to [Period-TP$(2)_2$] will be described. As described in the 5Tr/1C driving circuit, the length of each period of [Period-TP$(2)_1$] to [Period-TP$(2)_3$] may be appropriately selected in accordance with design for the display device.

Figure 25B:
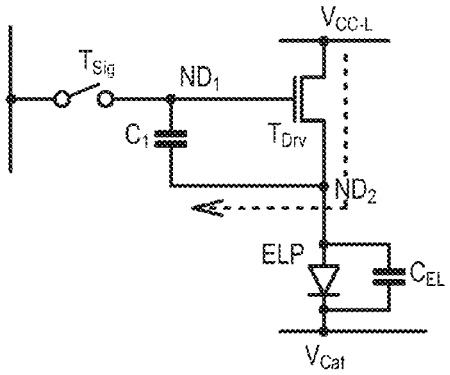

[Period-TP$(2)_0$] (see FIG. 25B)

[Period-TP$(2)_0$] is, for example, the operation from the previous display frame to the current display frame. That is, [Period-TP$(2)_0$] is the period from the (m+m')th horizontal scanning period in the previous display frame to the (m−1)th horizontal scanning period in the current display frame. In [Period-TP$(2)_0$], the (n,m)th light-emitting unit ELP is in the non-light-emission state. At the time of change from [Period-TP$(2)_{-2}$] to [Period-TP$(2)_0$], a voltage which is supplied from the current supply unit 100 is switched from $V_{CC-H}$ to voltage $V_{CC-L}$. As a result, the potential of the second node $ND_2$ (the source region of the drive transistor $T_{Drv}$ or the anode electrode of the light-emitting unit ELP) drops down to $V_{CC-L}$, and the light-emitting unit ELP is placed in the non-light-emission state. In order to follow the potential drop of the second node $ND_2$, the potential of the first node $ND_1$ (the gate electrode of the drive transistor $T_{Drv}$) in the floating state also drops.

Figure 25C:
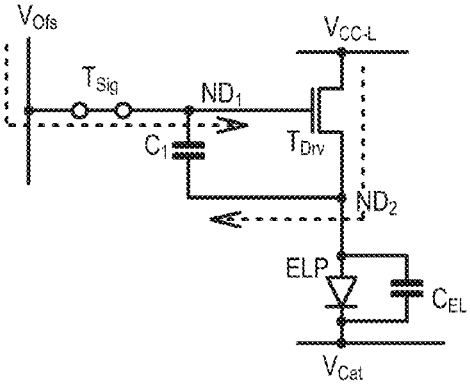

[Period-TP$(2)_1$] (see FIG. 25C)

The horizontal scanning period of the m-th row in the current display frame starts. At the time of the start of [Period-TP$(2)_1$], if the scanning line SCL is at high level on the basis of the operation of the scanning circuit 101, the video signal write transistor $T_{Sig}$ is placed in the on state. As a result, the potential of the first node $ND_1$ becomes $V_{Ofs}$ (for example, 0 volt). The potential of the second node $ND_2$ is held at $V_{CC-L}$ (for example, −10 volt).

With the above process, the potential difference between the gate electrode and the source region of the drive transistor $T_{Drv}$ is equal to or greater than $V_{th}$, and the drive transistor $T_{Drv}$ is placed in the on state.

Figure 25D:
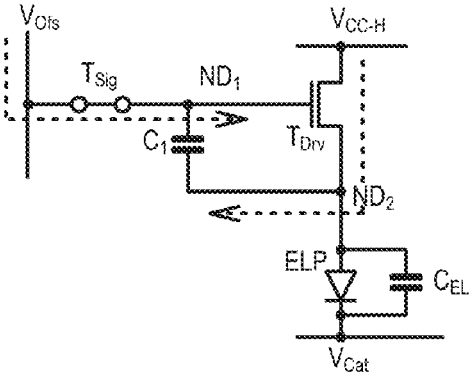

[Period-TP$(2)_2$] (see FIG. 25D)

Next, the threshold voltage cancel process is performed. That is, while the video signal write transistor $T_{Sig}$ is maintained in the on state, the voltage which is supplied from the current supply unit 100 is switched from the voltage $V_{CC-L}$ to the voltage $V_{CC-H}$. As a result, while the potential of the first node $ND_1$ is not changed (maintained at $V_{Ofs}$=0 volt), the potential of the second node $ND_2$ in the floating state rises, and the potential difference between the first node $ND_1$ and the second node $ND_2$ is brought close to the threshold voltage $V_{th}$ of the drive transistor $T_{Drv}$. If the potential difference between the gate electrode and the source region of the drive transistor $T_{Drv}$ reaches $V_{th}$, the drive transistor $T_{Drv}$ is placed in the off state. Specifically, the potential of the second node $ND_2$ in the floating state is brought close to ($V_{Ofs}-V_{th}$=−3 volt) and finally becomes ($V_{Ofs}-V_{th}$). If Expression (2) is assured, in other words, if the potential is selected and determined so as to satisfy Expression (2), the light-emitting unit ELP does not emit light.

In [Period-TP$(2)_2$], the potential of the second node $ND_2$ finally becomes, for example, ($V_{Ofs}-V_{th}$). That is, the potential of the second node $ND_2$ depends on only the threshold voltage $V_{th}$ of the drive transistor $T_{Drv}$ and the voltage $V_{Ofs}$ for initializing the gate electrode of the drive transistor $T_{Drv}$. The potential of the second node $ND_2$ does not depend on the threshold voltage $V_{th-EL}$ of the light-emitting unit ELP.

Figure 25E:
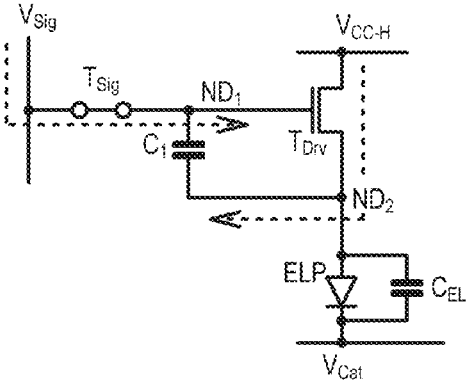

[Period-TP$(2)_3$] (see FIG. 25E)

Next, the write process to the drive transistor $T_{Drv}$ is performed and the potential of the source region of the drive transistor $T_{Drv}$ (the second node $ND_2$) is corrected on the basis of the magnitude of mobility μ of the drive transistor $T_{Drv}$ (mobility correction process). Specifically, the video signal write transistor $T_{Sig}$ is placed in the off state once, the potential of the data line DTL is changed to the driving signal (luminance signal) $V_{Sig}$ for controlling luminance of the light-emitting unit ELP, and then, if the scanning line SCL is at high level (that is, by the slowed scanning signal), the video signal write transistor $T_{Sig}$ is placed in the on state, such that the drive transistor $T_{Drv}$ is placed in the on state.

Unlike the description of the 5Tr/1C driving circuit, since the potential $V_{CC-H}$ is applied from the current supply unit 100 to the drain region of the drive transistor $T_{Drv}$, the potential of the source region of the drive transistor $T_{Drv}$ rises. When a predetermined time ($t_0$) has elapsed, if the scanning line SCL is at low level, the video signal write transistor $T_{Sig}$ is placed in the off state, and the first node $ND_1$ (the gate electrode of the drive transistor $T_{Drv}$) is placed in the floating state. The full time $t_0$ of [Period-TP$(2)_3$] may be determined in advance as a design value at the time of design for the display device such that the potential of the second node $ND_2$ becomes ($V_{Ofs}-V_{th}+\Delta V$).

In [Period-TP$(2)_3$], when the value of mobility μ of the drive transistor $T_{Drv}$ is large, the amount ΔV of rise in the potential of the source region of the drive transistor $T_{Drv}$ is large. When the value of mobility μ of the drive transistor $T_{Drv}$ is small, the amount ΔV of rise in the source region of the drive transistor $T_{Drv}$ is small.

Figure 25F:
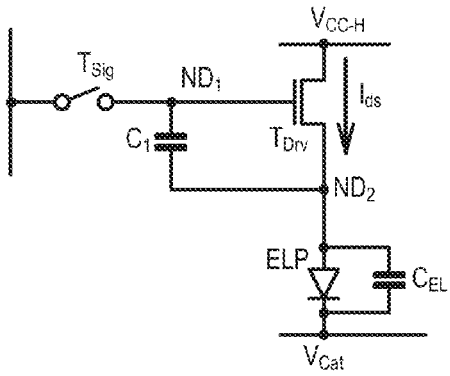

[Period-TP$(2)_4$] (see FIG. 25F)

With the above-described operation, the threshold voltage cancel process, the write process, and the mobility correction process are completed. Since the same process as [Period-TP$(5)_7$] described in the 5Tr/1C driving circuit is performed, and the potential of the second node $ND_2$ rises and exceeds $(V_{th-EL}+V_{Cat})$, the light-emitting unit ELP starts to emit light. At this time, since the current which flows in the light-emitting unit ELP can be obtained by Expression (5), the current $I_{ds}$ which flows in the light-emitting unit ELP does not depend on the threshold voltage $V_{th-EL}$ of the light-emitting unit ELP and the threshold voltage $V_{th}$ of the drive transistor $T_{Drv}$. That is, the light-emission amount (luminance) of the light-emitting unit ELP is not affected by the threshold voltage $V_{th-EL}$ of the light-emitting unit ELP and the threshold voltage $V_{th}$ of the drive transistor $T_{Drv}$. It is also possible to suppress the occurrence of variation in the drain current $I_{ds}$ due to variation in mobility μ of the drive transistor $T_{Drv}$.

The light-emission state of the light-emitting unit ELP continues up to the (m+m'−1)th horizontal scanning period. This time corresponds to the end of [Period-TP$(2)_{-1}$].

With the above, the operation of light emission of the light-emitting unit ELP [the (n,m)th subpixel] is completed.

Although the display device according to the embodiments of the present disclosure and the electronic apparatus have been described on the basis of the preferred examples, the display device according to the embodiments of the present disclosure and the electronic apparatus are not limited to these examples. The configuration or structure of the display device, the light-emitting element, or the driving circuit in the examples are for illustration and may be appropriately changed. The driving method is for illustration, and may be appropriately changed. Although in the examples, various transistors are TFTs, MOSFETs may be substitutively used. For example, in the operation of the 2Tr/1C driving circuit, [Period-TP$(2)_3$] may be divided into two periods of [Period-TP$(2)_3$] and [Period-TP(2) $T_3$]. In [Period-TP$(2)_3$], as described above, the video signal write transistor $T_{Sig}$ may be placed in the off state once, and the potential of the data line DTL may be changed to the driving signal (luminance signal) $V_{Sig}$ for controlling luminance of the light-emitting unit ELP. Thereafter, in [Period-TP$(2)'_3$], if the scanning line SCL is at high level (that is, by the slowed scanning signal), the video signal write transistor $T_{Sig}$ may be placed in the on state, such that the drive transistor $T_{Drv}$ may be placed in the on state. Although in the examples, a case where various transistors are of an n-channel type has been described, in some cases, a part or the whole of the driving circuit may be constituted by a p-channel transistor. The display device according to the embodiments of the present disclosure may be applied to, for example, a television receiver, a monitor constituting a digital camera, a monitor constituting a video camera, a monitor constituting a personal computer, various display units in a personal digital assistant (PDA), a mobile phone, a smart phone, a portable music player, a game machine, an electronic book, and an electronic dictionary, an electronic view finder (EVF), and a head mounted display (HMD). That is, examples of the electronic apparatus according to the embodiment of the present disclosure include a television receiver, a digital camera, a video camera, a personal computer, a PDA, a mobile phone, a smart phone, a portable music player, a game machine, an electronic book, an electronic dictionary, an electronic view finder, and a head mounted display. The display device according to the embodiments of the present disclosure is provided in these electronic apparatuses. Although in the examples, a case where a display unit is exclusively constituted by an organic electroluminescence light-emitting unit has been described, the light-emitting unit may be constituted by a self-luminous light-emitting unit, such as a liquid crystal light-emitting unit, an inorganic electroluminescence light-emitting unit, an LED light-emitting unit, or a semiconductor laser light-emitting unit.

The present disclosure may be implemented as the following configurations.

[1] <<Display Device: First Embodiment>>

A display device including:

(A) scanning circuits;

(B) a video signal output circuit;

(C) a current supply unit;

(D) M current supply lines which are connected to the current supply unit and extend in a first direction;

(E) M scanning lines which are connected to the scanning circuits and extend in the first direction;

(F) N data lines which are connected to the video signal output circuit and extend in a second direction; and (G) N×M light-emitting elements in total of N light-emitting elements in the first direction and M light-emitting elements in the second direction different from the first direction arranged in a two-dimensional matrix, each light-emitting element having a light-emitting unit and a driving circuit for driving the light-emitting unit, wherein the driving circuit of each light-emitting element is connected to the corresponding current supply line, the corresponding scanning line, and the corresponding data line, and a capacitive load unit is provided between each scanning line and each scanning circuit.

[2] The display device described in [1], wherein a second capacitive load unit is provided in the termination portion of each data line.

[3] The display device described in [1] or [2], wherein, when, from each scanning circuit through the capacitive load unit and the corresponding scanning line, the pulse width of a scanning signal which is input to a light-emitting element in the central portion along the first direction and the central portion along the second direction is $PW_{1-C}$, and the pulse width of a scanning signal which is input to a light-emitting element adjacent to each scanning circuit in the central portion along the second direction is $PW_{1-E}$, the following condition is satisfied.

$$0.95 \leq PW_{1-E}/PW_{1-C} < 1$$

[4] The display device described in any one of [1] to [3], wherein the capacitive load unit has a transistor, and the capacitance of the capacitive load unit is constituted by the gate capacitance of the transistor.

[5] The display device described in any one of [1] to [3], wherein the capacitive load unit has two electrodes and a dielectric layer interposed between the two electrodes, and one electrode is constituted by the corresponding scanning line.

[6] The display device described in any one of [1] to [5], wherein the capacitance of the capacitive load unit is determined by the luminance difference between luminance of a light-emitting element in the central portion along the first direction and the central portion along the second direction and luminance of a light-emitting element adjacent to each scanning circuit in the central portion along the second direction, a desired value of the luminance difference, and the parasitic capacitance of the corresponding scanning line per light-emitting element.

[7] The display device described in any one of [1] to [6], wherein the capacitance of the capacitive load unit is 5 times to 200 times greater than the parasitic capacitance of the corresponding scanning line per light-emitting element.

[8] The display device described in any one of [1] to [7], wherein the driving circuit at least includes (A) a drive transistor having source/drain regions, a channel forming region, and a gate electrode, (B) a video signal write transistor having source/drain regions, a channel forming region, and a gate electrode, and (C) a capacitive unit, in the drive transistor, (A-1) one region of the source/drain regions is connected to the corresponding current supply line, (A-2) the other of the source/drain regions is connected to the light-emitting unit and connected to one end of the capacitive unit, and forms a second node, and (A-3) the gate electrode is connected to the other of the source/drain regions of the video signal write transistor and connected to the other end of the capacitive unit, and forms a first node, and in the video signal write transistor, (B-1) one region of the source/drain regions is connected to the corresponding data line, and (B-2) the gate electrode is connected to the corresponding scanning line.

[9] <<Display Device: Second Embodiment>>

A display device including:

(A) scanning circuits;

(B) a video signal output circuit;

(C) a current supply unit;

(D) M current supply lines which are connected to the current supply unit and extend in a first direction;

(E) M scanning lines which are connected to the scanning circuits and extend in the first direction;

(F) N data lines which are connected to the video signal output circuit and extend in a second direction; and (G) N×M light-emitting elements in total of N light-emitting elements in the first direction and M light-emitting elements in the second direction different from the first direction arranged in a two-dimensional matrix, each light-emitting element having a light-emitting unit and a driving circuit for driving the light-emitting unit, wherein the driving circuit of each light-emitting element is connected to the corresponding current supply line, the corresponding scanning line, and the corresponding data line, and a capacitive load unit is provided in the termination portion of each data line.

[10] The display device described in [9], wherein, when, from each scanning circuit through the corresponding scanning line, the pulse width of a scanning signal which is input to a light-emitting element adjacent to each scanning circuit in the termination portion of the corresponding data line is $PW_{2-E}$, and the pulse width of a scanning signal which is input to a light-emitting element adjacent to each scanning circuit in the central portion of the corresponding data line is $PW_{2-C}$, the following condition is satisfied.

$$0.95 \leq PW_{2-E}/PW_{2-C} < 1$$

[11] The display device described in [9] or [10], wherein the capacitive load unit has a transistor, and the capacitance of the capacitive load unit is constituted by the gate capacitance of the transistor.

[12] The display device described in [9] or [10], wherein the capacitive load unit has two electrodes and a dielectric layer interposed between the two electrodes, and one electrode is constituted by the corresponding data line.

[13] The display device described in any one of [9] to [12], wherein the capacitance of the capacitive load unit is determined by the luminance difference between luminance of a light-emitting element adjacent to each scanning circuit in the central portion of the corresponding data line and luminance of a light-emitting element adjacent to each scanning circuit in the termination portion of the corresponding data line, a desired value of the luminance difference, and parasitic capacitance between the scanning line and the data line in one light-emitting element in the termination portion.

[14] The display device described in any one of [9] to [13], wherein the capacitance of the capacitive load unit is 5 times to 10 times greater than parasitic capacitance between the corresponding scanning line and data line per light-emitting element.

[15] The display device described in any one of [9] to [13], wherein the driving circuit at least includes (A) a drive transistor having source/drain regions, a channel forming region, and a gate electrode, (B) a video signal write transistor having source/drain regions, a channel forming region, and a gate electrode, and (C) a capacitive unit, in the drive transistor, (A-1) one region of the source/drain regions is connected to the corresponding current supply line, (A-2) the other of the source/drain regions is connected to the light-emitting unit and connected to one end of the capacitive unit, and forms a second node, and (A-3) the gate electrode is connected to the other of the source/drain regions of the video signal write transistor and connected to the other end of the capacitive unit, and forms a first node, and in the video signal write transistor, (B-1) one region of the source/drain regions is connected to the corresponding data line, and (B-2) the gate electrode is connected to the corresponding scanning line.

[16] <<Electronic Apparatus>>

An electronic apparatus including:

the display device described in any one of [1] to [15].

The present disclosure contains subject matter related to that disclosed in Japanese Priority Patent Application JP 2011-181798 filed in the Japan Patent Office on Aug. 23, 2011, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

scanning circuits;

a video signal output circuit;

a current supply unit;

M current supply lines which are connected to the current supply unit and extend in a first direction;

M scanning lines which are connected to the scanning circuits and extend in the first direction;

N data lines which are connected to the video signal output circuit and extend in a second direction; and N×M light-emitting elements in total of N light-emitting elements in the first direction and M light-emitting elements in the second direction different from the first direction arranged in a two-dimensional matrix, each light-emitting element having a light-emitting unit and a driving circuit for driving the light-emitting unit, wherein the driving circuit of each light-emitting element is connected to the corresponding current supply line, the corresponding scanning line, and the corresponding data line, a capacitive load unit is provided between each scanning line and each scanning circuit, and the capacitance of the capacitive load unit is 5 times to 200 times greater than the parasitic capacitance of the corresponding scanning line per light-emitting element.

2. The display device according to claim 1, wherein a second capacitive load unit is further provided in the termination portion of each data line.

3. The display device according to claim 1, wherein, when, from each scanning circuit through the capacitive load unit and the corresponding scanning line, the pulse width of a scanning signal which is input to a light-emitting element in the central portion along the first direction and the central portion along the second direction is $PW_{1-C}$, and the pulse width of a scanning signal which is input to a light-emitting element adjacent to each scanning circuit in the central portion along the second direction is $PW_{1-E}$, the following condition is satisfied $$0.95 \leq PW_{1-E}/PW_{1-C} < 1.$$

4. The display device according to claim 1, wherein the capacitive load unit has a transistor, and the capacitance of the capacitive load unit is constituted by the gate capacitance of the transistor.

5. The display device according to claim 1, wherein the capacitive load unit has two electrodes and a dielectric layer interposed between the two electrodes, and one electrode is constituted by the corresponding scanning line.

6. The display device according to claim 1, wherein the capacitance of the capacitive load unit is determined by the luminance difference between luminance of a light-emitting element in the central portion along the first direction and the central portion along the second direction and luminance of a light-emitting element adjacent to each scanning circuit in the central portion along the second direction, a desired value of the luminance difference, and the parasitic capacitance of the corresponding scanning line per light-emitting element.

7. The display device according to claim 1, wherein the driving circuit at least includes:

a drive transistor having source/drain regions, a channel forming region, and a gate electrode, a video signal write transistor having source/drain regions, a channel forming region, and a gate electrode, and a capacitive unit, in the drive transistor:

one region of the source/drain regions is connected to the corresponding current supply line, the other of the source/drain regions is connected to the light-emitting unit and connected to one end of the capacitive unit, and forms a second node, and the gate electrode is connected to the other of the source/drain regions of the video signal write transistor and connected to the other end of the capacitive unit, and forms a first node, and in the video signal write transistor:

one region of the source/drain regions is connected to the corresponding data line, and the gate electrode is connected to the corresponding scanning line.

8. An electronic apparatus comprising:

the display device according to claim 1.

9. A display device comprising:

scanning circuits;

a video signal output circuit;

a current supply unit;

M current supply lines which are connected to the current supply unit and extend in a first direction;

M scanning lines which are connected to the scanning circuits and extend in the first direction;

N data lines which are connected to the video signal output circuit and extend in a second direction; and N×M light-emitting elements in total of N light-emitting elements in the first direction and M light-emitting elements in the second direction different from the first direction arranged in a two-dimensional matrix, each light-emitting element having a light-emitting unit and a driving circuit for driving the light-emitting unit, wherein the driving circuit of each light-emitting element is connected to the corresponding current supply line, the corresponding scanning line, and the corresponding data line, a capacitive load unit is provided in the termination portion of each data line, and the capacitance of the capacitive load unit is 5 times to 10 times greater than parasitic capacitance between the corresponding scanning line and data line per light.

10. The display device according to claim 9, wherein, when, from each scanning circuit through the corresponding scanning line, the pulse width of a scanning signal which is input to a light-emitting element adjacent to each scanning circuit in the termination portion of the corresponding data line is $PW_{2-E}$, and the pulse width of a scanning signal which is input to a light-emitting element adjacent to each scanning circuit in the central portion of the corresponding data line is $PW_{2-C}$, the following condition is satisfied $$0.95 \leq PW_{2-E}/PW_{2-C} < 1.$$

11. The display device according to claim 9, wherein the capacitive load unit has a transistor, and the capacitance of the capacitive load unit is constituted by the gate capacitance of the transistor.

12. The display device according to claim 9, wherein the capacitive load unit has two electrodes and a dielectric layer interposed between the two electrodes, and one electrode is constituted by the corresponding data line.

13. The display device according to claim 9, wherein the capacitance of the capacitive load unit is determined by the luminance difference between luminance of a light-emitting element adjacent to each scanning circuit in the central portion of the corresponding data line and luminance of a light-emitting element adjacent to each scanning circuit in the termination portion of the corresponding data line, a desired value of the luminance difference, and parasitic capacitance between the scanning line and the data line in one light-emitting element in the termination portion.

14. The display device according to claim 9, wherein the driving circuit at least includes:

a drive transistor having source/drain regions, a channel forming region, and a gate electrode, a video signal write transistor having source/drain regions, a channel forming region, and a gate electrode, and a capacitive unit, in the drive transistor:

one region of the source/drain regions is connected to the corresponding current supply line, the other of the source/drain regions is connected to the light-emitting unit and connected to one end of the capacitive unit, and forms a second node, and the gate electrode is connected to the other of the source/drain regions of the video signal write transistor and connected to the other end of the capacitive unit, and forms a first node, and in the video signal write transistor:

one region of the source/drain regions is connected to the corresponding data line, and the gate electrode is connected to the corresponding scanning line.

15. An electronic apparatus comprising:

the display device according to claim 9.

* * * * *